US005913490A

United States Patent [19]

McNeil et al.

[11] Patent Number: 5,913,490

[45] Date of Patent: *Jun. 22, 1999

[54] TURRET ASSEMBLY

[75] Inventors: Kevin Benson McNeil, Maineville, Ohio; James Robert Johnson, Lawrenceburg, Ind.

[73] Assignee: Procter & Gamble Company, Cincinnati, Ohio

[ * ] Notice: This patent is subject to a terminal disclaimer.

[21] Appl. No.: 09/111,288

[22] Filed: Jul. 7, 1998

Related U.S. Application Data

[63] Continuation of application No. 08/954,332, Oct. 17, 1997, which is a continuation of application No. 08/459,922, Jun. 2, 1995, Pat. No. 5,690,297.

[51] Int. Cl.[6] ..... B65H 19/28

[52] U.S. Cl. ..... 242/533.4; 242/533.7

[58] Field of Search ..... 242/533–533.7

[56] References Cited

U.S. PATENT DOCUMENTS

| | | | |
|---|---|---|---|
| 2,066,659 | 1/1937 | Templeton et al. . | |
| 2,733,022 | 1/1956 | Grody . | |
| 2,903,200 | 9/1959 | McDougal et al. . | |
| 3,554,455 | 1/1971 | Graf . | |
| 3,606,188 | 9/1971 | Wagner . | |
| 3,774,921 | 11/1973 | Gifford . | |
| 3,780,962 | 12/1973 | Sykora . | |
| 3,989,202 | 11/1976 | Noe et al. . | |
| 5,660,350 | 8/1997 | Byrne et al. | 242/533.4 |
| 5,667,162 | 9/1997 | McNeil et al. | 242/533.4 |
| 5,690,297 | 11/1997 | McNeil et al. | 242/533.4 |
| 5,732,901 | 3/1998 | McNeil et al. | 242/533.4 |
| 5,810,282 | 9/1998 | McNeil et al. | 242/533.4 |

FOREIGN PATENT DOCUMENTS

| | | |
|---|---|---|
| 875630 | 9/1942 | France . |
| 1133273 | 3/1957 | France . |
| 1546103 | 11/1968 | France . |
| 1547103 | 11/1968 | France . |
| 1601502 | 10/1970 | France . |
| 1429 | 12/1877 | Germany . |

*Primary Examiner*—John P. Darling

*Attorney, Agent, or Firm*—Jay A. Krebs; Larry L. Huston; E. Kelly Linman

[57] ABSTRACT

A web winding apparatus and a method of operating the apparatus include a turret assembly, a core loading apparatus, and a core stripping apparatus. The turret assembly supports rotatably driven mandrels for engaging hollow cores upon which a paper web is wound. Each mandrel is driven in a closed mandrel path, which can be non-circular. The core loading apparatus conveys cores onto the mandrels during movement of the mandrels along the core loading segment of the closed mandrel path, and the core stripping apparatus removes each web wound core from its respective mandrel during movement of the mandrel along the core stripping segment of the closed mandrel path. The turret assembly can be rotated continuously, and the sheet count per wound log can be changed as the turret assembly is rotating. The apparatus can also include a mandrel having a deformable core engaging member.

15 Claims, 26 Drawing Sheets

TURRET ASSEMBLY

This application is a continuation of application Ser. No. 08/954,332 filed Oct. 17, 1997 which is a continuation of application Ser. No. 08/459,922 filed Jun. 2, 1995, now U.S. Pat. No. 5,690,297.

FIELD OF THE INVENTION

This invention is related to an apparatus for winding web material such as tissue paper or paper toweling into individual logs. More particularly, the invention is related to a turret winder for winding web material into individual logs.

BACKGROUND OF THE INVENTION

Turret winders are well known in the art. Conventional turret winders comprise a rotating turret assembly which supports a plurality of mandrels for rotation about a turret axis. The mandrels travel in a circular path at a fixed distance from the turret axis. The mandrels engage hollow cores upon which a paper web can be wound. Typically, the paper web is unwound from a parent roll in a continuous fashion, and the turret winder rewinds the paper web onto the cores supported on the mandrels to provide individual, relatively small diameter logs.

While conventional turret winders may provide for winding of the web material on mandrels as the mandrels are carried about the axis of a turret assembly, rotation of the turret assembly is indexed in a stop and start manner to provide for core loading and log unloading while the mandrels are stationary. Turret winders are disclosed in the following U.S. Pat. Nos. : 2,769,600 issued Nov. 6, 1956 to Kwitek et al; U.S. Pat. No. 3,179,348 issued Sep. 17, 1962 to Nystand et al.; U.S. Pat. No. 3,552,670 issued Jun. 12, 1968 to Herman; and U.S. Pat. No. 4,687,153 issued Aug. 18, 1987 to McNeil. Indexing turret assemblies are commercially available on Series 150, 200, and 250 rewinders manufactured by the Paper Converting Machine Company of Green Bay, Wis.

The Paper Converting Machine Company Pushbutton Grade Change 250 Series Rewinder Training Manual discloses a web winding system having five servo controlled axes. The axes are odd metered winding, even metered winding, coreload conveyor, roll strip conveyor, and turret indexing. Product changes, such as sheet count per log, are said to be made by the operator via a terminal interface. The system is said to eliminate the mechanical cams, count change gears or pulley and conveyor sprockets.

Various constructions for core holders, including mandrel locking mechanisms for securing a core to a mandrel, are known in the art. U.S. Pat. No. 4,635,871 issued Jan. 13, 1987 to Johnson et al. discloses a rewinder mandrel having pivoting core locking lugs. U.S. Pat. No. 4,033,521 issued Jul. 5, 1977 to Dee discloses a rubber or other resilient expansible sleeve which can be expanded by compressed air so that projections grip a core on which a web is wound. Other mandrel and core holder constructions are shown in U.S. Pat. Nos. 3,459,388; 4,230,286; and 4,174,077.

Indexing of the turret assembly is undesirable because of the resulting inertia forces and vibration caused by accelerating and decelerating a rotating turret assembly. In addition, it is desirable to speed up converting operations, such as rewinding, especially where rewinding is a bottleneck in the converting operation.

Accordingly, it is an object of the present invention to provide an apparatus for winding a continuous web of material into individual logs.

Another object of the present invention is to provide a turret assembly for carrying mandrels in a non-circular closed path.

Another object of the present invention is provide a turret winder capable of rotating continuously at a generally constant angular velocity.

Another object of the present invention is to provide a turret assembly having a rotating mandrel support, wherein each mandrel is supported for translation relative to the mandrel support and for rotation about a mandrel axis.

Another object of the present invention is to provide a turret assembly comprising replaceable sectors for changing the shape of a closed mandrel path.

SUMMARY OF THE INVENTION

The present invention comprises a web winding apparatus for winding a continuous web of material into individual logs. In one embodiment of the present invention, the web winding apparatus comprises a turret winder having a rotatably driven turret assembly supported on a frame for rotation about a turret assembly central axis. The turret assembly supports a plurality of rotatably driven mandrels for engaging cores upon which a paper web is wound. Each mandrel extends from a first mandrel end to a second mandrel end and has a mandrel axis generally parallel to the turret assembly central axis. Each mandrel is supported on the turret assembly for independent rotation of the mandrel about its mandrel axis, and each mandrel is driven in a closed mandrel path about the turret assembly central axis. The closed mandrel path has a predetermined core loading segment, a predetermined web winding segment, and a predetermined core stripping segment. The distance between a mandrel and the turret assembly central axis varies as a function of the position of the mandrel along the closed mandrel path.

The turret assembly can include a rotating mandrel support for supporting the mandrels. Each mandrel is supported for translation relative to the rotating mandrel support, and each mandrel is supported for rotation of the mandrel about its mandrel axis. In one embodiment, the mandrels are slidably supported for translation relative to the rotating mandrel support along a path having a radial component and a tangential component relative to the turret assembly central axis.

The web winding apparatus can further include a stationary mandrel guide for positioning the mandrels along the closed path. Each mandrel can be supported for rotation about its mandrel axis on a mandrel bearing support assembly, with each mandrel bearing support assembly slidably engaging the rotating mandrel support. The mandrel guide can have a cam surface corresponding to the closed mandrel path. A cam follower is associated with each mandrel bearing support. As the mandrel bearing supports are carried about the turret assembly central axis on the rotating mandrel support, the cam follower associated with each mandrel bearing support engages the cam surface of the mandrel guide. Engagement of a cam follower with the cam surface positions the associated mandrel radially and tangentially with respect to the turret assembly central axis, thereby providing a noncircular closed mandrel path.

In one embodiment, the mandrel guide comprises replaceable sectors. Each replaceable sector can include a portion of the full cam surface. Sectors with differently shaped, corresponding segments of the full cam surface can be interchanged to vary the shape of the closed mandrel path.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
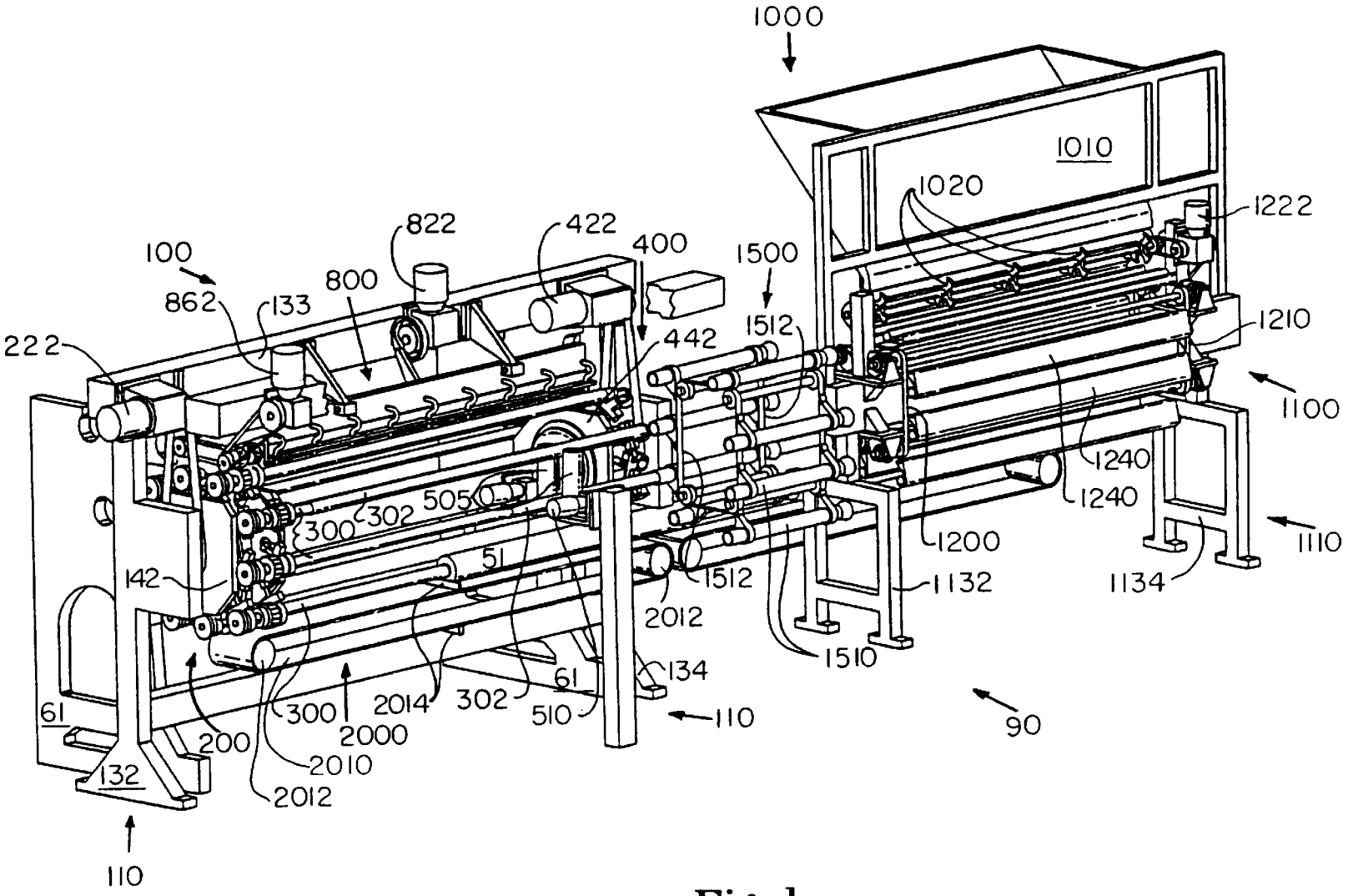
FIG. 1 is a perspective view of the turret winder, core guide apparatus, and core loading apparatus of the present invention.
Figure 2:
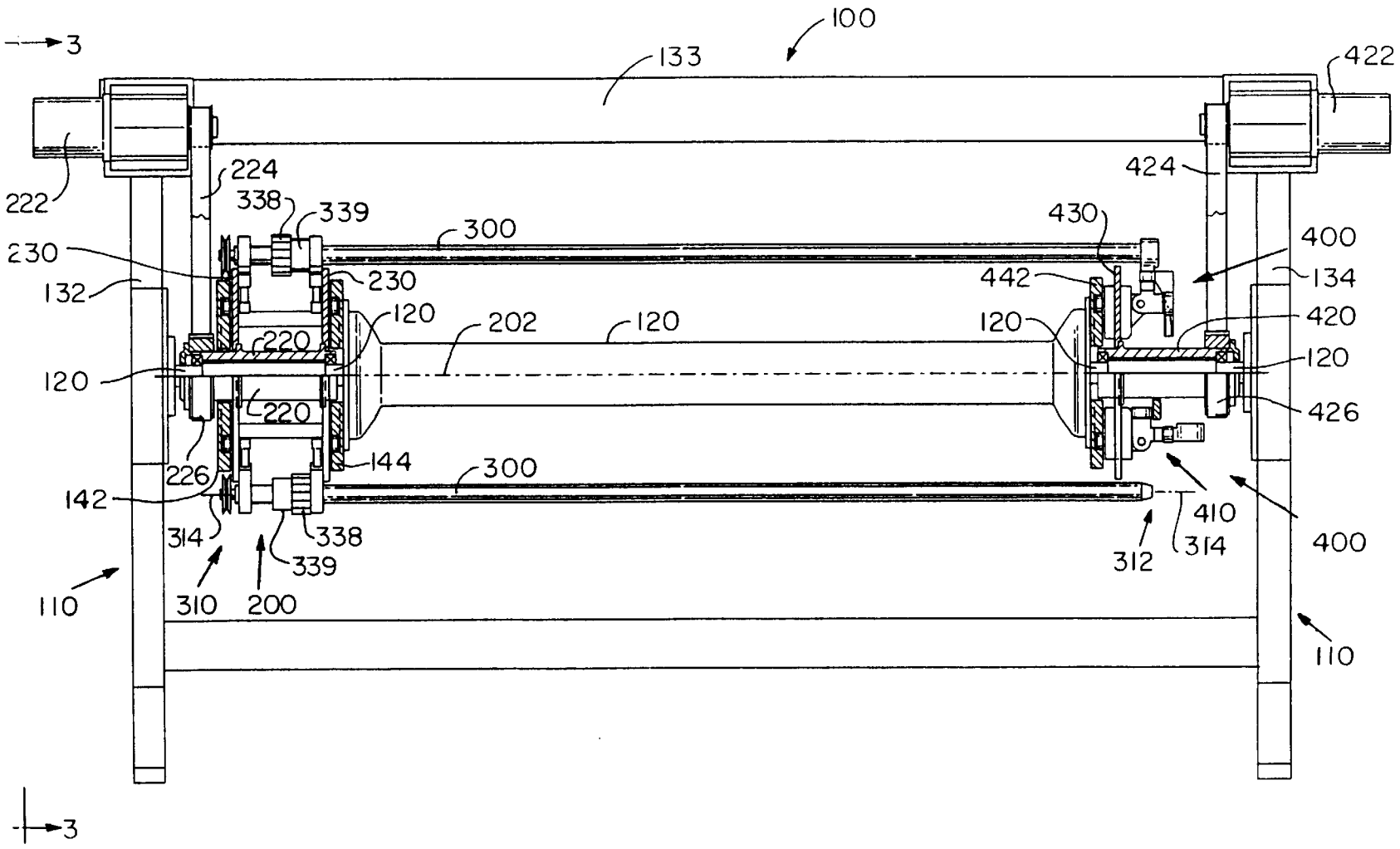
FIG. 2 is a partially cut away front view of the turret winder of the present invention.

FIG. 1 is a perspective view showing the front of a web winding apparatus 90 according to the present invention. The web winding apparatus 90 comprises a turret winder 100 having a stationary frame 110, a core loading apparatus 1000, and a core stripping apparatus 2000. FIG. 2 is a partial front view of the turret winder 100. FIG. 3 is a partial side view of the turret winder 100 taken along lines 3—3 in FIG. 2, showing a conventional web rewinder assembly upstream of the turret winder 100.

Description of Core Loading, Winding, and Stripping

Figure 3A:
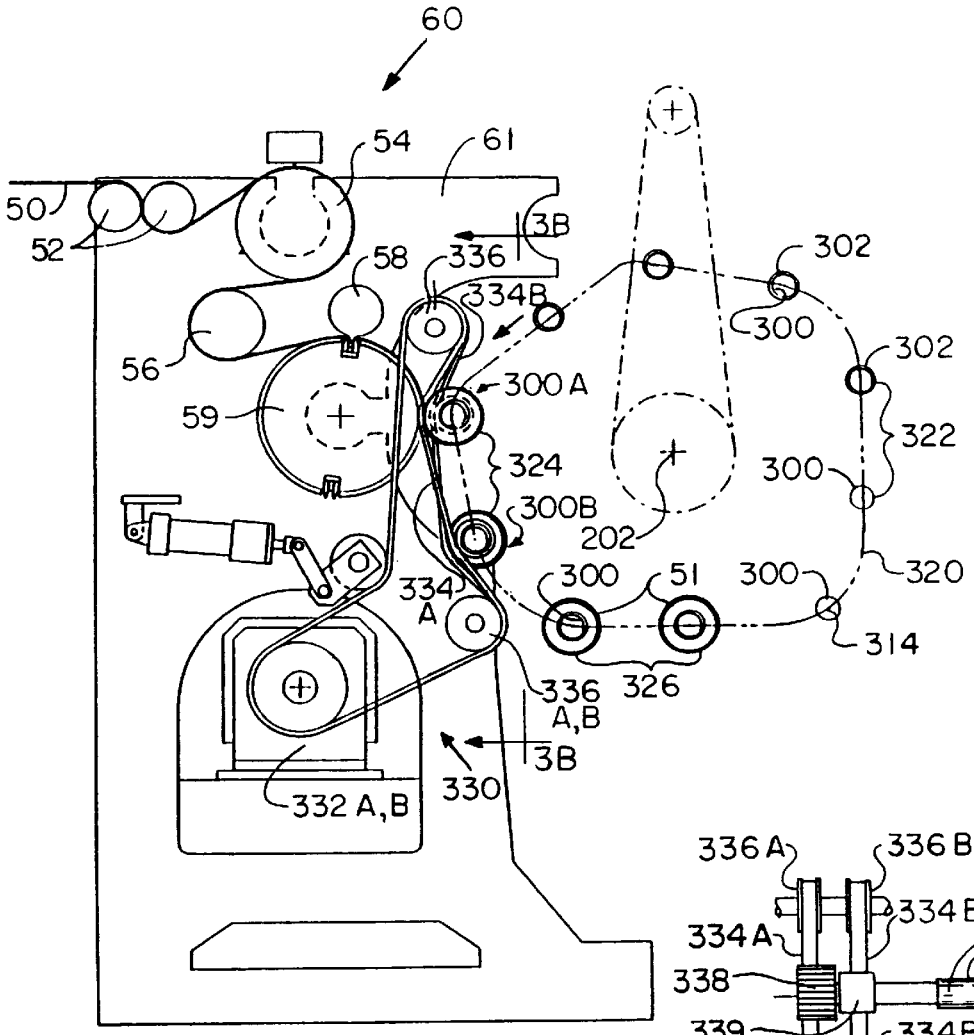
FIG. 3A is a side view showing the position of the closed mandrel path and mandrel drive system of the turret winder of the present invention relative to an upstream conventional rewinder assembly.
Figure 3B:
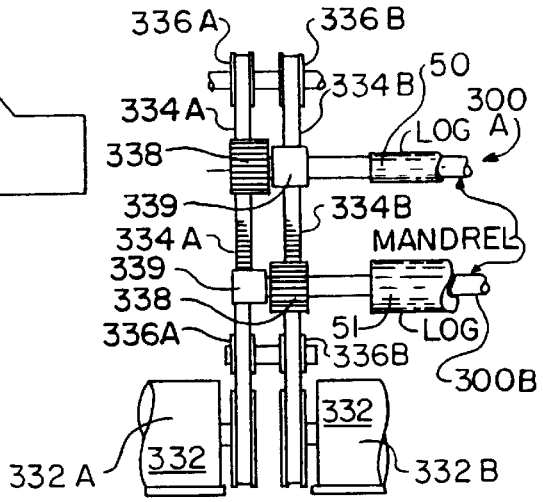
FIG. 3B is a partial front view of the mandrel drive system shown in FIG. 3A taken along lines 3B—3B in FIG. 3A.

Referring to FIG. 1, 2 and 3A/B, the turret winder 100 supports a plurality of mandrels 300. The mandrels 300 engage cores 302 upon which a paper web is wound. The mandrels 300 are driven in a closed mandrel path 320 about a turret assembly central axis 202. Each mandrel 300 extends along a mandrel axes 314 generally parallel to the turret assembly central aids 202, from a first mandrel end 310 to a second mandrel end 312. The mandrels 300 are supported at their first ends 310 by a rotatably driven turret assembly 200. The mandrels 300 are releasably supported at their second ends 312 by a mandrel cupping assembly 400. The turret winder 100 preferably supports at least three mandrels 300, more preferably at least 6 mandrels 300, and in one embodiment the turret winder 100 supports ten mandrels 300. A turret winder 100 supporting at least 10 mandrels 300 can have a rotatably driven turret assembly 200 which is rotated at a relatively low angular velocity to reduce vibration and inertia loads, while providing increased throughput relative to a indexing turret winder which is intermittently rotated at higher angular velocities.

As shown in FIG. 3A, the closed mandrel path 320 can be non-circular, and can include a core loading segment 322, a web winding segment 324, and a core stripping segment 326. The core loading segment 322 and the core stripping segment 326 can each comprise a generally straight line portion. By the phrase "a generally straight line portion" it is meant that a segment of the closed mandrel path 320 includes two points on the closed mandrel path, wherein the straight line distance between the two points is at least 10 inches, and wherein the maximum normal deviation of the closed mandrel path extending between the two points from a straight line drawn between the two points is no more than about 10 percent, and in one embodiment is no more than about 5 percent. The maximum normal deviation of the portion of the closed mandrel path extending between the two points is calculated by: constructing an imaginary line between the two points; determining the maximum distance from the imaginary straight line to the portion of the closed mandrel path between the two points, as measured perpendicular to the imaginary straight line; and dividing the maximum distance by the straight line distance between the two points (10 inches).

In one embodiment of the present invention, the core loading segment 322 and the core stripping segment 326 can each comprise a straight line portion having a maximum normal deviation of less than about 5.0 percent. By way of example, the core loading segment 322 can comprise a straight line portion having a maximum deviation of about 0.15–0.25 percent, and the core stripping segment can comprise a straight line portion having a maximum deviation of about 0.5–5.0 percent. Straight line portions with such maximum deviations permit cores to be accurately and easily aligned with moving mandrels during core loading, and permit stripping of empty cores from moving mandrels in the event that web material is not wound onto one of the cores. In contrast, for a conventional indexing turret having a circular closed mandrel path with a radius of about 10 inches, the normal deviation of the circular closed mandrel path from a 10 inch long straight chord of the circular mandrel path is about 13.4 percent, The second ends 312 of the mandrels 300 are not engaged by, or otherwise supported by, the mandrel cupping assembly 400 along the core loading segment 322. The core loading apparatus 1000 comprises one or more driven core loading components for conveying the cores 302 at least part way onto the mandrels 300 during movement of the mandrels 300 along the core loading segment 322. A pair of rotatably driven core drive rollers 505 disposed on opposite sides of the core loading segment 322 cooperate to receive a core from the core loading apparatus 1000 and complete driving of the core 302 onto the mandrel 300. As shown in FIG. 1, loading of one core 302 onto a mandrel 300 is initiated at the second mandrel end 312 before loading of another core on the preceding adjacent mandrel is completed. Accordingly, the delay and inertia forces associated with start and stop indexing of conventional turret assemblies is eliminated.

Once core loading is complete on a particular mandrel 300, the mandrel cupping assembly 400 engages the second end 312 of the mandrel 300 as the mandrel moves from the core loading segment 322 to the web winding segment 324, thereby providing support to the second end 312 of the mandrel 300. Cores 302 loaded onto mandrels 300 are carried to the web winding segment 324 of the closed mandrel path 320. Intermediate the core loading segment 322 and the web winding segment 324, a web securing adhesive can be applied to the core 302 by an adhesive application apparatus 800 as the core and its associated mandrel are carried along the closed mandrel path.

As the core 302 is carried along the web winding segment 324 of the closed mandrel path 320, a web 50 is directed to the core 302 by a conventional rewinder assembly 60 disposed upstream of the turret winder 100. The rewinder assembly 60 is shown in FIG. 3, and includes feed rolls 52 for carrying the web 50 to a perforator roll 54, a web slitter bed roll 56, and a chopper roll 58 and bedroll 59.

The perforator roll 54 provides lines of perforations extending along the width of the web 50. Adjacent lines of perforations are spaced apart a predetermined distance along the length of the web 50 to provide individual sheets joined together at the perforations. The sheet length of the individual sheets is the distance between adjacent lines of perforations.

The chopper roll 58 and bedroll 59 severe the web 50 at the end of one log wind cycle, when web winding on one core 302 is complete. The bedroll 59 also provides transfer of the free end of the web 50 to the next core 302 advancing along the closed mandrel path 320. Such a rewinder assembly 60, including the feed rolls 52, perforator roll 54, web slitter bed roll 56, and chopper roll and bedroll 58 and 59, is well known in the art. The bedroll 59 can have plural radially moveable members having radially outwardly extending fences and pins, and radially moveable booties, as is known in the art. The chopper roll can have a radially outwardly extending blade and cushion, as is known in the art. U.S. Pat. No. 4,687,153 issued Aug. 18, 1987 to McNeil is incorporated herein by reference for the purpose of generally disclosing the operation of the bedroll and chopper roll in providing web transfer. A suitable rewinder assembly 60 including rolls 52, 54, 56, 58 and 59 can be supported on a frame 61 and is manufactured by the Paper Converting Machine Company of Green Bay Wis. as a Series 150 rewinder system.

The bedroll can include a chopoff solenoid for activating the radial moveable members. The solenoid activates the radial moveable members to sever the web at the end of a log wind cycle, so that the web can be transferred for winding on a new, empty core. The solenoid activation timing can be varied to change the length interval at which the web is severed by the bedroll and chopper roll. Accordingly, if a change in sheet count per log is desired, the solenoid activation timing can be varied to change the length of the material wound on a log.

A mandrel drive apparatus 330 provides rotation of each mandrel 300 and its associated core 302 about the mandrel axis 314 during movement of the mandrel and core along the web winding segment 324. The mandrel drive apparatus 330 thereby provides winding of the web 50 upon the core 302 supported on the mandrel 300 to form a log 51 of web material wound around the core 302 (a web wound core). The mandrel drive apparatus 330 provides center winding of the paper web 50 upon the cores 302 (that is, by connecting the mandrel with a drive which rotates the mandrel 300 about its axis 314, so that the web is pulled onto the core), as opposed to surface winding wherein a portion of the outer surface on the log 51 is contacted by a rotating winding drum such that the web is pushed, by friction, onto the mandrel.

The center winding mandrel drive apparatus 330 can comprise a pair of mandrel drive motors 332A and 332B, a pair of mandrel drive belts 334A and 334B, and idler pulleys 336A and 336B. Referring to FIGS. 3A/B and 4, the first and second mandrel drive motors 332A and 332B drive first and second mandrel drive belts 334A and 334B, respectively around idler pulleys 336A and 336B. The first and second drive belts 334A and 334B transfer torque to alternate mandrels 300. In FIG. 3A, motor 332A, belt 334A, and pulleys 336A are in front of motor 332B, belt 334B, and pulleys 336B, respectively.

In FIGS. 3A/B, a mandrel 300A (an "even" mandrel) supporting a core 302 just prior to receiving the web from the bed roll 59 is driven by mandrel drive belt 334A, and an adjacent mandrel 300B (an "odd" mandrel) supporting a core 302B upon which winding is nearly complete is driven by mandrel drive belt 334B. A mandrel 300 is driven about its axis 314 relatively rapidly just prior to and during initial transfer of the web 50 to the mandrel's associated core. The rate of rotation of the mandrel provided by the mandrel drive apparatus 330 slows as the diameter of the web wound on the mandrel's core increases. Accordingly, adjacent mandrels 300A and 330B are driven by alternate drive belts 334A and 334B so that the rate of rotation of one mandrel can be controlled independently of the rate of rotation of an adjacent mandrel. The mandrel drive motors 332A and 332B can be controlled according to a mandrel winding speed schedule, which provides the desired rotational speed of a mandrel 300 as a function of the angular position of turret assembly 200. Accordingly, the speed of rotation of the mandrels about their axes during winding of a log is synchronized with the angular position of the mandrels 300 on the turret assembly 200. It is known to control the rotational speed of mandrels with a mandrel speed schedule in conventional rewinders.

Each mandrel 300 has a toothed mandrel drive pulley 338 and a smooth surfaced, free wheeling idler pulley 339, both disposed near the first end 310 of the mandrel, as shown in FIG. 2. The positions of the drive pulley 338 and idler pulley 339 alternate on every other mandrel 300, so that alternate mandrels 300 are driven by mandrel drive belts 334A and 334B, respectively. For instance, when to mandrel drive belt 334A engages the mandrel drive pulley 338 on mandrel 300A, the mandrel drive belt 334B rides over the smooth surface of the idler pulley 339 on that same mandrel 300A, so that only drive motor 332A provides rotation of that mandrel 300A about its axis 314. Similarly, when the mandrel drive belt 334B engages the mandrel drive pulley 339 on an adjacent mandrel 300B, the mandrel drive belt 334A rides over the smooth surface of the idler pulley 339 on that mandrel 300B, so that only drive motor 332B provides rotation of the mandrel 300B about its axis 314. Accordingly, each drive pulley on a mandrel 300 engages one of the belts 334A/334B to transfer torque to the mandrel 300, and the idler pulley 339 engages the other of the belts 334A/334B, but does not transfer torque from the drive belt to the mandrel.

The web wound cores are carried along the closed mandrel path 320 to the core stripping segment 326 of the closed mandrel path 320. Intermediate the web winding segment 324 and the core stripping segment 326, a portion of the mandrel cupping assembly 400 disengages from the second end 312 of the mandrel 300 to permit stripping of the log 51 from the mandrel 300. The core stripping apparatus 2000 is positioned along the core stripping segment 326. The core stripping apparatus 2000 comprises a driven core stripping component, such as an endless conveyor belt 2010 which is continuously driven around pulleys 2012. The conveyor belt 2010 carries a plurality of eights 2014 spaced apart on the conveyor belt 2010. Each flight 2014 engages the end of a log 51 supported on a mandrel 300 as the mandrel moves along the core stripping segment 326.

The flighted conveyor belt 2010 can be angled with respect to mandrel axes 314 as the mandrels are carried along a generally straight line portion of the core stripping segment 326 of the closed mandrel path, such that the flights 2014 engage each log 51 with a first velocity component generally parallel to the mandrel axis 314, and a second velocity component generally parallel to the straight line portion of the core stripping segment 326. The core stripping apparatus 2000 is described in more detail below. Once the log 51 is stripped from the mandrel 300, the mandrel 300 is carried along the closed mandrel path to the core loading segment 322 to receive another core 302.

Having described core loading, winding and stripping generally, the individual elements of the web winding apparatus 90 and their functions will now be described in detail.

Turret Winder

Mandrel Support

Referring to FIGS. 1–4, the rotatably driven turret assembly 200 is supported on the stationary frame 110 for rotation about the turret assembly central axis 202. The frame 110 is preferably separate from the rewinder assembly frame 61 to isolate the turret assembly 200 from vibrations caused by the rewinder assembly 60. The rotatably driven turret assembly 200 supports each mandrel 300 adjacent the first end 310 of the mandrel 300. Each mandrel 300 is supported on the rotatably driven turret assembly 200 for independent rotation of the mandrel 300 about its mandrel axis 314, and each mandrel is carried on the rotatably driven turret assembly along the closed mandrel path 320. Preferably, at least a portion of the mandrel path 320 is non-circular, and the distance between the mandrel axis 314 and the turret assembly central axis 202 varies as a function of position of the mandrel 300 along the closed mandrel path 320.

Figure 4:
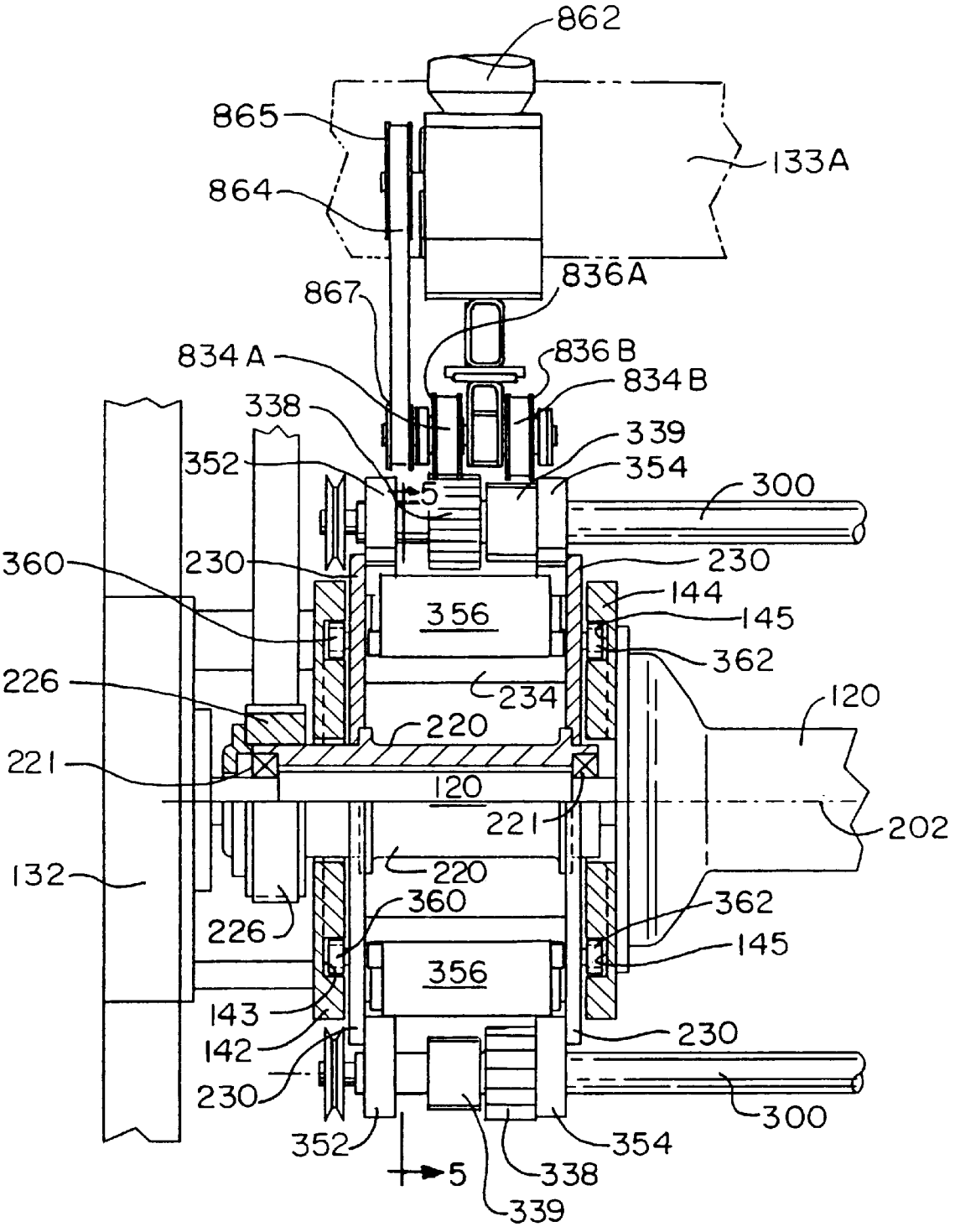
FIG. 4 is an enlarged front view of the rotatably driven turret assembly shown in FIG. 2.

Referring to FIG. 2, and 4, the turret winder stationary frame 110 comprises a horizontally extending stationary support 120 extending intermediate upstanding frame ends 132 and 134. The rotatably driven turret assembly 200 comprises a turret hub 220 which is rotatably supported on the support 120 adjacent the upstanding frame end 132 by bearings 221. Portions of the assembly are shown cut away in FIGS. 2 and 4 for clarity. A turret hub drive servo motor 222 mounted on the frame 110 delivers torque to the turret hub 220 through a belt or chain 224 and a sheeve or sprocket 226 to rotatably drive the turret hub 220 about the turret assembly central axis 202. The servo motor 222 is controlled to phase the rotational position of the turret assembly 200 with respect to a position reference. The position reference can be a function of the angular position of the bedroll 59 about its axis of rotation, and a function of an accumulated number of revolutions of the bedroll 59. In particular, the position of the turret assembly 200 can be phased with respect to the position of the bedroll 59 within a log wind cycle, as described more fully below.

In one embodiment, the turret hub 220 can be driven continuously, in a non-stop, non-indexing fashion, so that the turret assembly 200 rotates continuously. By "rotates continuously" it is meant that the turret assembly 200 makes multiple, full revolutions about its axis 202 without stopping. The turret hub 220 can be driven at a generally constant angular velocity, so that the turret assembly 200 rotates at a generally constant angular velocity. By "driven at a generally constant angular velocity" it is meant that the turret assembly 200 is driven to rotate continuously, and that the rotational speed of the turret assembly 200 varies less than about 5 percent, and preferably less than about 1 percent, from a baseline value. The turret assembly 200 can support 10 mandrels 300, and the turret hub 220 can be driven at a baseline angular velocity of between about 2–4 RPM, for winding between about 20–40 logs 51 per minute. For instance, the turret hub 220 can be driven at a baseline angular velocity of about 4 RPM for winding about 40 logs per minute, with the angular velocity of the turret assembly varying less than about 0.04 RPM.

Referring to FIGS. 2, 4, 5, 6, 7, and 8, a rotating mandrel support extends from the turret hub 220. In the embodiment shown, the rotating mandrel support comprises first and second rotating mandrel support plates 230 rigidly joined to the hub for rotation with the hub about the axis 202. The rotating mandrel support plates 230 are spaced one from the other along the axis 202. Each rotating mandrel support plate 230 can have a plurality of elongated slots 232 (FIG. 5) extending there through. Each slot 232 extends along a path having a radial and a tangential component relative to the axis 202. A plurality of cross members 234 (FIGS. 4 and 6–8) extend intermediate and are rigidly joined to the rotating mandrel support plates 230. Each cross member 234 is associated with and extends along an elongated slot on the first and second rotating mandrel support plates 230.

The first and second rotating mandrel support plates 230 are disposed intermediate first and second stationary mandrel guide plates 142 and 144. The first and second mandrel guide plates 142 and 144 are joined to a portion of the frame 110, such as the frame end 132 or the support 120, or alternatively, can be supported independently of the frame 110. In the embodiment shown, mandrel guide plate 142 can be supported by frame end 132 and the second mandrel guide plate 144 can be supported on the support 120.

The first mandrel guide plate 142 comprises a first cam surface, such as a cam surface groove 143, and the second mandrel guide plate 144 comprises a second cam surface, such as a cam surface groove 145. The first and second cam surface grooves 143 and 145 are disposed on oppositely facing surfaces of the first and second mandrel guide plates 142 and 144, and are spaced apart from one another along the axis 202. Each of the grooves 143 and 145 define a closed path around the turret assembly central axis 202. The cam surface grooves 143 and 145 can, but need not be, mirror images of one another. In the embodiment shown, the cam surfaces are grooves 143 and 145, but it will be understood that other cam surfaces, such as external cam surfaces, could be used.

Figure 7:
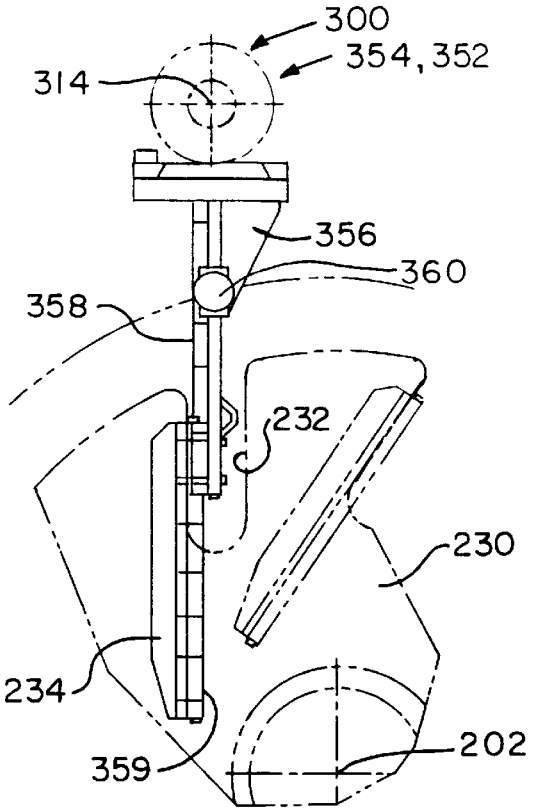
FIG. 7 is a sectional view taken along lines 7—7 in FIG. 6 and showing a mandrel extended relative to a rotating mandrel support plate.
Figure 8:
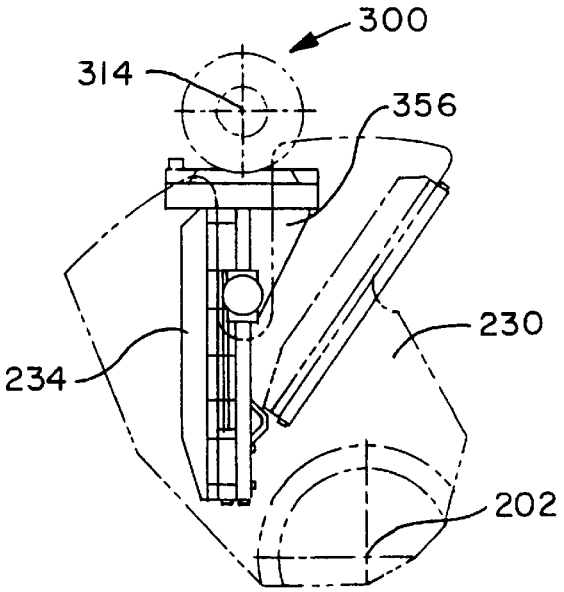
FIG. 8 is a view similar to that of FIG. 7 showing the mandrel retracted relative to the rotating mandrel support plate.
Figure 9:
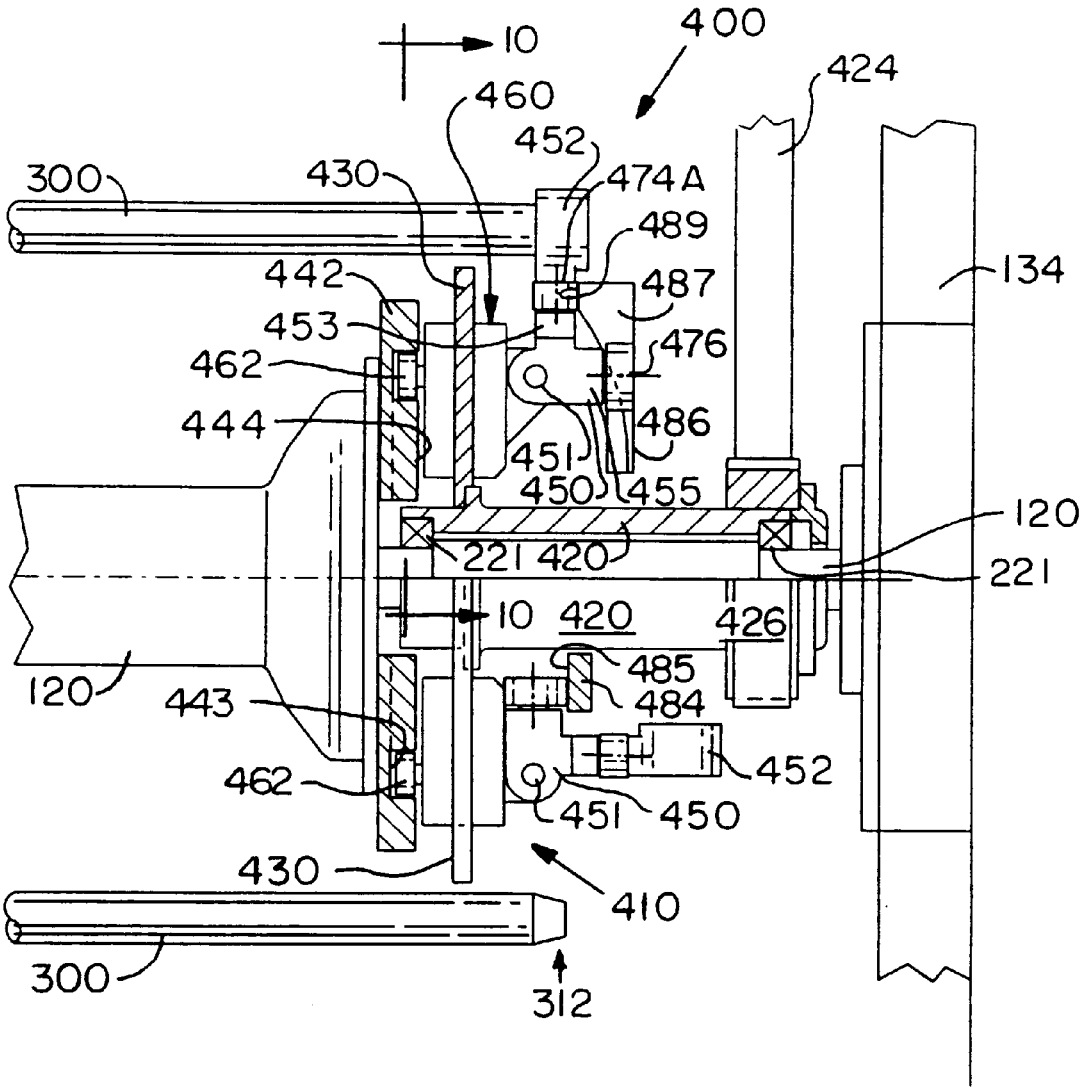
FIG. 9 is an enlarged view of the mandrel cupping assembly shown in FIG. 2.

The mandrel guide plates 142 and 144 act as a mandrel guide for positioning the mandrels 300 along the closed mandrel path 320 as the mandrels are carried on the rotating mandrel support plates 230. Each mandrel 300 is supported for rotation about its mandrel axis 314 on a mandrel bearing support assembly 350. The mandrel bearing support assembly 350 can comprise a first bearing housing 352 and a second bearing housing 354 rigidly joined to a mandrel slide plate 356. Each mandrel slide plate 356 is slidably supported on a cross member 234 for translation relative to the cross member 234 along a path having a radial component relative to the axis 202 and a tangential component relative to the axis 202. FIGS. 7 and 9 show translation of the mandrel slide plate 356 relative to the cross member 234 to vary the distance from the mandrel axis 314 to the turret assembly central axis 202. In one embodiment, the mandrel slide plate can be slidably supported on a cross member 234 by a plurality of commercially available linear bearing slide 358 and rail 359 assemblies. Accordingly, each mandrel 300 is supported on the rotating mandrel support plates 230 for translation relative to the rotating mandrel support plates along a path having a radial component and a tangential component relative to the turret assembly central axis 202. Suitable slides 358 and mating rails 359 are ACCUGLIDE CARRIAGES manufactured by Thomson Incorporated of Port Washington, N.Y.

Each mandrel slide plate 356 has first and second cylindrical cam followers 360 and 362. The first and second cam followers 360 and 362 engage the cam surface grooves 143 and 145, respectively, through the grooves 232 in the first and second rotating mandrel support plates 230. As the mandrel bearing support assemblies 350 are carried around the axis 202 on the rotating mandrel support plates 230, the cam followers 360 and 362 follow the grooves 143 and 145 on the mandrel guide plates, thereby positioning the mandrels 300 along the closed mandrel path 320.

The servo motor 222 can drive the rotatably driven turret assembly 200 continuously about the central axis 202 at a generally constant angular velocity. Accordingly, the rotating mandrel support plates 230 provide continuous motion of the mandrels 300 about the closed mandrel path 320. The lineal speed of the mandrels 300 about the closed path 320 will increase as the distance of the mandrel axis 314 from the axis 202 increases. A suitable servo motor 222 is a 4 hp Model HR2000 servo motor manufactured by the Reliance Electric Company of Cleveland, Ohio.

Figure 5:
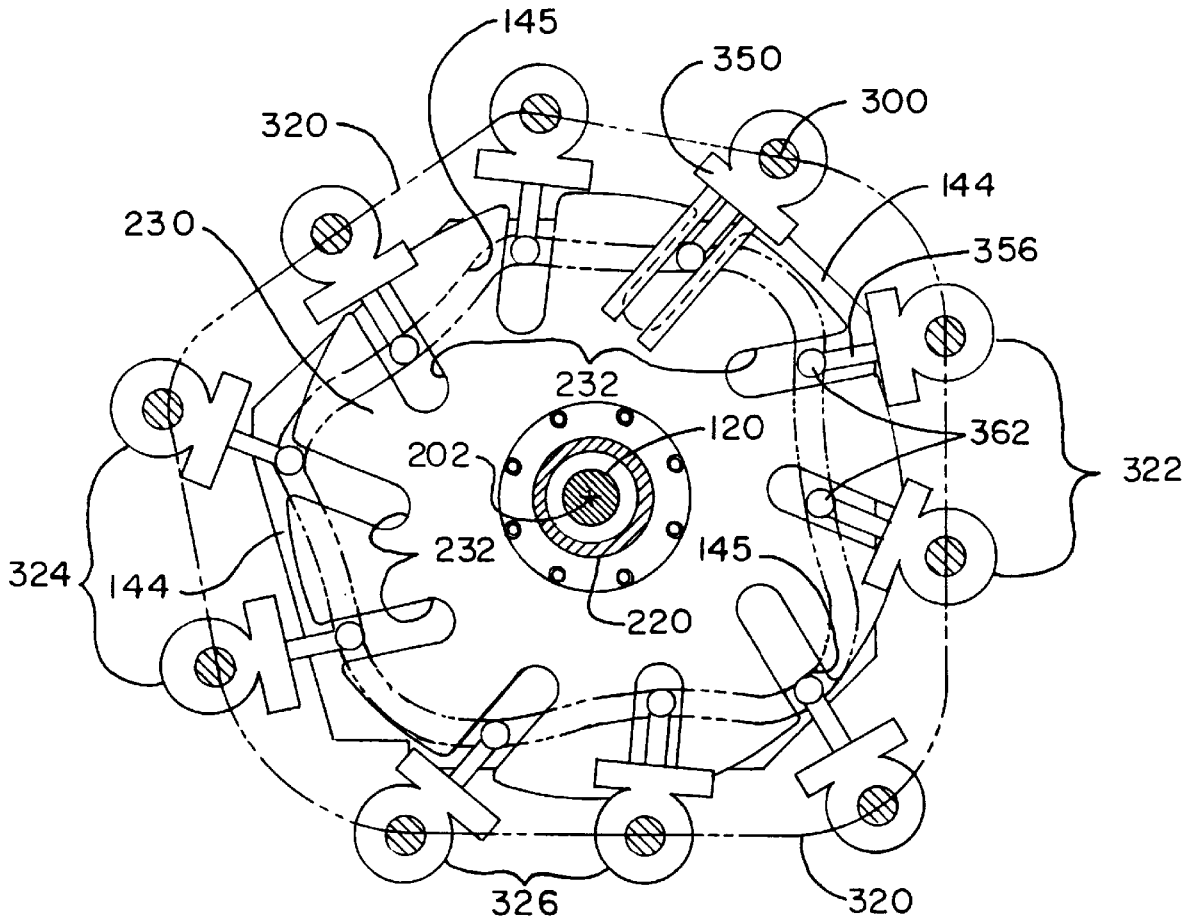
FIG. 5 is schematic view taken along lines 5—5 in FIG. 4.
Figure 6:
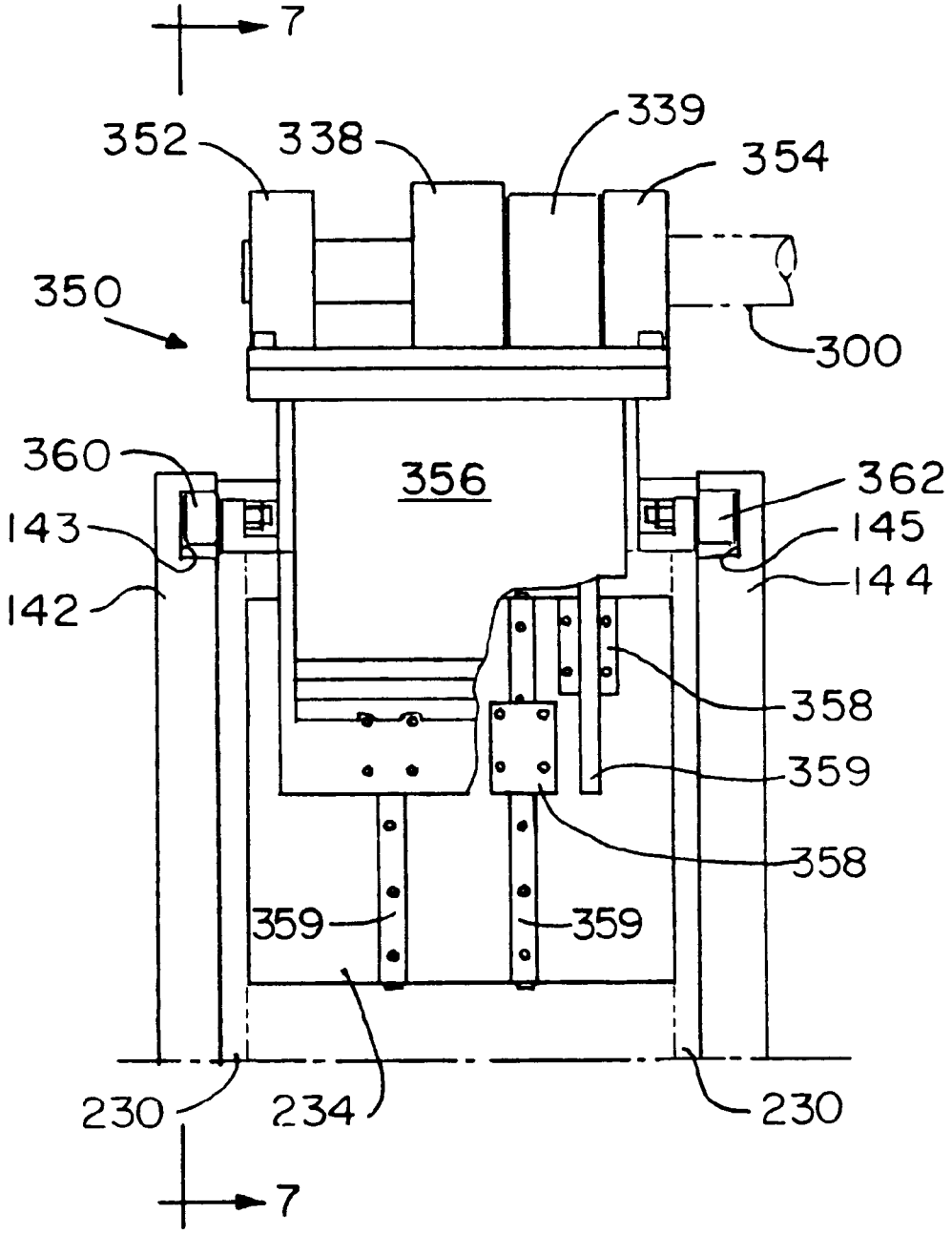
FIG. 6 is a schematic illustration of a mandrel bearing support slidably supported on rotating mandrel support plates.
Figure 14:
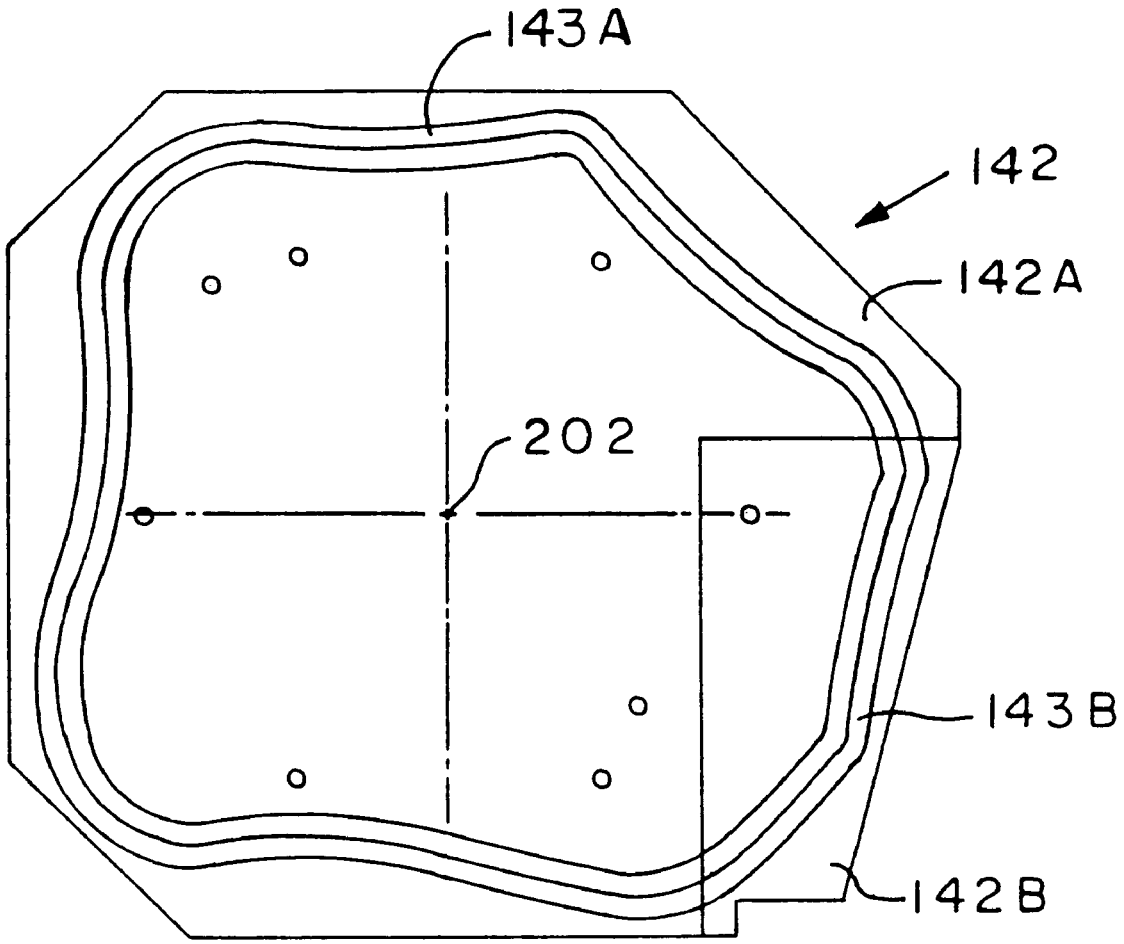
FIG. 14 is a view of a stationary mandrel positioning guide comprising separable plate segments.

The shape of the first and second cam surface grooves 143 and 145 can be varied to vary the closed mandrel path 320. In one embodiment, the first and second cam surface grooves 143 and 145 can comprise interchangeable, replaceable sectors, such that the closed mandrel path 320 comprises replaceable segments. Referring to FIG. 5, the cam surface grooves 143 and 145 can encircle the axis 202 along a path that comprises non-circular segments. In one embodiment, each of the mandrel guide plates 142 and 144 can comprise a plurality of bolted together plate sectors. Each plate sector can have a segment of the complete cam follower surface groove 143 (or 145). Referring to FIG. 14, the mandrel guide plate 142 can comprise a first plate sector 142A having a cam surface groove segment 143A, and a second plate sector 142B having a cam surface groove segment 143B. By unbolting one plate sector and inserting a different plate sector having a differently shaped segment of the cam surface groove, one segment of the closed mandrel path 320 having a particular shape can be replaced by another segment having a different shape.

Such interchangeable plate sectors can eliminate problems encountered when winding logs 5l having different diameters and/or sheet counts. For a given closed mandrel path, a change in the diameter of the logs 51 will result in a corresponding change in the position of the tangent point at which the web leaves the bedroll surface as winding is completed on a core. If a mandrel path adapted for large diameter logs is used to wind small diameter logs, the web will leave the bedroll at a tangent point which is higher on the bedroll than the desired tangent point for providing proper web transfer to the next core. This shifting of the web to bedroll tangent point can result in an incoming core "running into" the web as the web is being wound onto the preceding core, and can result in premature transfer of the web to the incoming core.

Prior art winders having circular mandrel paths can have air blast systems or mechanical snubbers to prevent such premature transfer when small diameter logs are being wound. The air blast systems and snubbers intermittently deflect the web intermediate the bedroll and the preceding core to shift the web to bedroll tangent point as an incoming core approaches the bedroll. The present invention provides the advantage that winding of different diameter logs can be accommodated by replacing segments of the closed mandrel path (and thereby varying the mandrel path), rather than by deflecting the web. By providing mandrel guide plates 142 and 144 which comprise two or more bolted together plate sectors, a portion of the closed mandrel path, such as the web winding segment, can be changed by unbolting one plate sector and inserting a different plate sector having a differently shaped segment of the cam surface.

By way of illustrative example, Table 1A lists coordinates for a cam surface groove segment 143A shown in FIG. 14, Table 1B lists coordinates for a cam surface groove segment 143B suitable for use in winding relatively large diameter logs, and Table 1C lists coordinates for a cam surface groove segment suitable for replacing segment 143B when winding relatively small diameter logs. The coordinates are measured from the central axis 202. Suitable cam groove segments are not limited to those listed in Tables 1A–C, and it will be understood that the cam groove segments can be modified as needed to define any desired mandrel path 320. Tables 2A lists the coordinates of the mandrel path 320 corresponding to the cam groove segments 143A and 143B described by the coordinates in Tables 1A and 1B. When Table 1C is substituted for Table 1B, the resulting changes in the coordinates of the mandrel path 320 are listed in Table 2B.

Turret Winder, Mandrel Cupping Assembly

The mandrel cupping assembly 400 releasably engages the second ends 312 of the mandrels 300 intermediate the core loading segment 322 and the core stripping segment 326 of the closed mandrel path 320 as the mandrels are driven around the turret assembly central axis 202 by the rotating turret assembly 200. Referring to FIGS. 2 and 9–12, the mandrel cupping assembly 400 comprises a plurality of cupping arms 450 supported on a rotating cupping arm support 410. Each of the cupping arms 450 has a mandrel cup assembly 452 for releasably engaging the second end 312 of a mandrel 300. The mandrel cup assembly 452 rotatably supports a mandrel cup 454 on bearings 456. The mandrel cup 454 releasably engages the second end 312 of a mandrel 300, and supports the mandrel 300 for rotation of the mandrel about its axis 314.

Each cupping arm 450 is pivotably supported on the rotating cupping arm support 410 to permit rotation of the cupping arm 450 about a pivot axis 451 from a first cupped position wherein the mandrel cup 454 engages a mandrel 300, to a second uncupped position wherein the mandrel cup 454 is disengaged from the mandrel 300. The first cupped position and the second uncupped position are shown in FIGS. 9. Each cupping arm 450 is supported on the rotating cupping arm support in a path about the turret assembly central axis 202 wherein the distance between the cupping arm pivot axis 451 and the Turret assembly central axis 202 varies as a function of the position of the cupping arm 450 about the axis 202. Accordingly, each cupping arm and associated mandrel cup 454 can track the second end 312 of its respective mandrel 30C as the mandrel is carried around the closed mandrel path 320 by the rotating turret assembly 200.

The rotating cupping arm support 410 comprises a cupping arm support hub 420 which is rotatably supported on the support 120 adjacent the upstanding frame end 134 by bearings 221. Portions of the assembly are shown cut away in FIGS. 2 and 9 for clarity. A servo motor 422 mounted on or adjacent to the upstanding frame end 134 delivers torque to the hub 420 through a belt or chain 424 and a pulley or sprocket 426 to rotatably drive the hub 420 about the turret assembly central axis 202. The servo motor 422 is controlled to phase the rotational position of the rotating cupping arm support 410 with respect to a reference that is a function of the angular position of the bedroll 59 about its axis of rotation, and a function of an accumulated number of revolutions of the bedroll 59. In particular, the position of the support 410 can be phased with respect to the position of the bedroll 59 within a log wind cycle, thereby synchronizing rotation of the cupping arm support 410 with rotation of the turret assembly 200. The servo motors 222 and 422 are each equipped with a brake. The brakes prevent relative rotation of the turret assembly 200 and the cupping arm support 410 when the winding apparatus 90 is not running, to thereby preventing twisting of the mandrels 300.

The rotating cupping arm support 410 further comprises a rotating cupping arm support plate 430 rigidly joined to the hub 420 and extending generally perpendicular to the turret assembly central axis 202. The rotating plate 430 is rotatably driven about the axis 202 on the hub 420. A plurality of cupping arm support members 460 are supported on the rotating plate 430 for movement relative to the rotating plate 430. Each cupping arm 450 is pivotably joined to a cupping arm support member 460 to permit rotation of the cupping arm 450 about the pivot axis 451.

Figure 10:
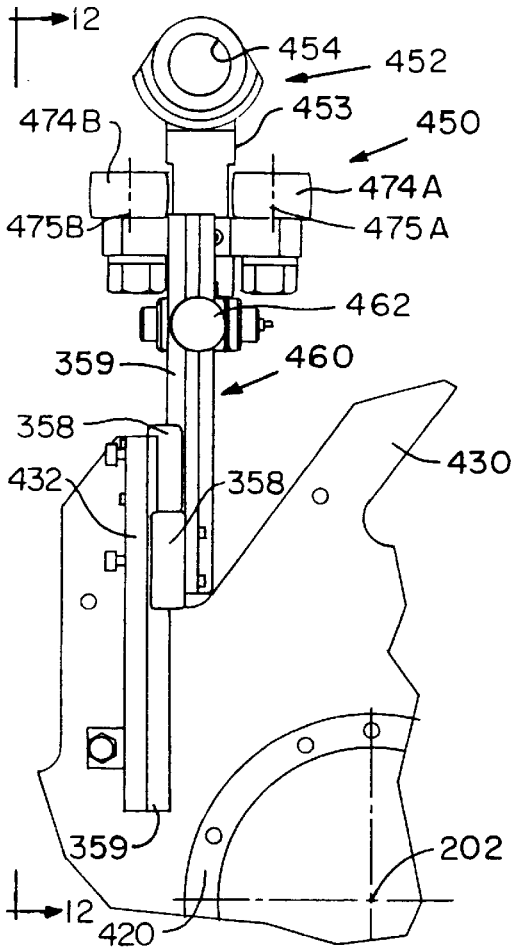
FIG. 10 is a side view taken along lines 10—10 in FIG. 9 and showing a cupping arm extended relative to a rotating cupping arm support plate.
Figure 11:
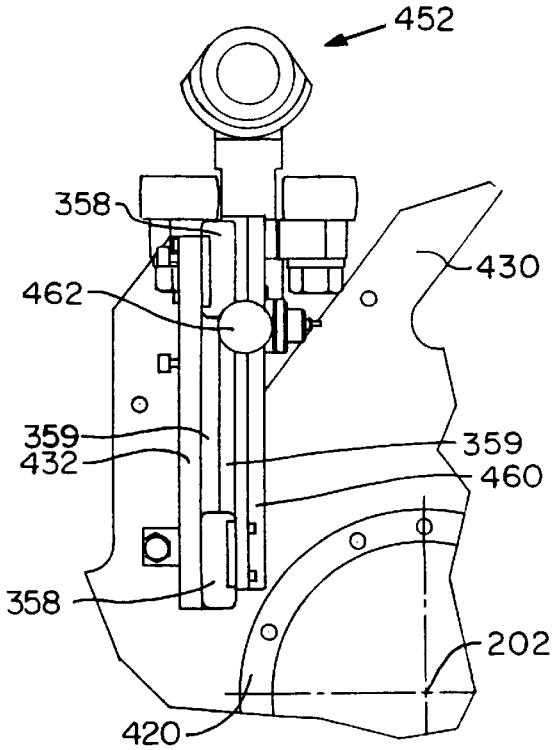
FIG. 11 is a view similar to that of FIG. 10 showing the cupping arm retracted relative to the rotating cupping arm support plate.

Referring to FIGS. 10 and 11, each cupping arm support member 460 is slidably supported on a portion of the plate 430, such as a bracket 432 bolted to the rotating plate 430, for translation relative to the rotating plate 430 along a path having a radial component and a tangential component relative to the turret assembly central axis 202. In one embodiment, the sliding cupping arm support member 460 can be slidably supported on a bracket 432 by a plurality of commercially available linear bearing slide 358 and rail 359 assemblies. A slide 358 and a rail 359 can be fixed (such as by bolting) to each of the bracket 432 and the support member 460, so that a slide 358 fixed to the bracket 432 slidably engages a rail 359 fixed to the support member 460, and a slide 353 fixed to the support member 460 slidably engages a rail 359 fixed to the bracket 432.

The mandrel cupping assembly 400 further comprises a pivot axis positioning guide for positioning the cupping arm pivot axes 451. The pivot axis positioning guide positions the cupping arm pivot axes 451 to vary the distance between each pivot axis 451 and the axis 202 as a function of position of the cupping arm 450 about the axis 202. In the embodiment shown in FIGS. 2 and 9–12, the pivot axis positioning guide comprises a stationary pivot axis positioning guide plate 442. The pivot axis positioning guide plate 442 extends generally perpendicular to the axis 202 and is positioned adjacent to the rotating cupping arm support plate 430 along the axis 202. The positioning plate 442 can be rigidly joined to the support 120, such that the rotating cupping arm support plate 430 rotates relative to the positioning plate 442.

The positioning plate 442 has a surface 444 facing the rotating support plate 430. A cam surface, such as cam surface groove 443 is disposed in the surface 444 to face the rotating support plate 430. Each sliding cupping arm support member 460 has an associated cam follower 462 which engages the cam surface groove 443. The cam follower 462 follows the groove 443 as the rotating plate 430 carries the support member 460 around the axis 202, and thereby positions the cupping pivot axis 451 relative to the axis 202. The groove 443 can be shaped with reference to the shape of the grooves 143 and 145, so that each cupping arm and associated mandrel cup 454 can track the second end 312 of its respective mandrel 300 as the mandrel is carried around the closed mandrel path 320 by the rotating mandrel support 200. In one embodiment, the groove 443 can have substantially the same shape as that of the groove 145 in mandrel guide plate 144 along that portion of the closed mandrel path where the mandrel ends 312 are cupped. The groove 443 can have a circular arc shape (or other suitable shape) along that portion of the closed mandrel path where the mandrel ends 312 are uncupped. By way of illustration, Tables 3A and 3B, together, list coordinates for a groove 443 which is suitable for use with cam follower grooves 143A and 143B having coordinates listed in Tables 1A and 1B. Similarly, Tables 3A and 3C, together, list coordinates for a groove 443 which is suitable for use with cam follower grooves 143A and 143C having coordinates listed in Tables 1A and 1C.

Each cupping arm 450 comprises a plurality of cam followers supported on the cupping arm and pivotable about the cupping arm pivot axis 451. The cam followers supported on the cupping arm engage stationary cam surfaces to provide rotation of the cupping arm 450 between the cupped and uncupped positions. Referring to FIGS. 9–12, each cupping arm 450 comprises a first cupping arm extension 453 and a second cupping arm extension 455. The cupping arm extensions 453 and 455 extend generally perpendicular to each other from their proximal ends at the cupping arm pivot axis 451 to their distal ends. The cupping arm 450 has a clevis construction for attachment to the support member 460 at the location of the pivot axis 451. The cupping arm extension 453 and 455 rotate as a rigid body about the pivot axis 451. The mandrel cup 454 is supported at the distal end of the extension 453. At least one cam follower is supported on the extension 453, and at least one cam follower is supported on the extension 455.

Figure 12:
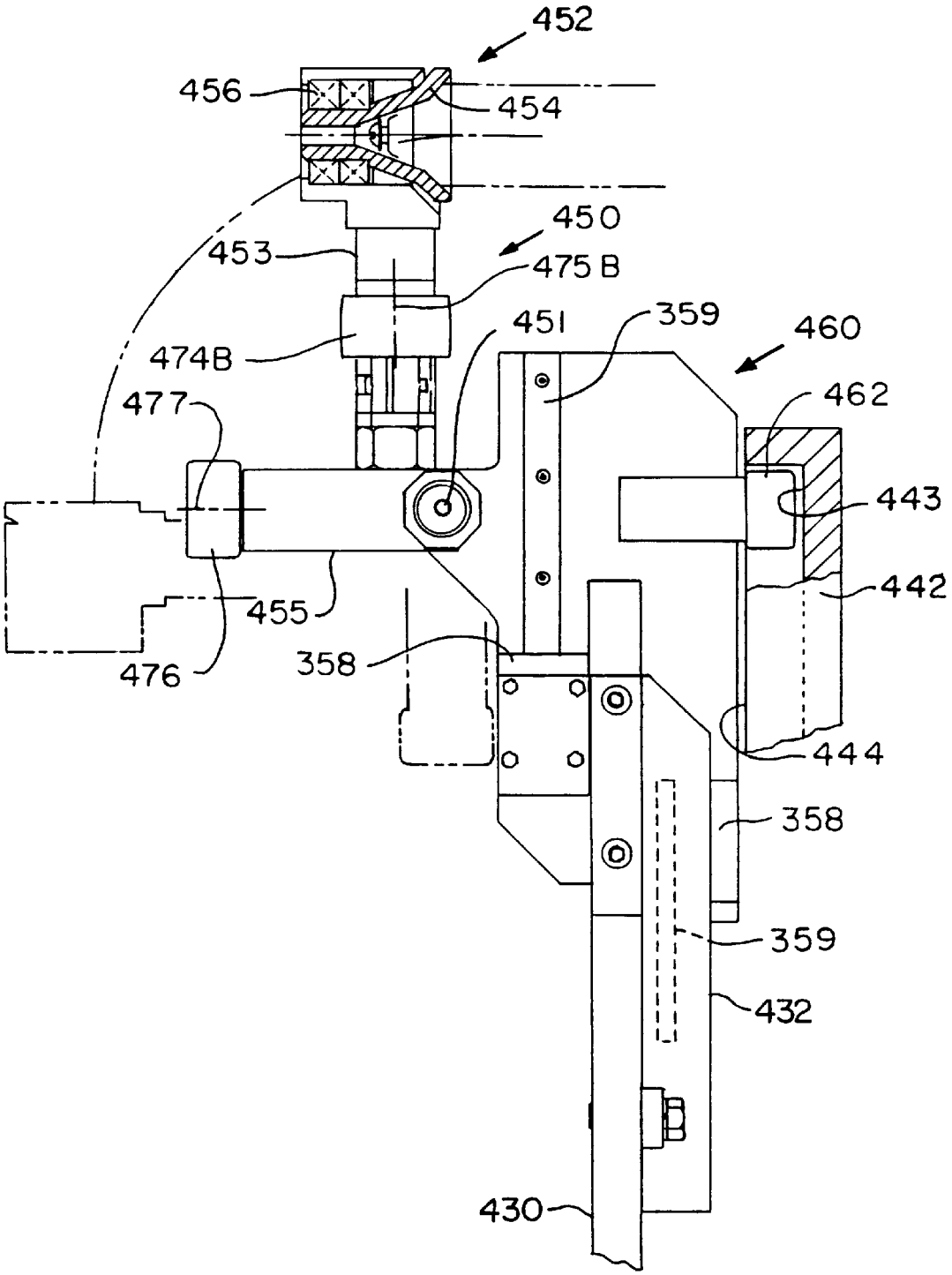
FIG. 12 is a view taken along lines 12—12 in FIG. 10, with the open, uncupped position of the cupping arm shown in phantom.

In the embodiment shown in FIGS. 10–12, a pair of cylindrical cam followers 474A and 474B are supported on the extension 453 intermediate the pivot axis 451 and the mandrel cup 454. The cam followers 474A and 474B are pivotable about pivot axis 451 with extension 453. The cam followers 474A, B are supported on the extension 453 for rotation about axes 475A and 475B, which are parallel to one another. The axes 475A and 475B are parallel to the direction along which the cupping arm support member 460 slides relative to the rotating cupping arm support plate 430 when the mandrel cup is in the cupped position (upper cupping arm in FIG. 9). The axes 475A and 475B are parallel to axis 202 when the mandrel cup is in the uncupped position (lower cupping arm in FIG. 9).

Each cupping arm 450 also comprises a third cylindrical cam follower 476 supported on the distal end of the cupping arm extension 455. The cam follower 476 is pivotable about pivot axis 451 with extension 455. The third cam follower 476 is supported on the extension 455 to rotate about an axis 477 which is perpendicular to the axes 475A and 475B about which followers 474A and B rotate. The axis 477 is parallel to the direction along which the cupping arm support member 460 slides relative to the rotating cupping arm support plate 430 when the mandrel cup is in the uncupped position, and the axis 477 is parallel to axis 202 when the mandrel cup is in the cupped position.

Figure 13:
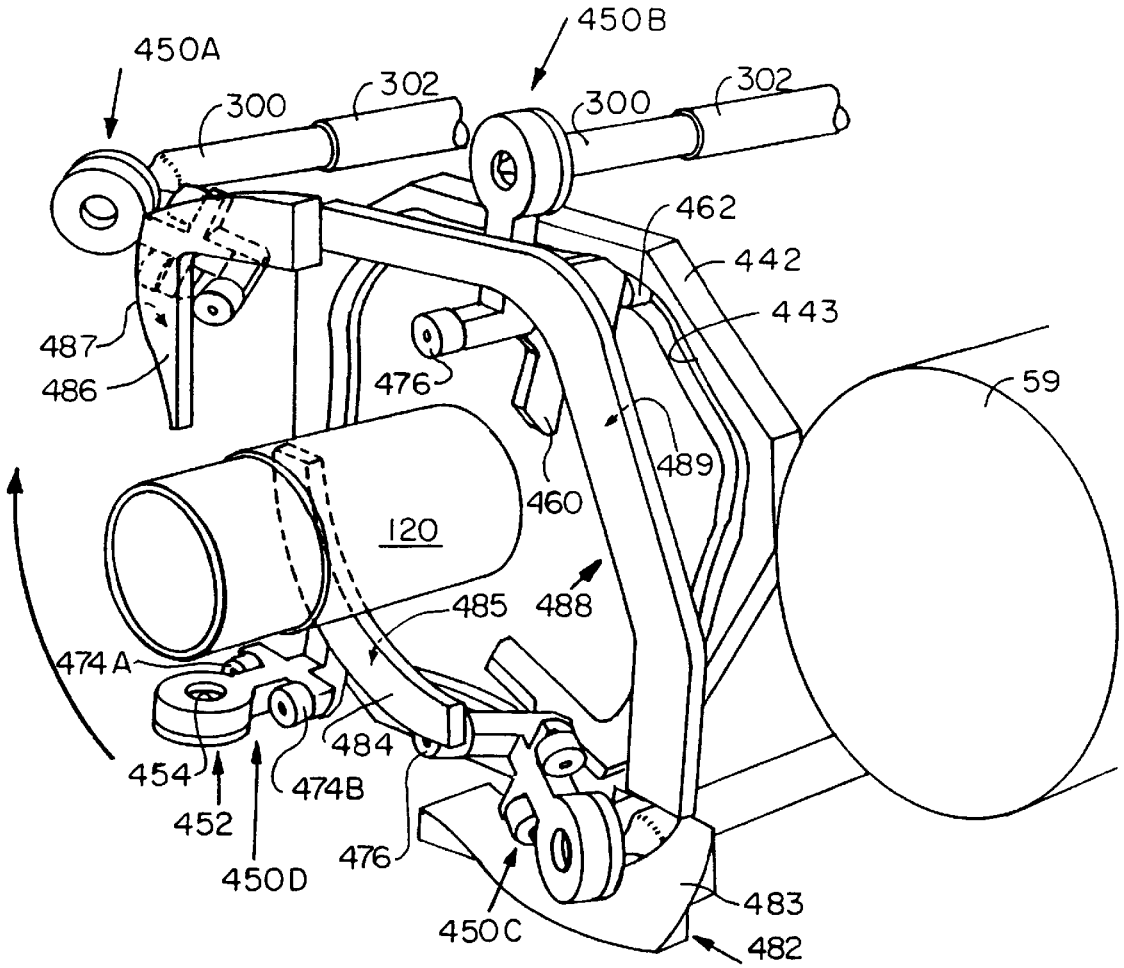
FIG. 13 is a perspective view showing positioning of cupping arms provided by stationary cupping arm closing, opening, hold open, and hold closed cam surfaces.

The mandrel cupping assembly 400 further comprises a plurality of cam follower members having cam follower surfaces. Each cam follower surface is engageable by at least one of the cam followers 474A, 474B and 476 to provide rotation of the cupping arm 450 about the cupping arm pivot axis 451 between the cupped and uncupped positions, and to hold the cupping arm 450 in the cupped and uncupped positions. FIG. 13 is an isometric view showing four of the cupping arms 450A–D. Cupping arm 450A is shown pivoting from an uncupped to a cupped position; cupping arm 450B is in a cupped position; cupping arm 450C is shown pivoting from a cupped position to an uncupped position; and cupping arm 450D is shown in an uncupped position. FIG. 13 shows the cam follower members which provide pivoting of the cupping arms 450 ts the cam follower 462 on each cupping arm support member 460 tracks the groove 443 in positioning plate 442. The rotating support plate 430 is omitted from FIG. 13 for clarity.

Referring to FIGS. 9 and 13, the mandrel cupping assembly 400 can comprise an opening cam member 482 having an opening cam surface 483, a hold open cam member 484 having a hold open cam surface 485 (FIG. 9), a closing cam member 486 comprising a closing cam surface 487, and a hold closed cam member 488 comprising a hold closed cam surface 489. Cam surfaces 485 and 489 can be generally planar, parallel surfaces which extend perpendicular to axis 202. Cam surfaces 483 and 487 are generally three dimensional cam surfaces. The cam members 482, 484, 486, and 488 are preferably stationary, and can be supported (supports not shown) on any rigid foundation including but not limited to frame 110.

As the rotating plate 430 carries the cupping arms 450 around the axis 202 the cam follower 474A engages the three dimensional opening cam surface 483 prior to the core stripping segment 326, thereby rotating the cupping arms 450 (e.g. cupping arm 450C in FIG. 13) from the cupped position to the uncupped position so that the web wound core can be stripped from the mandrels 300 by the core stripping apparatus 2000. The cam follower 476 on the rotated cupping arm 450 (e.g., cupping arm 450D in FIG. 13) then engages the cam surface 485 to hold the cupping arm in the uncupped position until an empty core 302 can be loaded onto the mandrel 300 along the segment 322 by the core loading apparatus 1000. Upstream of the web winding segment 324, the cam follower 474A on the cupping arm (e.g. cupping arm 450A in FIG. 13) engages the closing cam surface 487 to rotate the cupping arm 450 from the uncupped to the cupped position. The cam followers 474A and 474B on the cupping arm (e.g. cupping arm 450B in FIG. 13) then engage the cam surface 489 to hold the cupping arm 450 in the cupped position during web winding.

The cam follower and cam surface arrangement shown in FIGS. 9 and 13 provides the advantage that the cupping arm 450 can be rotated to cupped and uncupped positions as the radial position of the cupping arm pivot axis 451 moves relative to the as 202. A typical barrel cam arrangement for cupping and uncupping mandrels, such as that shown on page 1 of PCMC Manual Number 01-012-ST003 and page 3 of FCMC Manual Number 01-013-ST011 for the PCMC Series 150 Turret Winder, requires a linkage system to cup and uncup mandrels, and does not accommodate cupping arms that have a pivot axis whose distance from a turret axis 202 is variable.

Core Drive Roller Assembly and Mandrel Assist Assemblies

Referring to FIGS. 1 and 15–19, the web winding apparatus according to the present invention includes a core drive apparatus 500, a mandrel loading assist assembly 600, and a mandrel cupping assist assembly 700. The core drive apparatus 500 is positioned for driving cores 302 onto the mandrels 300. The mandrel assist assemblies 600 and 700 are positioned for supporting and positioning the uncupped mandrels 300 during core loading and mandrel cupping.

Turret winders having a single core drive roller for driving a core onto a mandrel while the turret is stationary are well known in the arn. Such arrangements provide a nip between the mandrel and the single drive roller to drive the core onto the stationary mandrel. The drive apparatus 500 of the present invention comprises a pair of core drive rollers 505. The core drive rollers 505 are disposed on opposite sides of the core loading segment 322 of the closed mandrel path 320 along a generally straight line portion of the segment 322. One of the core drive rollers, roller 505A, is disposed outside the closed mandrel path 320, and the other of the core drive rollers, 505B, is disposed within the closed mandrel path 320, so that the mandrels 300 are carried intermediate the core drive rollers 505A and 505B. The core drive rollers 505 cooperate to engage a core driven at least partially onto the mandrel 300 by the core loading apparatus 1000. The core drive rollers 505 complete driving of the core 302 onto the mandrel 300.

Figure 15:
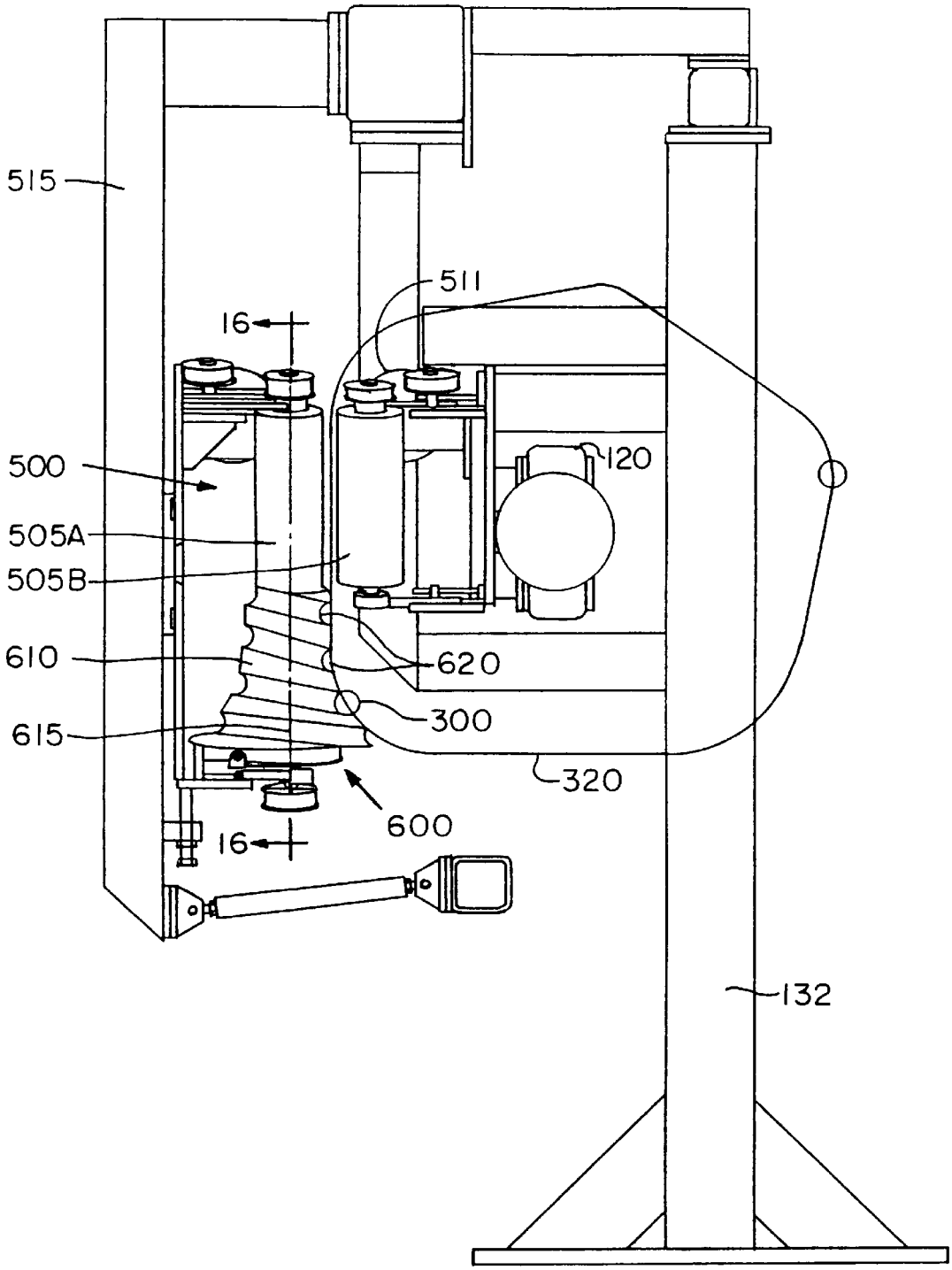
FIG. 15 is a side view showing the position of core drive rollers and a mandrel support relative to the closed mandrel path.
Figure 16:
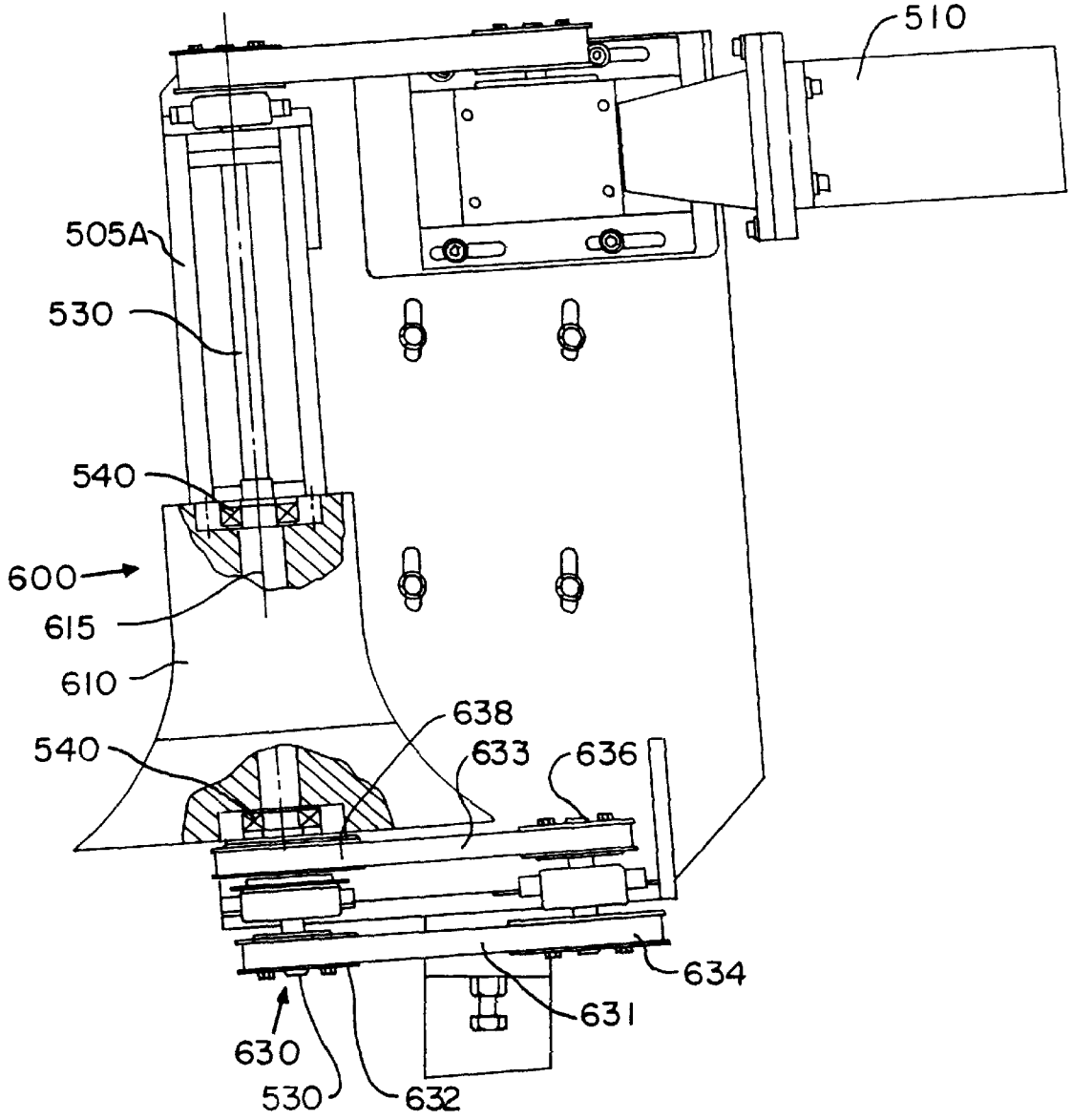
FIG. 16 is a view taken along lines 16—16 in FIG. 15.
Figure 17:
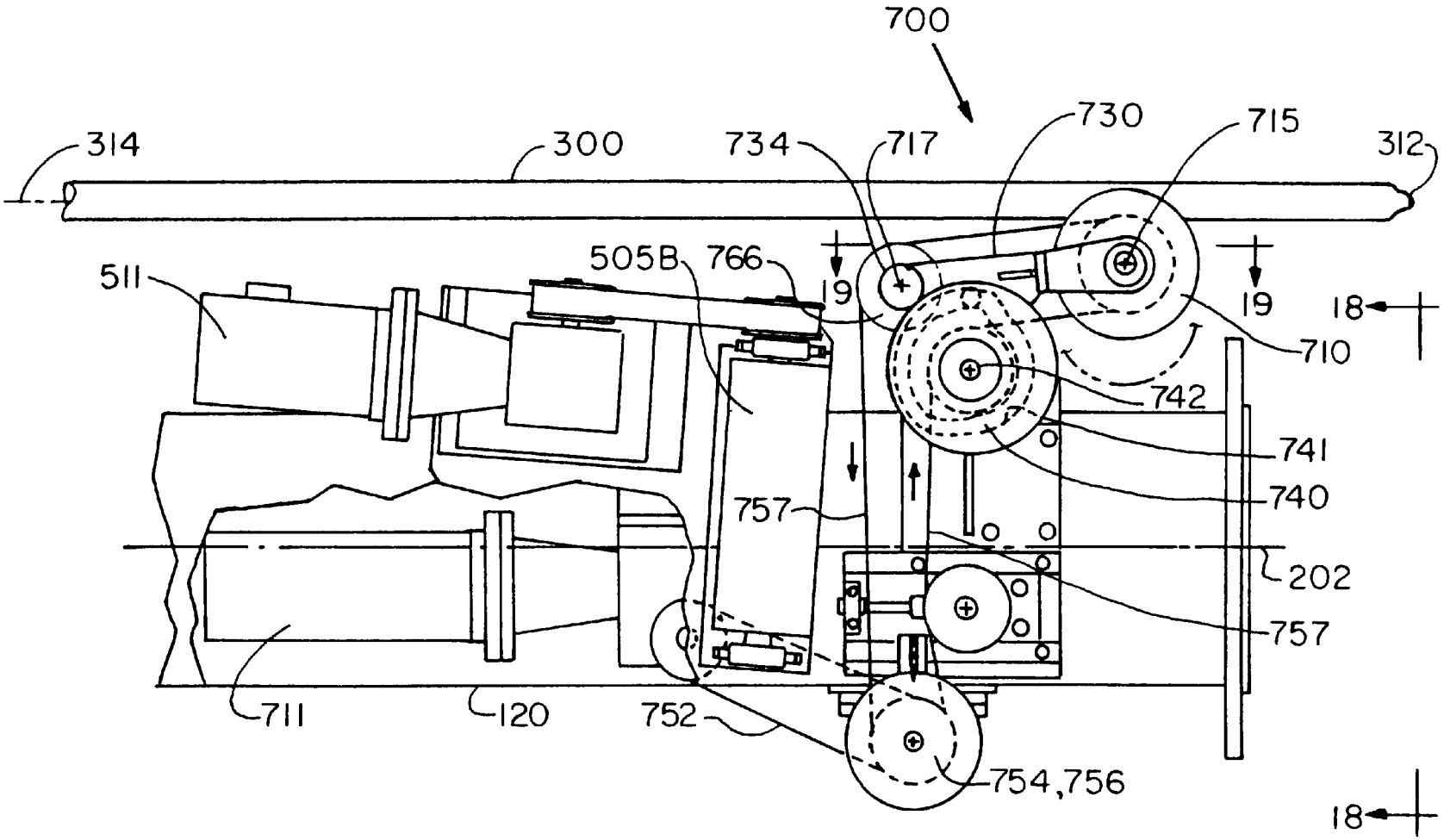
FIG. 17 is a front view of a cupping assist mandrel support assembly.

The core drive rollers 505 are supported for rotation about parallel axes, and are rotatably driven by servo motors through belt and pulley arrangements. The core drive roller 505A and its associated servo motor 510 are supported from a frame extension 515. The core drive roller 505B and its associated servo motor 511 (shown in FIG. 17) are supported from an extension of the support 120. The core drive rollers 505 can be supported for rotation about axes that are inclined with respect to the mandrel axes 314 and the core loading segment 322 of the mandrel path 320. Referring to FIGS. 16 and 17, the core drive rollers 505 are inclined to drive a core 302 with a velocity component generally parallel to a mandrel axis and a velocity component generally parallel to at least a portion of the core loading segment. For instance, core drive roller S50A is supported for rotation about axis 615 which is inclined with respect to the mandrel axes 314 and the core loading segment 322, as shown in FIGS. 15 and 16. Accordingly, the core drive rollers 505 can drive the core 302 onto the mandrel 300 during movement of mandrel along the core loading segment 322.

Referring to FIGS. 15 and 16, the mandrel assist assembly 600 is supported outside of the closed mandrel path 320 and is positioned to support uncupped mandrels 300 intermediate the first and second mandrel ends 310 and 312. The mandrel assist assembly 600 is not shown in FIG. 1. The mandrel assist assembly 600 comprises a rotatably driven mandrel support 610 positioned for supporting an uncupped mandrel 300 along at least a portion of the core loading segment 322 of the closed mandrel path 320. The mandrel support 610 stabilizes the mandrel 300 and reduces vibration of the uncupped mandrel 300. The mandrel support 610 thereby aligns the mandrel 300 with the core 302 being driven onto the second end 312 of the mandrel from the core loading apparatus 1000.

The mandrel support 610 is supported for rotation about the axis 615, which is inclined with respect to the mandrel axes 314 and the core loading segment 322. The mandrel support 610 comprises a generally helical mandrel support surface 620. The mandrel support surface 620 has a variable pitch measured parallel to the axis 615, and a variable radius measured perpendicular to the axis 615. The pitch and radius of the helical support surface 620 vary to support the mandrel along the closed mandrel path. In one embodiment, the pitch can increase as the radius of the helical support surface 620 decreases. Conventional mandrel supports used in conventional indexing turret assemblies support mandrels which are stationary during core loading. The variable pitch and radius of the support surface 620 permits the support surface 620 to contact and support a moving mandrel 300 along a non-linear path.

Because the mandrel support 610 is supported for rotation about the axis 615, the mandrel support 610 can be driven off the same motor used to drive the core drive roller 505A. In FIG. 16, the mandrel support 610 is rotatably driven through a drive train 630 by the same servo motor 510 which rotatably drives core drive roller 505A. A shaft 530 driven by motor 510 is joined to and extends through roller 505A. The mandrel support 610 is rotatably supported on the shaft 530 by bearings 540 so as not to be driven by the shaft 530. The shaft 530 extends through the mandrel support 610 to the drive train 630. The drive train 630 includes pulley 634 driven by a pulley 632 through belt 631, and a pulley 638 driven by pulley 636 through belt 633. The diameters of pulleys 632, 634, 636 and 638 are selected to reduce the rotational speed of the mandrel support 610 to about half that of the core drive roller 505A.

The servo motor 510 is controlled to phase the rotational position of the mandrel support 610 with respect to a reference that is a function of the angular position of the bedroll 59 about its axis of rotation, and a function of an accumulated number of revolutions of the bedroll 59. In particular, the rotational position of the support 610 can be phased with respect to the position of the bedroll 59 within a log wind cycle, thereby synchronizing the rotational position of the support 160 with the rotational position of the turret assembly 200.

Figure 18:
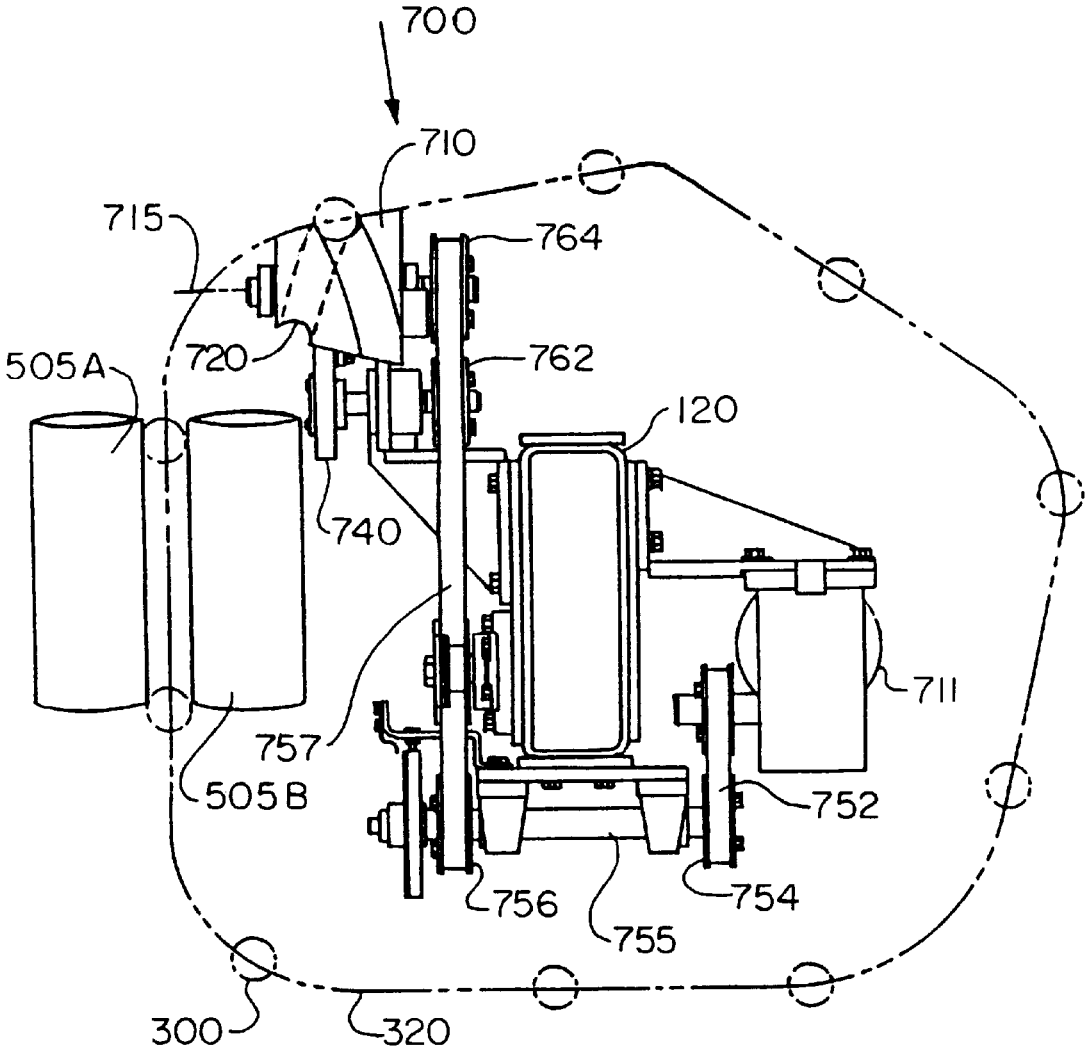
FIG. 18 is a view taken along lines 18—18 in FIG. 17.
Figure 19:
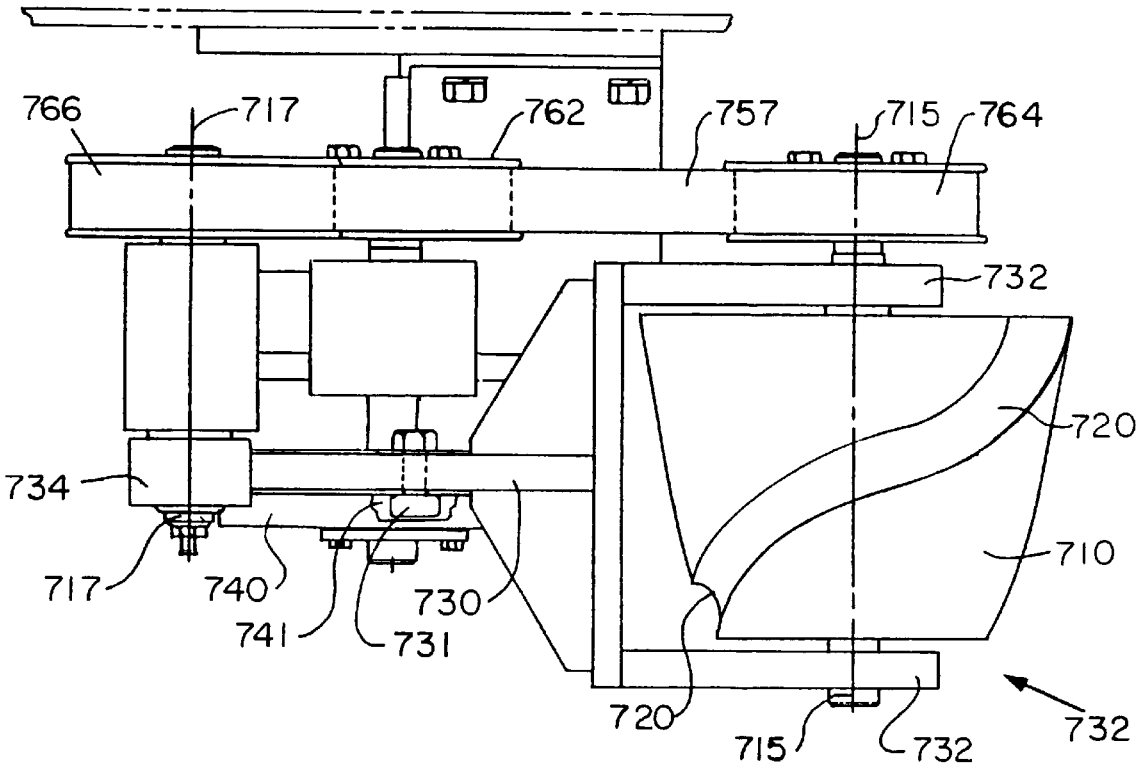
FIG. 19 is a view taken along lines 19—19 in FIG. 17.

Referring to FIGS. 17–19, the mandrel cupping assist assembly 700 is supported inside of the closed mandrel path 320 and is positioned to support uncupped mandrels 300 and align the mandrel ends 312 with the mandrel cups 454 as the mandrels are being cupped. The mandrel cupping assist assembly 700 comprises a rotatably driven mandrel support 710. The rotatably driven mandrel support 710 is positioned for supporting an uncupped mandrel 300 intermediate the first and second ends 310 and 312 of the mandrel. The mandrel support 710 supports the mandrel 300 along at least a portion of the closed mandrel path intermediate the core loading segment 322 and the web winding segment 324 of the closed mandrel path 320. The rotatably driven mandrel support 710 can be driven by a servo motor 711. The mandrel cupping assist assembly 700, including the mandrel support 710 and the servo motor 711, can be supported from the horizontally extending stationary support 120, as shown in FIGS. 17–19.

The rotatably driven mandrel support 710 has a generally helical mandrel support surface 720 having a variable radius and a variable pitch. The support surface 720 engages the mandrels 300 and positions them for engagement by the mandrel cups 454. The rotatably driven mandrel support 710 is rotatably supported on a pivot arm 730 having a clevised first end 732 and a second end 734. The support 710 is supported for rotation about a horizontal axis 715 adjacent the first end 732 of the arm 730. The pivot arm 730 is pivotably supported at its second end 734 for rotation about a stationary horizontal axis 717 spaced from the axis 715. The position of the axis 715 moves in an arc as the pivot arm 730 pivots about axis 717. The pivot arm 730 includes a cam follower 731 extending from a surface of the pivot arm intermediate the first and second ends 732 and 734.

A rotating cam plate 740 having an eccentric cam surface groove 741 is rotatably driven about a stationary horizontal axis 742. The cam follower 731 engages the cam surface groove 741 in the rotating cam plate 740, thereby periodically pivoting the arm 730 about the axis 717. Pivoting of the arm 730 and the rotating support 710 about the axis 717 causes the mandrel support surface 720 of the rotating support 710 to periodically engage a mandrel 300 as the mandrel is carried along a predetermined portion of the closed mandrel path 320. The mandrel support surface 720 thereby positions the unsupported second end 312 of the mandrel 300 for cupping.

Rotation of the mandrel support 710 and the rotating cam plate 740 is provided by the servo motor 711. The servo motor 711 drives a belt 752 about a pulley 754, which is connected to a pulley 756 by a shad 755. Pulley 756, in turn, drives serpentine belt 757 about pulleys 762, 764, and idler pulley 766. Rotation of pulley 762 drives continuous rotation of the cam plate 740. Rotation of pulley 764 drives rotation of mandrel support 710 about its axis 715.

While the rotating cam plate 740 shown in the Figures has a cam surface groove, in an alternative embodiment the rotating cam plate 740 could have an external cam surface for providing pivoting of the arm 730. In the embodiment shown the servo motor 711 provides rotation of the cam plate 740, thereby providing periodic pivoting of the mandrel support 710 about the axis 717. The servo motor 711 is controlled to phase the rotation of the mandrel support 710 and the periodic pivoting of the mandrel support 710 with respect to a reference that is a function of the angular position of the bedroll 59 about its axis of rotation, and a function of an accumulated number of revolutions of the bedroll 59. In particular, the pivoting of the mandrel support 710 and the rotation of the mandrel support 710 can be phased with respect to the position of the bedroll 59 within a log wind cycle. The rotational position of the mandrel support 710 and the pivot position of the mandrel support 710 can thereby be synchronized with the rotation of the turret assembly 200. Alternatively, one of the servo motors 222 or 422 could be used to drive rotation of the cam plate 740 through a timing chain or other suitable gearing arrangement.

In the embodiment shown the serpentine belt 757 drives both the rotation of the cam plate 740 and the rotation of the mandrel support 710 about its axis 715. In yet another embodiment, the serpentine belt 757 could be replaced by two separate belts. For instance, a first belt could provide rotation of the cam plate 740, and a second belt could provide rotation of the mandrel support 710 about its axis 715. The second belt could be driven by the first belt through a pulley arrangement, or alternatively, each belt could be driven by the servo motor 722 through separate pulley arrangements.

Core Adhesive Application Apparatus

Once a mandrel 300 is engaged by a mandrel cup 454, the mandrel is carried along the closed mandrel path toward the web winding segment 324. Intermediate the core loading segment 322 and the web winding segment 324, an adhesive application apparatus 800 applies an adhesive to the core 302 supported on the moving mandrel 300. The adhesive application apparatus 800 comprises a plurality of glue application nozzles 810 supported on a glue nozzle rack 820. Each nozzle 810 is in communication with a pressurized source of liquid adhesive (not shown) through a supply conduit 812. The glue nozzles have a check valve ball tip which releases an outflow of adhesive from the tip when the tip compressively engages a surface, such as the surface of a core 302.

The glue nozzle rack 820 is pivotably supported at the ends of a pair of support arms 825. The support arms 825 extend from a frame cross member 133. The cross member 133 extends horizontally between the upstanding frame members 132 and 134. The glue nozzle rack 820 is pivotable about an axis 828 by an actuator assembly 840. The axis 828 is parallel to the turret assembly central axis 202. The glue nozzle rack 820 has an arm 830 carrying a cylindrical cam follower.

The actuator assembly 840 for pivoting the glue nozzle rack comprises a continuously rotating disk 842 and a servo motor 822, both of which can be supported from the frame cross member 133. The cam follower carried on the arm 830 engages an eccentric cam follower surface groove 844 disposed in the continuously rotating disk 842 of the actuator assembly 840. The disk 842 is continuously rotated by the servo motor 822. The actuator assembly 840 provides periodic pivoting of the glue nozzle rack 820 about the axis 828 such that the glue nozzles 810 track the motion of each mandrel 300 as the mandrel 300 moves along the closed mandrel path 320. Accordingly, glue can be applied to the cores 302 supported on the mandrels 300 without stopping motion of the mandrels 300 along the closed path 320.

Figure 20A:
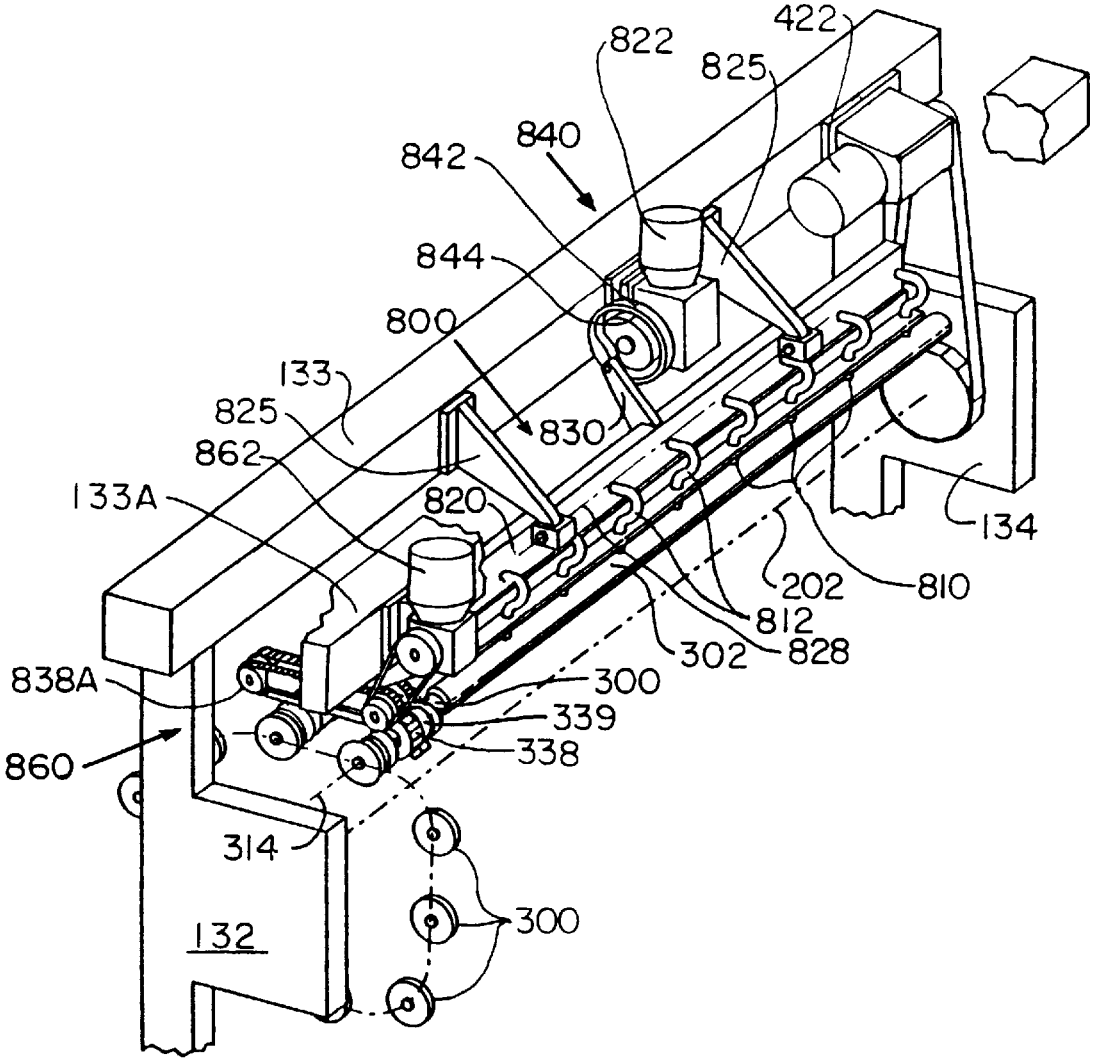
FIG. 20A is an enlarged perspective view of the adhesive application assembly shown in FIG. 1.
Figure 20B:
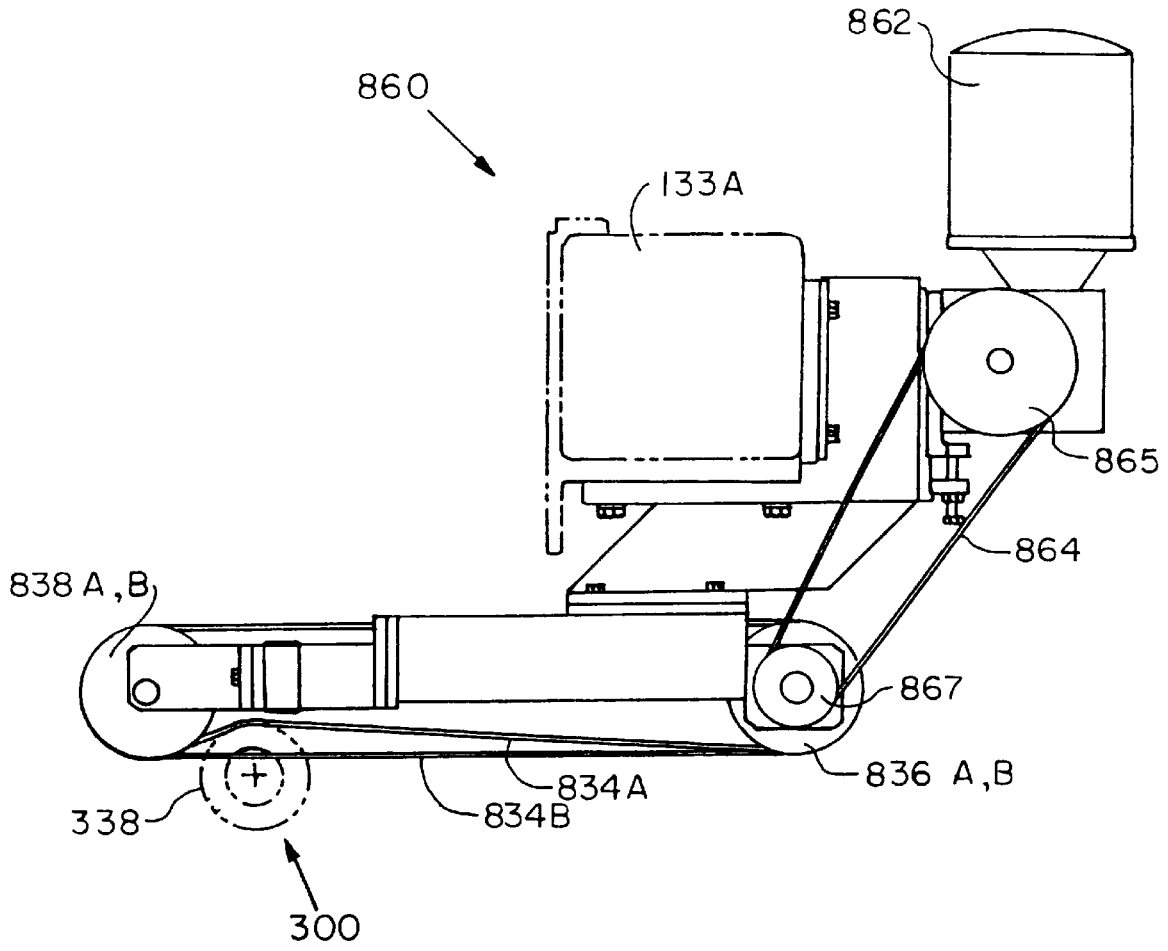
FIG. 20B is a side view of a core spinning assembly shown in FIG. 20A.

Each mandrel 300 is rotated about its axis 314 by a core spinning assembly 860 as the nozzles 810 engage the core 302, thereby providing distribution of adhesive around the core 302. The core spinning assembly 860 comprises a servo motor 862 which provide continuous motion of two mandrel spinning belts 834A and 834B. Referring to FIGS. 4, 20A, and 20B, the core spinning assembly 860 can be supported on an extension 133A of the frame cross member 133. The servo motor 862 continuously drives a belt 864 around pulleys 865 and 867. Pulley 867 drives pulleys 836A and 836B, which in turn drive belts 834A and 834B about pulleys 868A and 868B, respectively. The belts 834A and 834B engage the mandrel drive pulleys 338 and spin the mandrels 300 as the mandrels 300 move along the closed mandrel path 320 beneath the glue nozzles 910. Accordingly, each mandrel and its associated core 302 are translating along the closed mandrel path 320 and rotating about the mandrel axis 314 as the core 302 engages the glue nozzles 810.

The servo motor 822 is controlled to phase the periodic pivoting of the glue nozzle rack 820 with respect to a reference that is a function of the angular position of the bedroll 59 about its axis of rotation, and a function of an accumulated number of revolutions of the bedroll 59. In particular, the pivot position of the glue nozzle rack 820 can be phased with respect to the position of the bedroll 59 within a log wind cycle. The periodic pivoting of the glue nozzle rack 820 is thereby synchronized with rotation of the turret assembly 200. The pivoting of the glue nozzle rack 820 is synchronized with the rotation of the turret assembly 200 such that the glue nozzle rack 820 pivots about axis 828 as each mandrel passes beneath the glue nozzles 810. The glue nozzles 810 thereby track motion of each mandrel along a portion of the closed mandrel path 320. Alternatively, the rotating cam plate 844 could be driven indirectly by one of the servo motors 222 or 422 through a timing chain or other suitable gearing arrangement.

In yet another embodiment, the glue could be applied to the moving cores by a rotating gravure roll positioned inside the closed mandrel path. The gravure roll could be rotated about its axis such that its surface is periodically submerged in a bath of the glue, and a doctor blade could be used to control the thickness of the glue on the gravure roll surface. The axis of the rotation of the gravure roll could be generally parallel to the axis 202. The closed mandrel path 320 could include a circular arc segment intermediate the core loading segment 322 and the web winding segment 324. The circular arc segment of the closed mandrel path could be concentric with the surface of the gravure roll, such that the mandrels 300 carry their associated cores 302 to be in rolling contact with an arcuate portion of the glue coated surface of the gravure roll. The glue coated cores 302 would then be carried from the surface of the gravure roll to the web winding segment 324 of the closed mandrel path. Alternatively, an offset gravure arrangement can be provided. The offset gravure arrangement can include a first pickup roll at least partially submerged in a glue bath, and one or more transfer rolls for transferring the glue from the first pickup roll to the cores 302.

Core Loading Apparatus

Figure 21:
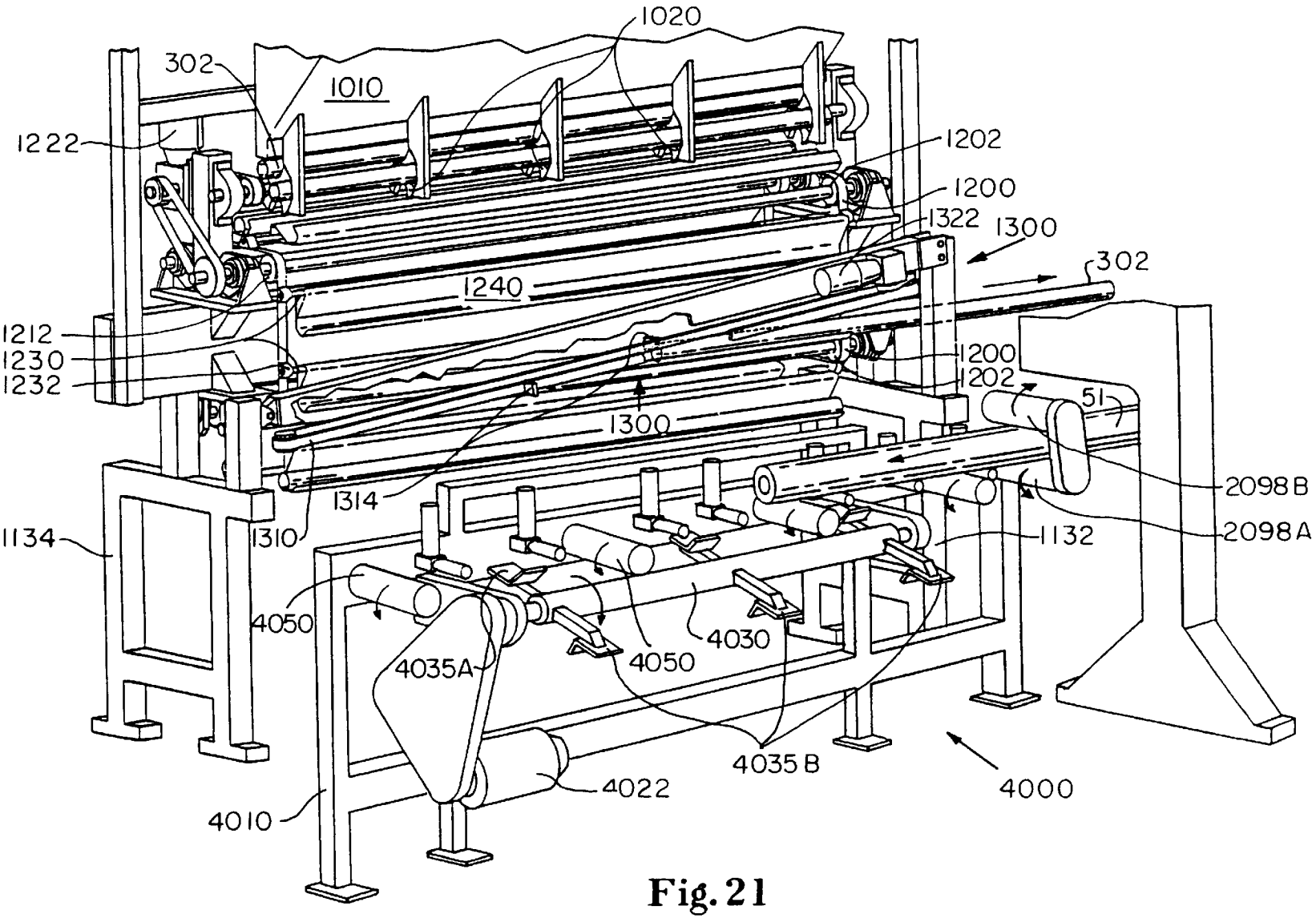
FIG. 21 is a rear perspective view of the core loading apparatus in FIG. 1.
Figure 23:
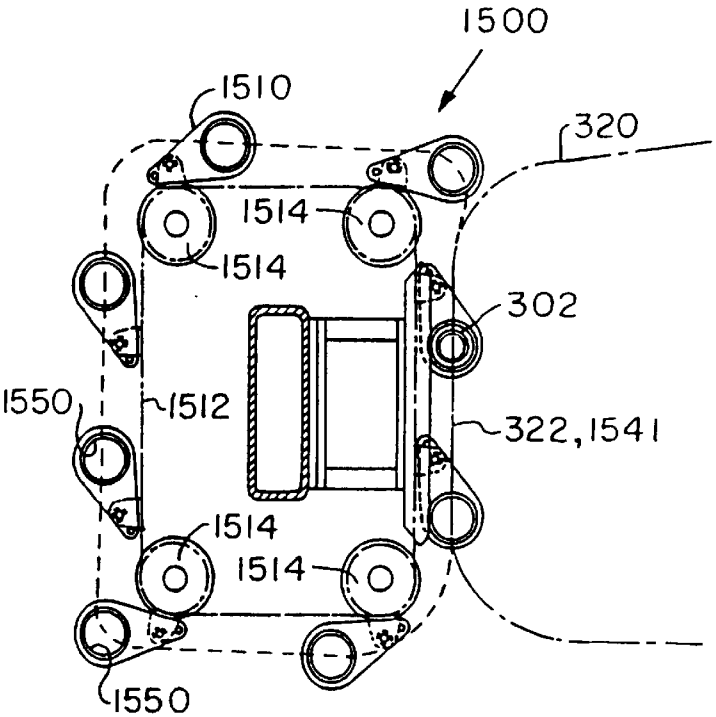
FIG. 23 is a schematic side view shown partially in cross-section of the core guide assembly shown in FIG. 1.
Figure 22:
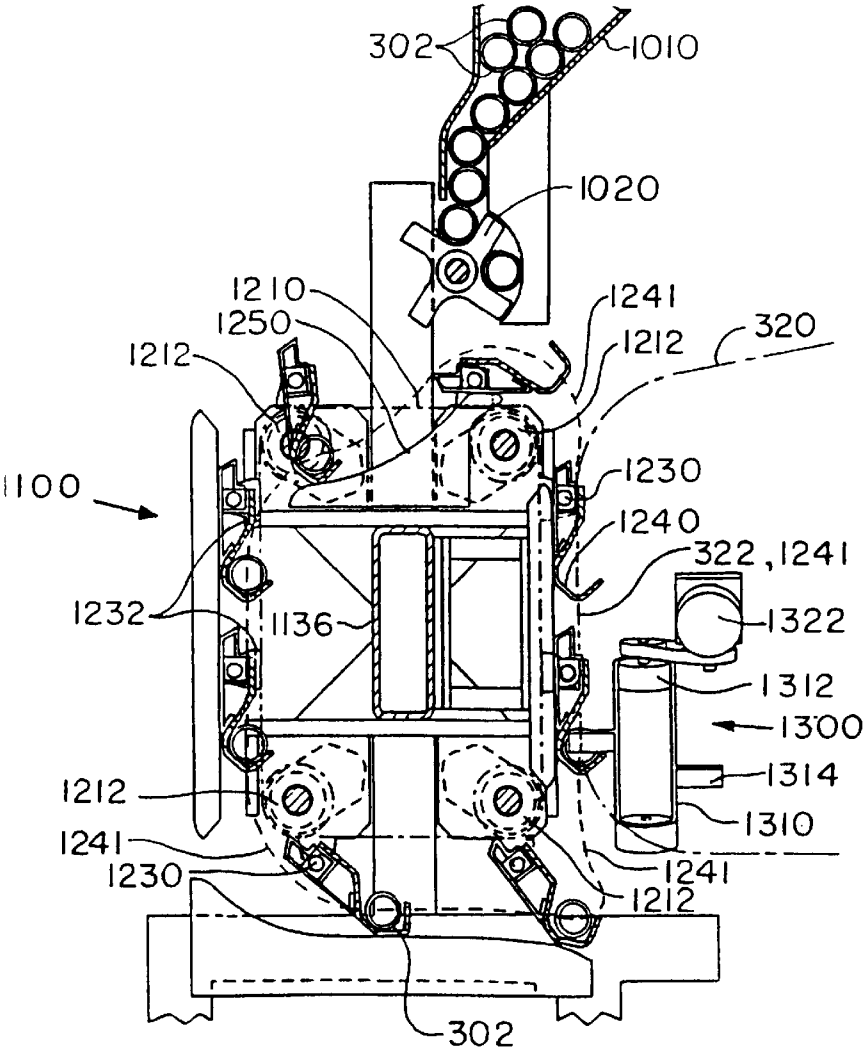
FIG. 22 is a schematic side view shown partially in cross-section of the core loading apparatus shown in FIG. 1.

The core loading apparatus 1000 for conveying cores 302 onto moving mandrels 300 is shown in FIGS. 1 and 21–23. The core loading apparatus comprises a core hopper 1010, a core loading carousel 1100, and a core guide assembly 1500 disposed intermediate the turret winder 100 and the core loading carousel 1100. FIG. 21 is a perspective view of the rear of the core loading apparatus 1000. FIG. 21 also shows a portion of the core stripping apparatus 2000. FIG. 22 is an end view of the core loading apparatus 1000 shown partially cut away and viewed parallel to the turret assembly central axis 202. FIG. 23 is an end view of the core guide assembly 1500 shown partially cut away.

Referring to FIGS. 1 and 21–23, the core loading carrousel 1100 comprises a stationary frame 1110. The stationary frame can include vertically upstanding frame ends 1132 and 1134, and a frame cross support 1136 extending horizontally intermediate the frame ends 1132 and 1134. Alternatively, the core loading carousel 1100 could be supported at one end in a cantilevered fashion.

In the embodiment shown, an endless belt 1200 is driven around a plurality of pulleys 1202 adjacent the frame end 1132. Likewise, an endless belt 1210 is driven around a plurality of pulleys 1212 adjacent the frame end 1134. The belts are driven around their respective pulleys by a servo motor 1222. A plurality of support rods 1230 pivotably connect core trays 1240 to lugs 1232 attached to the belts 1200 and 1210. In one embodiment, a support rod 1230 can emend from each end of a core tray 1240. In an alternative embodiment, the support rods 1230 can extend in parallel rung fashion between lugs 1232 attached to the belts 1200 and 1210, and each core tray 1240 can be hung from one of the support rods 1230. The core trays 1240 extend intermediate the endless belts 1200 and 1210, and are carried in a closed core tray path 1241 by the endless belts 1200 and 1210. The servo motor 1222 is controlled to phase the motion of the core trays with respect to a reference that is a function of the angular position of the bedroll 59 about its axis of rotation, and a function of an accumulated number of revolutions of the bedroll 59. In particular, the position of the core trays can be phased with respect to the position of the bedroll 59 within a log wind cycle, thereby synchronizing the movement of the core trays with rotation of the turret assembly 200.

The core hopper 1010 is supported vertically above the core carousel 1100 and holds a supply of cores 302. The cores 302 in the hopper 1010 are gravity fed to a plurality of rotating slotted wheels 1020 positioned above the closed core tray path. The slotted wheels 1020, which can be rotatably driven by the servo motor 1222, deliver a core 302 to each core tray 1240 be used in place of the slotted wheels 1020 to deliver a core to each core tray 1240. Alternatively, a lugged belt could be used in place of the slotted wheels to pick up a core and place a core in each core tray. A core tray support surface 1250 (FIG. 22) positions the core trays to receive a core from the slotted wheels 1020 as the core trays pass beneath the slotted wheels 1020. The cores 302 supported in the core trays 1240 are carried around the closed core tray path 1241.

Referring to FIG. 22, the cores 302 are carried in the trays 1240 along at least a portion of the closed tray path 1241 which is aligned with core loading segment 322 of the closed mandrel path 320. A core loading conveyor 1300 is positioned adjacent the portion of the closed tray path 1241 which is aligned with the core loading segment 322. The core loading conveyor 1300 comprises an endless belt 1310 driven about pulleys 1312 by a servo motor 1322. The endless belt 1310 has a plurality of flight elements 1314 for engaging the cores 302 held in the trays 1240. The flight element 1314 engages a core 302 held in a tray 1240 and pushes the core 302 at least part of the way out of the tray 1240 such that the core 302 at least partially engages a mandrel 300. The flight elements 1314 need not push the core 302 completely out of the tray 1240 and onto the mandrel 300, but only far enough such that the core 302 is engaged by the core drive rollers 505.

The endless belt 1310 is inclined such that the elements 1314 engage the cores 302 held in the core trays 1240 with a velocity component generally parallel to a mandrel axis and a velocity component generally parallel to at least a portion of the core loading segment 322 of the closed mandrel path 320. In the embodiment shown, the core trays 1240 carry the cores 302 vertically, and the flight elements 1314 of the core loading conveyor 1300 engage the cores with a vertical component of velocity and a horizontal component of velocity. The servo motor 1322 is controlled to phase the position of the flight elements 1314 with respect to a reference that is a function of the angular position of the bedroll 59 about its axis of rotation, and a function of an accumulated number of revolutions of the bedroll 59. In particular, the position of the flight elements 1314 can be phased with respect to the position of the bedroll 59 within a log wind cycle. The motion of the flight elements 1314 can thereby be synchronized with the position of the core trays 1240 and with the rotational position of the turret assembly 200.

The core guide assembly 1500 disposed intermediate the core loading carousel 1100 and the turret winder 100 comprises a plurality of core guides 1510. The core guides position the cores 302 with respect to the second ends 312 of the mandrels 300 as the cores 302 are driven from the core trays 1240 by the core loading conveyor 1300. The core guides 1510 are supported on endless belt conveyors 1512 driven around pulleys 1524. The belt conveyors 1512 are driven by the servo motor 1222, through a shaft and coupling arrangement (not shown). The core guides 1510 thereby maintain registration with the core trays 1240. The core guides 1510 extend in parallel rung fashion intermediate the belt conveyors 1512, and are carried around a closed core guide path 1541 by the conveyors 1512.

At least a portion of the closed core guide path 1541 is aligned with a portion of the closed core tray path 1241 and a portion of the core loading segment 322 of the closed mandrel path 320. Each core guide 1510 comprises a core guide channel 1550 which extends from a first end of the core guide 1510 adjacent the core loading carousel 1100 to a second end of the core guide 1510 adjacent the turret winder 100. The core guide channel 1550 converges as it extends from the first end of the core guide 1510 to the second end of the core guide. Convergence of the core guide channel 1550 helps to center the cores 302 with respect to the second ends 312 of the mandrels 300. In FIG. 1, the core guide channels 1550 at the first ends of the core guides 1510 adjacent the core loading carousel are flared to accommodate some misalignment of cores 302 pushed from the core trays 1240.

Core Stripping Apparatus

Figures 24, 25A, 25B, 25C:
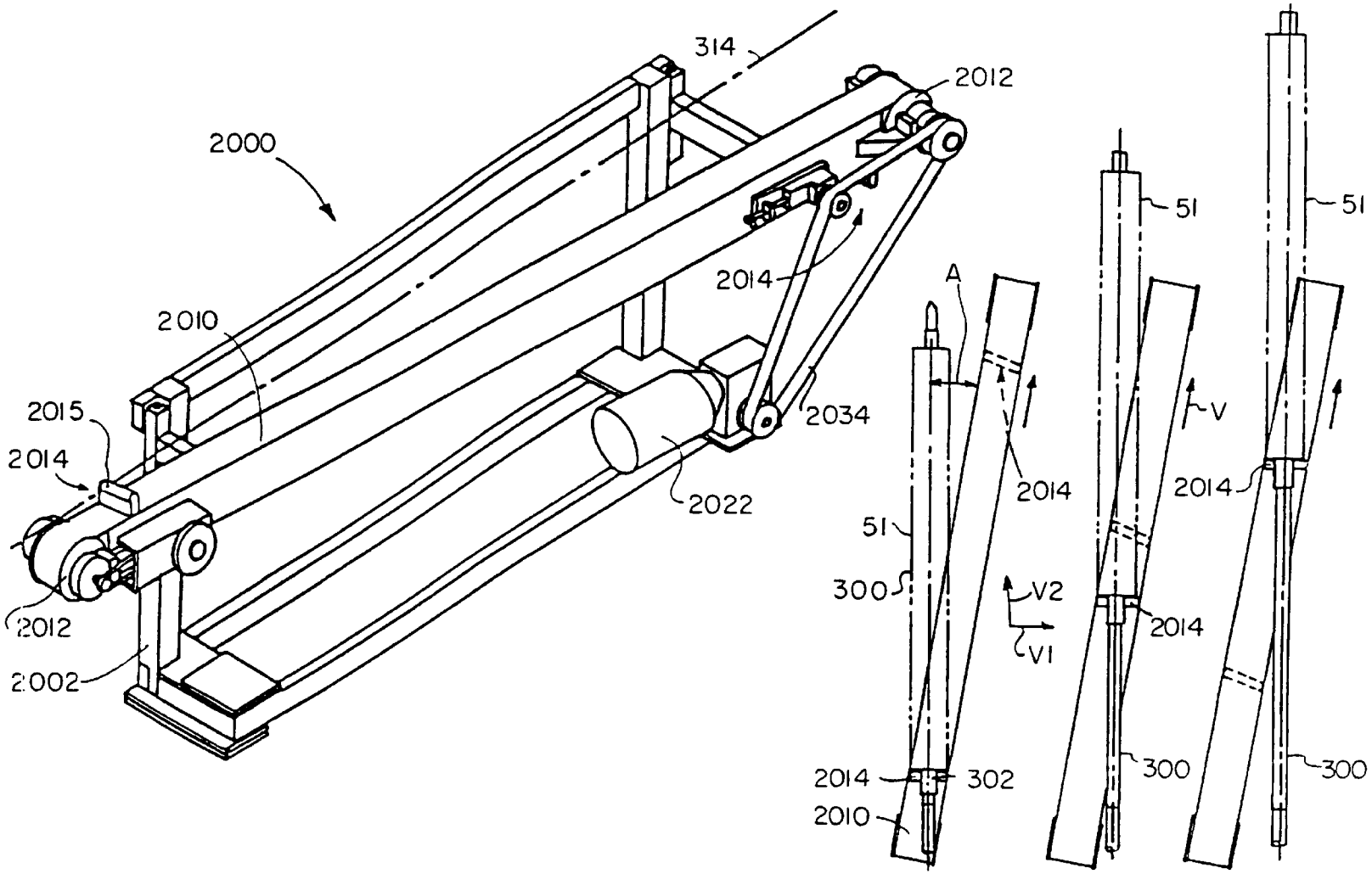
FIG. 24 is a front perspective view of the core stripping apparatus in FIG. 1.
FIGS. 25A, B, and C are top views showing a web wound core being stripped from a mandrel by the core stripping apparatus.

FIGS. 1, 24 and 25A–C illustrate the core stripping apparatus 2000 for removing logs 51 from uncupped mandrels 300. The core stripping apparatus 2000 comprises an endless conveyor belt 2010 and servo drive motor 2022 supported on a frame 2002. The conveyor belt 2010 is positioned vertically beneath the closed mandrel path adjacent to the core stripping segment 326. The endless conveyor belt 2010 is continuously driven around pulleys 2012 by a drive belt 2034 and servo motor 2022. The conveyor belt 2010 carries a plurality of flights 2014 spaced apart at equal intervals on the conveyor belt 2010 (two flights 2014 in FIG. 24). The flights 2014 move with a linear velocity V (FIG. 25A). Each flight 2014 engages the end of a log 51 supported on a mandrel 300 as the mandrel moves along the core stripping segment 326.

The servo motor 2022 is controlled to phase the position of the flights 2014 with respect to a reference that is a function of the angular position of the bedroll 59 about its axis of rotation, and a function of an accumulated number of revolutions of the bedroll 59. In particular, the position of the flights 2014 can be phased with respect to the position of the bedroll 59 within a log wind cycle. Accordingly, the motion of the flights 2014 can be synchronized with the rotation of the turret assembly 200.

The flighted conveyor belt 2010 is angled with respect to mandrel axes 314 as the mandrels 300 are carried along a straight line portion of the core stripping segment 326 of the closed mandrel path. For a given mandrel speed along the core stripping segment 326 and a given conveyor flight speed V, the included angle A between the conveyor 2010 and the mandrel axes 314 is selected such that the flights 2014 engage each log 51 with a first velocity component V1 generally parallel to the mandrel axis 314 to push the logs off the mandrels 300, and a second velocity component V2 generally parallel to the straight line portion of the core stripping segment 326. In one embodiment, the angle A can be about 4–7 degrees.

As shown in FIGS. 25A–C, the flights 2014 are angled with respect to the conveyor belt 2010 to have a log engaging face which forms an included angle equal to A with the centerline of the belt 2010. The angled log engaging face of the flight 2014 is generally perpendicular to the mandrel axes 314 to thereby squarely engage the ends of the logs 51. Once the log 51 is stripped from the mandrel 300, the mandrel 300 is carried along the closed mandrel path to the core loading segment 322 to receive another core 302. In some instances it may be desirable to strip an empty core 302 from a mandrel. For instance, it may be desirable to strip an empty core 302 from a mandrel during startup of the turret winder, or if no web material is wound onto a particular core 302. Accordingly, the flights 2014 can each have a deformable rubber tip 2015 for slidably engaging the mandrel as the web wound core is pushed from the mandrel. Accordingly, the flights 2014 contact both the core 302 and the web wound on the core 302, and have the ability to strip empty cores (i.e. core on which no web is wound) from the mandrels.

Log Reject Apparatus

FIG. 21 shows a log reject apparatus 4000 positioned downstream of the core stripping apparatus 2000 for receiving logs 51 from the core stripping apparatus 2000. A pair of drive rollers 2098A and 2098B engage the logs 51 leaving the mandrels 300, and propel the logs 51 to the log reject apparatus 4000. The log reject apparatus 4000 includes a servo motor 4022 and a selectively rotatable reject element 4030 supported on a frame 4010. The rotatable reject element 4030 supports a first set of log engaging arms 4035A and a second set of oppositely extending log engaging arms 4035B (three arms 4035A and three arms 4035B shown in FIG. 21).

During normal operation, the logs 51 received by the log reject apparatus 4000 are carried by continuously driven rollers 4050 to a first acceptance station, such as a storage bin or other suitable storage receptacle. The rollers 4050 can be driven by the servo motor 2022 through a gear train or pulley arrangement to have a surface speed a fixed percentage higher than that of the flights 2014. The rollers 4050 can thereby engage the logs 51, and carry the logs 51 at a speed higher than that at which the logs are propelled by the flights 2014.

In some instances, it is desirable to direct one or more logs 51 to a second, reject station, such as a disposal bin or recycle bin. For instance, one or more defective logs 51 may be produced during startup of the web winding apparatus 90, or alternatively, a log defect sensing device can be used to detect defective logs 51 at any time during operation of the apparatus 90. The servo motor 4022 can be controlled manually or automatically to intermittently rotate the element 4030 in increments of about 180 degrees. Each time the element 4030 is rotated 180 degrees, one of the sets of log engaging arms 4035A or 4035B engages the log 51 supported on the rollers 4050 at that instant. The log is lifted from the rollers 4050, and directed to the reject station. At the end of the incremental rotation of the element 4030, the other set of arms 4035A or 4035B is in position to engage the next defective log.

Mandrel Description

Figure 26:
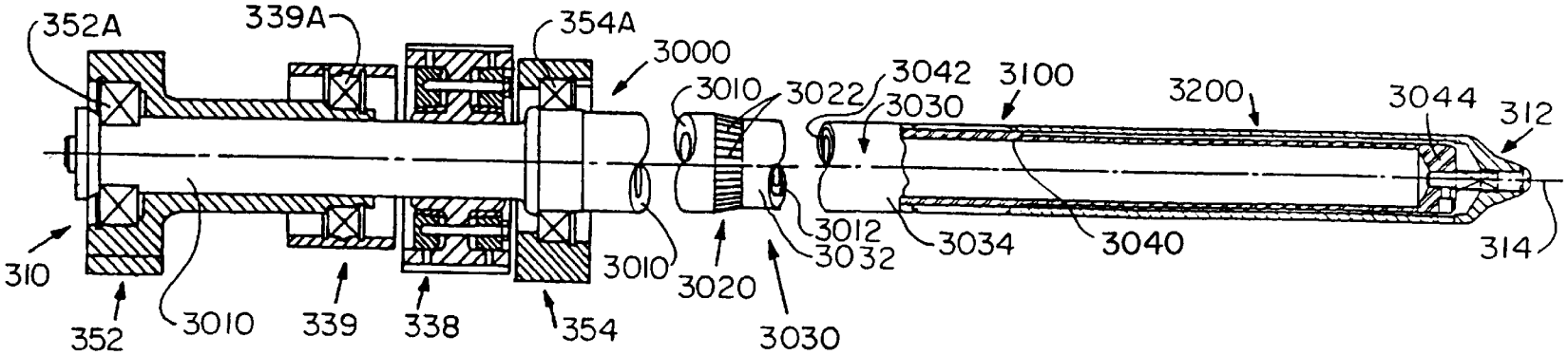
FIG. 26 is a schematic side view of a mandrel shown partially in cross-section.

FIG. 26 is a partial cross-sectional view of a mandrel 300 according to the present invention. The mandrel 300 extends from the first end 310 to the second end 312 along the mandrel longitudinal axis 314. Each mandrel includes a mandrel body 3000, a deformable core engaging member 3100 supported on the mandrel 300, and a mandrel nosepiece 3200 disposed at the second end 312 of the mandrel. The mandrel body 3000 can include a steel tube 3010, a steel endpiece 3040, and a non-metallic composite mandrel tube 3030 extending intermediate the steel tube 3010 and the steel endpiece 3040.

At least a portion of the core engaging member 3100 is deformable from a first shape to a second shape for engaging the inner surface of a hollow core 302 after the core 302 is positioned on the mandrel 300 by the core loading apparatus 1000. The mandrel nosepiece 3200 can be slidably supported on the mandrel 300, and is displaceable relative to the mandrel body 3000 for deforming the deformable core engaging member 3100 from the first shape to the second shape. The mandrel nosepiece is displaceable relative to the mandrel body 3000 by a mandrel cup 454.

Figure 27:
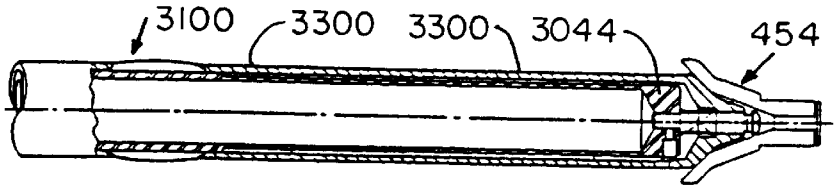
FIG. 27 is a partial schematic side view of the mandrel shown partially in cross-section, a cupping arm assembly shown engaging the mandrel nosepiece to displace the nosepiece toward the mandrel body, thereby compressing the mandrel deformable ring.
Figure 29:
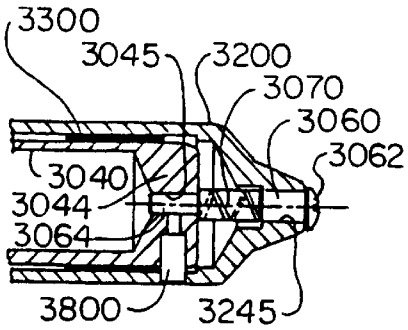
FIG. 29 is an enlarged schematic side view of the second end of the mandrel of FIG. 26 showing the nosepiece biased away from the mandrel body.
Figure 28:
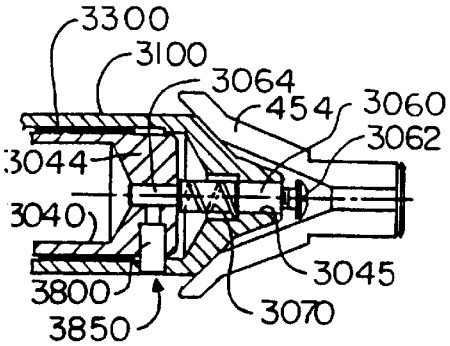
FIG. 28 is an enlarged schematic side view of the second end of the mandrel of FIG. 26 showing a cupping arm assembly engaging the mandrel nosepiece to displace the nosepiece toward the mandrel body.

The deformable core engaging member 3100 can comprise one or more elastically deformable polymeric rings 3110 (FIG. 30) radially supported on the steel endpiece 3040. By "elastically deformable" it is meant that the member 3100 deforms from the first shape to the second shape under a load, and that upon release of the load the member 3100 returns substantially to the first shape. The mandrel nosepiece can be displaced relative to the endpiece 3040 to compress the rings 3110, thereby causing the rings 3100 to elastically buckle in a radially outwardly direction to engage the inside diameter of the core 302. FIG. 27 illustrates deformation of the deformable core engaging member 3100. FIGS. 28 and 29 are enlarged views of a portion of the nosepiece 3200 showing motion of the nosepiece 3200 relative to steel endpiece 3040.

Referring to the components of the mandrel 300 in more detail, the first and second bearing housings 352 and 354 have bearings 352A and 354A for rotatably supporting the steel tube 3010 about the mandrel axis 314. The mandrel drive pulley 339 and the idler pulley 339 are positioned on the steel tube 3010 intermediate the bearing housings 352 and 354. The mandrel drive pulley 338 is fixed to the steel tube 3010, and the idler pulley 339 can be rotatably supported on an extension of the bearing housing 352 by idler pulley bearing 339A, such that the idler pulley 339 free wheels relative to the steel tube 3010.

The steel tube 3010 includes a shoulder 3020 for engaging the end of a core 302 driven onto the mandrel 300. The shoulder 3020 is preferably frustum shaped, as shown in FIG. 26, and can have a textured surface to restrict rotation of the core 302 relative to the mandrel body 3000. The surface of the frustum shaped shoulder 3020 can be textured by a plurality of axially and radially extending splines 3022. The splines 3022 can be uniformly spaced about the circumference of the shoulder 3020. The splines can be tapered as they extend axially from left to right in FIG. 26, and each spline 3022 can have a generally triangular cross-section at any given location along its length, with a relatively broad base attachment to the shoulder 3020 and a relatively narrow apex for engaging the ends of the cores.

Figure 30:
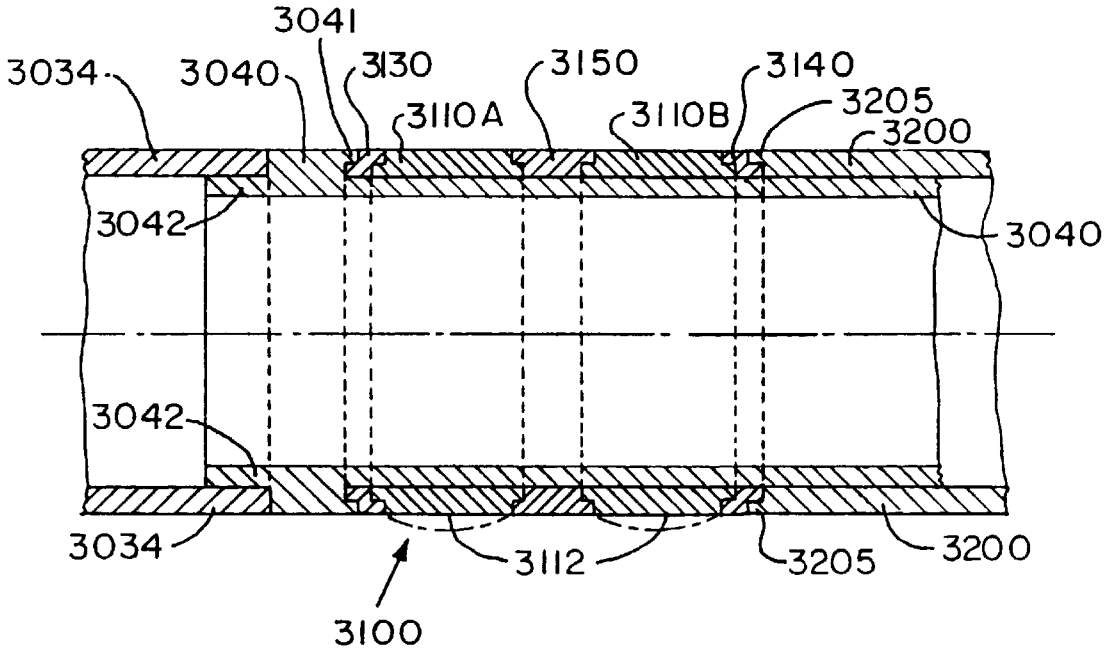
FIG. 30 is a cross-sectional view of a mandrel deformable ring.

The steel tube 3010 has a reduced diameter end 3012 (FIG. 26) which extends from the shoulder 3020. The composite mandrel tube 3030 extends from a first end 3032 to a second end 3034. The first end 3032 extends over the reduced diameter end 3012 of the steel tube 3010. The first end 3032 of the composite mandrel tube 3030 is joined to the reduced diameter end 3012, such as by adhesive bonding. The composite mandrel tube 3030 can comprise a carbon composite construction. Referring to FIGS. 26 and 30, a second end 3034 of the composite mandrel tube 3030 is joined to the steel endpiece 3040. The endpiece 3040 has a first end 3042 and a second end 3044. The first end 3042 of the endpiece 3040 fits inside of, and is joined to the second end 3034 of the composite mandrel tube 3030.

The deformable core engaging member 3100 is spaced along the mandrel axis 314 intermediate the shoulder 3020 and the nosepiece 3200. The deformable core engaging member 3100 can comprise an annular ring having an inner diameter greater than the outer diameter of a portion of the endpiece 3040, and can be radially supported on the endpiece 3040. The deformable core engaging member 3 100 can extend axially between a shoulder 3041 on the endpiece 3040 and a shoulder 3205 on the nosepiece 3200, as shown in FIG. 30.

The member 3100 preferably has a substantially circumferentially continuous surface for radially engaging a core. A suitable continuous surface can be provided by a ring shaped member 3100. A substantially circumferentially continuous surface for radially engaging a core provides the advantage that the forces constraining the core to the mandrel are distributed, rather than concentrated. Concentrated forces, such as those provided by conventional core locking lugs, can cause tearing or piercing of the core. By "substantially circumferentially continuous" it is meant that the surface of the member 3100 engages the inside surface of the core around at least about 51 percent, more preferably around at least about 75 percent, and most preferably around at least about 90 percent of the circumference of the core.

The deformable core engaging member 3100 can comprise two elastically deformable rings 3110A and 3110B formed of 40 durometer "A" urethane, and three rings 3130, 3140, and 3150 formed of a relatively harder 60 durometer "D" urethane. The rings 3110A and 3110B each have an unbroken, circumferentially continuous surface 3112 for engaging a core. The rings 3130 and 3140 can have Z-shaped cross-sections for engaging the shoulders 3041 and 3205, respectively. The ring 3150 can have a generally T-shaped cross-section. Ring 3110A extends between and is joined to rings 3130 and 3150. Ring 3110B extends between and is joined to rings 3150 and 3140.

The nosepiece 3200 is slidably supported on bushings 3300 to permit axial displacement of the nosepiece 3200 relative to the endpiece 3040. Suitable bushings 3300 comprise a LEMPCOLOY base material with a LEMOCOAT 15 coating. Such bushings are manufactured by LEMPCO industries of Cleveland, Ohio. When nosepiece 3200 is displaced along the axis 314 toward the endpiece 3040, the deformable core engaging member 3100 is compressed between the shoulders 3041 and 3205, causing the rings 3110A and 3110B to buckle radially outwardly, as shown in phantom in FIG. 30.

Axial motion of the nosepiece 3200 relative to the endpiece 3040 is limited by a threaded fastener 3060, as shown in FIGS. 28 and 29. The fastener 3060 has a head 3062 and a threaded shank 3064. The threaded shank 3064 extends through an axially extending bore 3245 in the nosepiece 3200, and threads into a tapped hole 3045 disposed in the second end 3044 of the endpiece 3040. The head 3062 is enlarged relative to the diameter of the bore 3245, thereby limiting the axial displacement of the nosepiece 3200 relative to the endpiece 3040. A coil spring 3070 is disposed intermediate the end 3044 of the endpiece 3040 and the nosepiece 3200 for biasing the mandrel nosepiece from the mandrel body.

Once a core is loaded onto the mandrel 300, the mandrel cupping assembly provides the actuation force for compressing the rings 3110A and 3110B. As shown in FIG. 28, a mandrel cup 454 engages the nosepiece 3200, thereby compressing the spring 3070 and causing the nosepiece to slide axially along mandrel axis 314 toward the end 3044. This motion of the nosepiece 3200 relative to the endpiece 3040 compresses the rings 3110A and 3110B, causing them to deform radially outwardly to have generally convex surfaces 3112 for engaging a core on the mandrel. Once winding of the web on the core is complete and the mandrel cup 454 is retracted, the spring 3070 urges the nosepiece 3200 axially away from the endpiece 3040, thereby returning the rings 3110A and 3110B to their original, generally cylindrical undeformed shape. The core can then be removed from the mandrel by the core stripping apparatus.

The mandrel 300 also comprises an antirotation member for restricting rotation of the mandrel nosepiece 3200 about the axis 314, relative to the mandrel body 3000. The antirotation member can comprise a set screw 3800. The set screw 3800 threads into a tapped hole which is perpendicular to and intersects the tapped hole 3045 in the end 3044 of the endpiece 3040. The set screw 3800 abuts against the threaded fastener 3060 to prevent the fastener 3060 from coming loose from the endpiece 3040. The set screw 3800 extends from the endpiece 3040, and is received in an axially extending slot 3850 in the nosepiece 3200. Axial sliding of the nosepiece 3200 relative to the endpiece 3040 is accommodated by the elongated slot 3850, while rotation of the nosepiece 3200 relative to the endpiece 3040 is prevented by engagement of the set screw 3800 with the sides of the slot 3850.

Alternatively, the deformable core engaging member 3100 can comprise a metal component which elastically deforms in a radially outward direction, such as by elastic buckling, when compressed. For instance, the deformable core engaging member 3100 can comprise one or more metal rings having circumferentially spaced apart and axially extending slots. Circumferentially spaced apart portions of a ring intermediate each pair of adjacent slots deform radially outwardly when the ring is compressed by motion of the sliding nosepiece during cupping of the second end of the mandrel.

As Servo Motor Control System

The web winding apparatus 90 can comprise a control system for phasing the position of a number of independently driven components with respect to a common position reference, so that the position of one of the components can be synchronized with the position of one or more other components. By "independently driven" it is meant that the positions of the components are not mechanically coupled, such as by mechanical gear trains, mechanical pulley arrangements, mechanical linkages, mechanical cam mechanisms, or other mechanical means. In one embodiment, the position of each of the independently driven components can be electronically phased with respect to one or more other components, such as by the use of electronic gear ratios or electronic cams.

In one embodiment, the positions of the independently driven components is phased with respect to a common reference that is a function of the angular position of the bedroll 59 about its axis of rotation, and a function of an accumulated number of revolutions of the bedroll 59. In particular, the positions of the independently driven components can be phased with respect to the position of the bedroll 59 within a log wind cycle.

Each revolution of the bedroll 59 corresponds to a fraction of a log wind cycle. A log wind cycle can be defined as equaling 360 degree increments. For instance, if there are sixty-four 11¼ inch sheets on each web wound log 51, and if the circumference of the bedroll is 45 inches, then four sheets will be wound per bedroll revolution, and one log cycle will be completed (one log 51 will be wound) for each 16 revolutions of the bedroll. Accordingly, each revolution of the bedroll 59 will correspond to 22.5 degrees of a 360 degree log wind cycle.

The independently driven components can include: the turret assembly 200 driven by motor 222 (e.g. a 4 HP servo motor); the rotating mandrel cupping arm support 410 driven by the motor 422 (e.g. a 4 BP Servo motor); the roller 505A and mandrel support 610 driven by a 2 HP servo motor 510 (the roller 505A and the mandrel support 610 are mechanically coupled); the mandrel cupping support 710 driven by motor 711 (e.g. a 2 HP servo motor); the glue nozzle rack actuator assembly 840 driven by motor 822 (e.g. a 2 HP servo motor); the core carousel 1100 and core guide assembly 1500 driven by a 2 HP servo motor 1222 (rotation of the core carousel 1100 and the core guide assembly 1500 are mechanically coupled); the core loading conveyor 1300 driven by motor 1322 (e.g. a 2 HP servo motor); and the core stripping conveyor 2010 driven by motor 2022 (e.g. a 4 HP servo motor). Other components, such as core drive roller 505B/motor 511 and core glue spinning assembly 860/motor 862, can be independently driven, but do not require phasing with the bedroll 59. Independently driven components and their associated drive motors are shown schematically with a programmable control system 5000 in FIG. 31.

The bedroll 59 has an associated proximity switch. The proximity switch makes contact once for each revolution of the bedroll 59, at a given bedroll angular position. The programmable control system 5000 can count and store the number of times the bedroll 59 has completed a revolution (the number of times the bedroll proximity switch has made contact) since the completion of winding of the last log 51. Each of the independently driven components can also have a proximity switch for defining a home position of the component.

The phasing of the position of the independently driven components with respect to a common reference, such as the position of the bedroll within a log wind cycle, can be accomplished in a closed loop fashion. The phasing of the position of the independently driven components with respect to the position of the bedroll within a log wind cycle can include the steps of: determining the rotational position of the bedroll within a log wind cycle, determining the actual position of a component relative to the rotational position of the bedroll within the log wind cycle; calculating the desired position of the component relative to the rotational position of the bedroll within the log wind cycle; calculating a position error for the component from the actual and desired positions of the component relative to the rotational position of the bedroll within the log wind cycle; and reducing the calculated position error of the component.

In one embodiment, the position error of each component can be calculated once at the start up of the web winding apparatus 90. When contact is first made by the bedroll proximity switch at start up, the position of the bedroll with respect to the log wind cycle can be calculated based upon information stored in the random access memory of the programmable control system 5000. In addition, when the proximity switch associated with the bedroll first makes contact on start up, the actual position of each component relative to the rotational position of the bedroll within the log cycle is determined by a suitable transducer, such as an encoder associated with the motor driving the component. The desired position of the component relative to the rotational position of the bedroll within the log wind cycle can be calculated using an electronic gear ratio for each component stored in the random access memory of the programmable control system 5000.

When the bedroll proximity switch first makes contact at the start up of the winding apparatus 90, the accumulated number of rotations of the bedroll since completion of the last log wind cycle, the sheet count per log, the sheet length, and the bedroll circumference can be read from the random access memory of the programmable control system 5000. For example, assume the bedroll had completed seven rotations into a log wind cycle when the winding apparatus 90 was stopped (e.g. shutdown for maintenance). When the bedroll proximity switch first makes contact upon re-starting the winding apparatus 90, the bedroll completes its eighth full rotation since the last log wind cycle was completed. Accordingly, the bedroll at that instant is at the 180 degree (halfway) position of the log wind cycle, because for the given sheet count, sheet length and bedroll circumference, each rotation of the bedroll corresponds to 4 sheets of the 64 sheet log, and 16 revolutions of the bedroll are required to wind one complete log.

When contact is first made by the bedroll proximity switch at start up, the desired position of each of the independently driven components with respect to the position of the bedroll in the log wind cycle is calculated based upon the electronic gear ratio for that component and the position of the bedroll within the wind cycle. The calculated, desired position of each independently driven component with respect to the log wind cycle can then be compared to the actual position of the component measured by a transducer, such as an encoder associated with the motor driving the component. The calculated, desired position of the component with respect to the bedroll position in the log wind cycle is compared to the actual position of the component with respect to the bedroll position in the log wind cycle to provide a component position error. The motor driving the component can then be adjusted, such as by adjusting the motors speed with a motor controller, to drive the position error of the component to zero.

Figure 31:
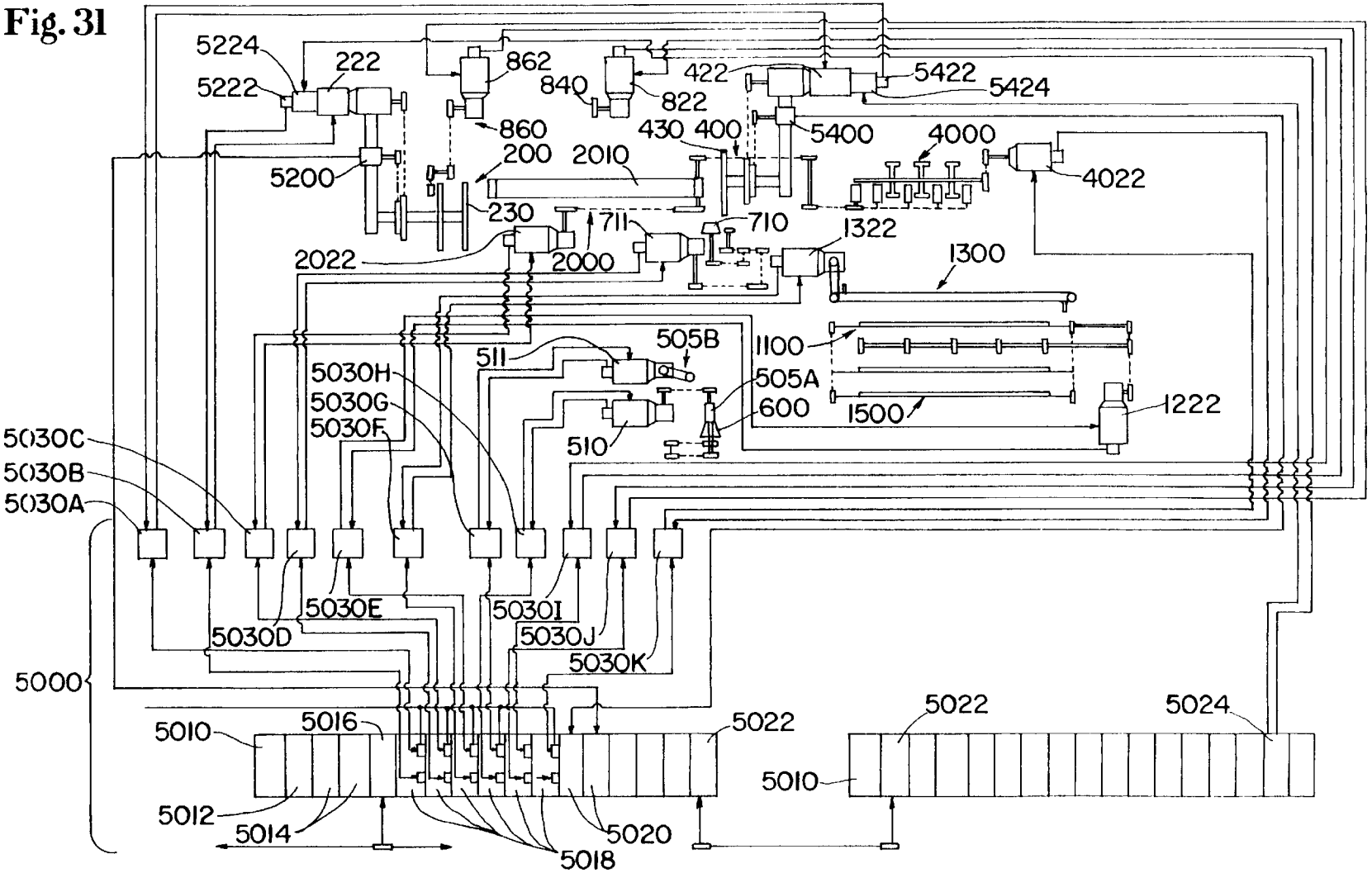
FIG. 31 is a schematic diagram showing a programmable drive control system for controlling the independently drive components of the web winding apparatus.

For example, when the proximity switch associated with the bedroll first makes contact at start up, the desired angular position of the rotating turret assembly 200 with respect to the position of the bedroll in the log wind cycle can be calculated based upon the number of revolutions the bedroll has made during the current log wind cycle, the sheet count, the sheet length, the circumference of the bedroll, and the electronic gear ratio stored for the turret assembly 200. The actual angular position of the turret assembly 200 is measured using a suitable transducer. Referring to FIG. 31, a suitable transducer is an encoder 5222 associated with the servo motor 222. The difference between the actual position of the turret assembly 200 and its desired position relative to the position of the bedroll within the log wind cycle is then used to control the speed of the motor 222, such as with a motor controller 5030B, and thereby drive the position error of the turret assembly 200 to zero.

The position of the mandrel cupping arm support 410 can be controlled in a similar manner, so that rotation of the support 410 is synchronized with rotation of the turret assembly 200. An encoder 5422 associated with the motor 422 driving the mandrel cupping assembly 400 can be used to measure the actual position of the support 410 relative to the bedroll position in the log wind cycle. The speed of the servo motor 422 can be varied, such as with a motor controller 5030A, to drive the position error of the support 410 to zero. By phasing the angular positions of both the turret assembly 200 and the support 410 relative to a common reference, such as the position of the bedroll 59 within the log wind cycle, the rotation of the mandrel cupping arm support 410 is synchronized with that of the turret assembly 200, and twisting of the mandrels 300 is avoided. Alternatively, the position of the independently driven components could be phased with respect to a reference other than the position of the bedroll within a log wind cycle.

The position error of an independently driven component can be reduced to zero by controlling the speed of the motor driving that particular component. In one embodiment, the value of the position error is used to determine whether the component can be brought into phase with the bedroll more quickly by increasing the drive motor speed, or by decreasing the motor speed. If the value of the position error is positive (the actual position of the component is "ahead" of the desired position of the component), the drive motor speed is decreased. If the value of the position error is negative (the actual position of the component is "behind" the desired position of the component), the drive motor speed is increased. In one embodiment, the position error is calculated for each component when the bedroll proximity switch first makes contact at start up, and a linear variation in the speed of the associated drive motor is determined to drive the position error to zero over the remaining portion of the log wind cycle.

Normally, the position of a component in log wind cycle degrees should correspond to the position of the bedroll in log cycle degrees (e.g., the position of a component in log wind cycle degrees should be zero when the position of the bedroll in log wind cycle degrees is zero.) For instance, when the bedroll proximity switch makes contact at the beginning of a wind cycle (zero wind cycle degrees), the motor 222 and the turret assembly 200 should be at an angular position such that the actual position of the turret assembly 200 as measured by the encoder 5222 corresponds to a calculated, desired position of zero wind cycle degrees. However, if the belt 224 driving the turret assembly 200 should slip, or if the axis of the motor 222 should otherwise move relative to the turret assembly 200, the encoder will no longer provide the correct actual position of the turret assembly 200.

In one embodiment the programmable control system can be programmed to allow an operator to provide an offset for that particular component. The offset can be entered into the random access memory of the programmable control system in increments of about 1/10 of a log wind cycle degree. Accordingly, when the actual position of the component matches the desired, calculated position of the component modified by the offset, the component is considered to be in phase with respect to the position of the bedroll in the log wind cycle. Such an offset capability allows continued operation of the winder apparatus 90 until mechanical adjustments can be made.

In one embodiment, a suitable programmable control system 5000 for phasing the position of the independently driven components comprises a programmable electronic drive control system having programmable random access memory, such as an AUTOMAX programmable drive control system manufactured by the Reliance Electric Company of Cleveland, Ohio. The AUTOMAX programmable drive system can be operated using the following manuals, all of which are incorporated herein by reference: AUTOMAX System Operation Manual Version 3.0 J2-3005, AUTOMAX Prograrrning Reference Manual J-3696; and AUTOMAX Hardware Reference Manual J-3656,3658. It will be understood, however, that in other embodiments of the present invention, other control systems, such as those available from Emerson Electronic Company, Giddings and Lewis, and the General Electric Company could also be used.

Referring to FIG. 31, the AUTOMAX programmable drive control system includes one or more power supplies 5010, a common memory module 5012, two Model 7010 microprocessors 5014, a network connection module 5016, a plurality of dual axis programmable cards 5018 (each axis corresponding to a motor driving one of the independently driven components), resolver input modules 5020, general input/output cards 5022, and a VAC digital output card 5024. The AUTOMAX system also includes a plurality of model HG2000 motor controllers 5030A-K. Each motor controller is associated with a particular drive motor. For instance, motor controller 5030B is associated with the servo motor 222, which drives rotation of the turret assembly 200.

The common memory module 5012 provides an interface between multiple microprocessors. The two Model 7010 microprocessors execute software programs which control the independently driven components. The network connection module 5016 transmits control and status data between an operator interface and other components of the programmable control system 5000, as well as between the programmable control system 5000 and a programmable mandrel drive control system 6000 discussed below. The dual axis programmable cards 5018 provide individual control of each of the independently driven components. The signal from the bedroll proximity switch is hardwired into each of the dual axis programmable cards 5018. The resolver input modules 5020 convert the angular displacement of the resolvers 5200 and 5400 (discussed below) into digital data. The general input/output cards 5022 provide a path for data exchange among different components of the control system 5000. The VAC digital output card 5024 provides output to brakes 5224 and 5424 associated with motors 222 and 422, respectively.

Figure 32:
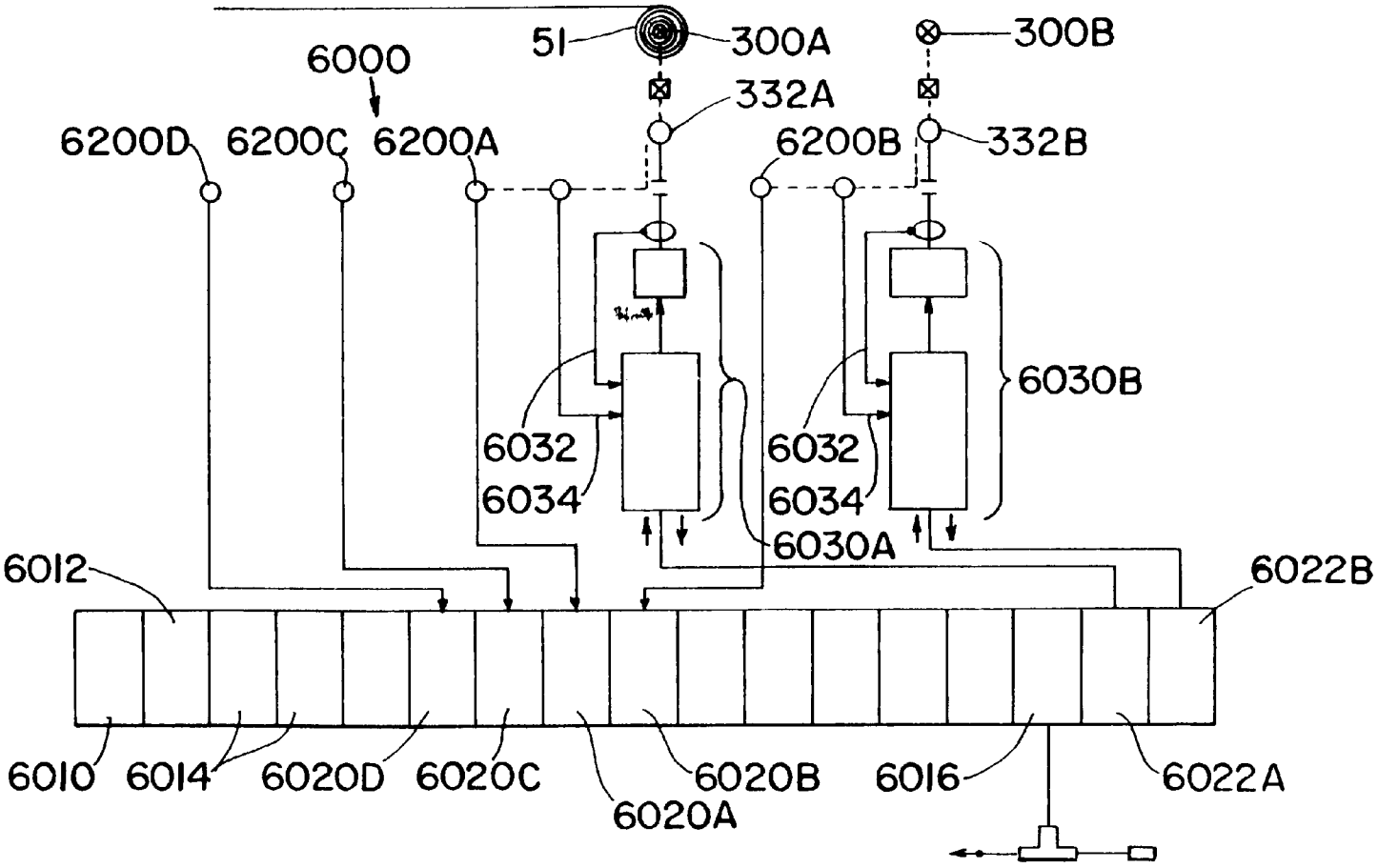
FIG. 32 is a schematic diagram showing a programmable mandrel drive control system for controlling mandrel drive motors.

In one embodiment, the mandrel drive motors 332A and 332B are controlled by a programmable mandrel drive control system 6000, shown schematically in FIG. 32. The motors 332A and 332B can be 30 HP, 460 Volt AC motors. The programmable mandrel drive control system 6000 can include an AUTOMAX system including a power supply 6010, a common memory module 6012 having random access memory, two central processing units 6014, a network communication card 6016 for providing communication between the programmable mandrel control system 6000 and the programmable control system 5000, resolver input cards 6020A–6020D, and Serial Dual Port cards 6022A and 6022B. The programmable mandrel drive control system 6000 can also include AC motor controllers 6030A and 6030B, each having current feedback 6032 and speed regulator 6034 inputs. Resolver input cards 6020A and 6020D receive inputs from resolvers 6200A and 6200B3, which provide a signal related to the rotary position of the mandrel drive motors 332A and 332B, respectively. Resolver input card 6020C receives input from a resolver 6200C, which provides a signal related to the angular position of the rotating turret assembly 200. In one embodiment, the resolver 6200C and the resolver 5200 in FIG. 31 can be one and the same. Resolver input card 6020D receives input from a resolver 6200D, which provides a signal related to the angular position of the bedroll 59.

An operator interface (not shown), which can include a keyboard and display screen, can be used to enter data into, and display data from the programmable drive system 5000. A suitable operator interface is a XYCOM Series 8000 Industrial Workstation manufactured by the Xycom Corporation of Saline, Michigan. Suitable operator interface software for use with the XYCOM Series 8000 workstation is Interact Software available from the Computer Technology Corporation of Milford, Ohio. The individually driven components can be jogged forward or reverse, individually or together by the operator. In addition, the operator can type in a desired offset, as described above, from the keyboard. The ability to monitor the position, velocity, and current associated with each drive motor is built into (hard wired into) the dual axis programmable cards 5010. The position, velocity, and current associated with each drive motor is measured and compared with associated position, velocity and current limits, respectively. The programmable control system 5000 halts operation of all the drive motors if any of the position, velocity, or current limits are exceeded.

In FIG. 2, the rotatably driven turret assembly 200 and the rotating cupping arm support plate 430 are rotatably driven by separate servo motors 222 and 422, respectively. The motors 222 and 422 can continuously rotate the turret assembly 200 and the rotating cupping arm support plate 430 about the central axis 202, at a generally constant angular velocity. The angular position of the turret assembly 200 and the angular position of the cupping arm support plate 430 are monitored by position resolvers 5200 and 5400, respectively, shown schematically in FIG. 31. The programmable drive system 5000 halts operation of all the drive motors if the angular position the turret assembly 200 changes more than a predetermined number of angular degrees with respect to the angular position of the support plate 430, as measured by the position resolvers 5200 and 5400.

In an alternative embodiment, the rotatably driven turret assembly 200 and the cupping arm support plate 430 could be mounted on a common hub and be driven by a single drive motor. Such an arrangement has the disadvantage that torsion of the common hub interconnecting the rotating turret and cupping arm support assemblies can result in vibration or mispositioning of the mandrel cups with respect to the mandrel ends if the connecting hub is not made sufficiently massive and stiff. The web winding apparatus of the present invention drives the independently supported rotating turret assembly 200 and rotating cupping arm support plate 430 with separate drive motors that are controlled to maintain positional phasing of the turret assembly 200 and the mandrel cupping arms 450 with a common reference, thereby mechanically decoupling rotation of the turret assembly 200 and the cupping arm support plate 430.

In the embodiment described, the motor driving the bedroll 59 is separate from the motor driving the rotating turret assembly 200 to mechanically decouple rotation of the turret assembly 200 from rotation of the bedroll 59, thereby isolating the turret assembly 200 from vibrations caused by the upstream winding equipment. Driving the rotating turret assembly 200 separately from the bedroll 59 also allows the ratio of revolutions of the turret assembly 200 to revolutions of the bedroll 59 to be changed electronically, rather than by changing mechanical gear trains.

Changing the ratio of turret assembly rotations to bedroll rotations can be used to change the length of the web wound on each core, and therefore change the number of perforated sheets of the web which are wound on each core. For instance, if the ratio of the turret assembly rotations to bedroll rotations is increased, fewer sheets of a given length will be wound on each core, while if the ratio is decreased, more sheets will be wound on each core. The sheet count per log can be changed while the turret assembly 200 is rotating, by changing the ratio of the turret assembly rotational speed to the ratio of bedroll rotational speed while turret assembly 200 is rotating.

In one embodiment according to the present invention, two or more mandrel winding speed schedules, or mandrel speed curves, can be stored in random access memory which is accessible to the programmable control system 5000. For instance, two or more mandrel speed curves can be stored in the common memory 6012 of the programmable mandrel drive control system 6000. Each of the mandrel speed curves stored in the random access memory can correspond to a different size log (different sheet count per log). Each mandrel speed curve can provide the mandrel winding speed as a function of the angular position of the turret assembly 200 for a particular sheet count per log. The web can be severed as a function of the desired sheet count per log by changing the timing of the activation of the chopoff solenoid.

In one embodiment, the sheet count per log can be changed while the turret assembly 200 is rotating by:

1) storing at least two mandrel speed curves in addressable memory, such as random access memory accessible to the programmable control system 5000;
2) providing a desired change in the sheet count per log via the operator interface;
3) selecting a mandrel speed curve from memory, based upon the desired change in the sheet count per log;

4) calculating a desired change in the ratio of the rotational speeds of the turret assembly 200 and the mandrel cupping assembly 400 to the rotational speed of the bedroll 59 as a function of the desired change in the sheet count per log;

5) calculating a desired change in the ratios of the speeds of the core drive roller 505A and mandrel support 610 driven by motor 510; the mandrel support 710 driven by motor 711; the glue nozzle rack actuator assembly 840 driven by motor 822; the core carrousel 1100 and core guide assembly 1500 driven by the motor 1222; the core loading conveyor 1300 driven by motor 1322; and the core stripping apparatus 2000 driven by motor 2022; relative to the rotational speed of the bedroll 59 as a function of the desired change in the sheet count per log;

6) changing the electronic gear ratios of the turret assembly 200 and the mandrel cupping assembly 400 with respect to the bedroll 59 in order to change the ratio of the rotational speeds of the turret assembly 200 and the mandrel cupping assembly 400 to the rotational speed of the bedroll 59;

7) changing the electronic gear ratios of the following components with respect to the bedroll 59 in order to change the speeds of the components relative to the bedroll 59; the core drive roller 505A and mandrel support 610 driven by motor 510; the mandrel support 710 driven by motor 711; the glue nozzle rack actuator assembly 840 driven by motor 822; the core carousel 1100 and core guide assembly 1500 driven by the motor 1222; the core loading conveyor 1300 driven by motor 1322; and the core stripping apparatus 2000 driven by motor 2022 relative to the rotational speed of the bedroll 59; and 8) severing the web as a function of the desired change in the sheet count per log, such as by varying the chopof solenoid activation timing.

Each time the sheet count per log is changed, the position of the independently driven components can be re-phased with respect to the position of the bedroll within a log wind cycle by: determining an updated log wind cycle based upon the desired change in the sheet count per log; determining the rotational position of the bedroll within the updated log wind cycle; determining the actual position of a component relative to the rotational position of the bedroll within the updated log wind cycle; calculating the desired position of the component relative to the rotational position of the bedroll within the updated log wind cycle; calculating a position error for the component from the actual and desired positions of the component relative to the rotational position of the bedroll within the updated log wind cycle; and reducing the calculated position error of the component.

While particular embodiments of the present invention have been illustrated and described, various changes and modifications can be made without departing from the spirit and scope of the invention. For instance, the turret assembly central axis is shown extending horizontally in the figures, but it will be understood that the turret assembly axis 202 and the mandrels could be oriented in other directions, including but not limited to vertically. It is intended to cover, in the appended claims, all such modifications and intended uses.

TABLE IA

| | CAM PROFILE C-804486-A | |
|---|---|---|
| POINT | X | Y |
| A61 | 7.375 | −10.3108 |
| A61.6 | 7.0246 | −10.4618 |
| A62 | 7.1551 | −10.4087 |
| A63 | 6.9292 | −10.4983 |
| A64 | 6.6972 | −10.5789 |
| A65 | 6.4588 | −10.6499 |
| A66 | 6.2138 | −10.7103 |
| A67 | 5.9618 | −10.7594 |
| A68 | 5.7026 | −10.7959 |
| A69 | 5.4357 | −10.8187 |
| A70 | 5.1604 | −10.8262 |
| A71 | 4.8763 | −10.8168 |
| A72 | 4.5823 | −10.7881 |
| A73 | 4.2776 | −10.7377 |
| A74 | 3.9659 | −10.6684 |
| A75 | 3.6655 | −10.6004 |
| A76 | 3.3756 | −10.5338 |
| A77 | 3.0957 | −10.4687 |
| A78 | 2.8251 | −10.405 |
| A79 | 2.5633 | −10.3427 |
| A80 | 2.3097 | −10.282 |
| A81 | 2.0639 | −10.2227 |
| A82 | 1.8254 | −10.165 |
| A83 | 1.5937 | −10.1087 |
| A84 | 1.3685 | −10.0541 |
| A85 | 1.1493 | −10.001 |
| A86 | 0.9358 | −9.9495 |
| A87 | 0.7276 | −9.8996 |
| A88 | 0.5245 | −9.8513 |
| A89 | 0.326 | −9.8046 |
| A90 | 0.1319 | −9.7595 |
| A91 | −0.0581 | −9.7162 |
| A92 | −0.2442 | −9.6745 |
| A93 | −0.4269 | −9.6345 |
| A94 | −0.6062 | −9.5961 |
| A95 | −0.7825 | −9.5595 |
| A96 | −0.9561 | −9.5246 |
| A97 | −1.127 | −9.4914 |
| A98 | −1.2956 | −9.46 |
| A99 | −1.4622 | −9.4303 |
| A100 | −1.6268 | −9.4024 |
| A101 | −1.7897 | −9.3762 |
| A102 | −1.9512 | −9.3518 |
| A103 | −2.1114 | −9.3292 |
| A104 | −2.2705 | −9.3084 |
| A105 | −2.4287 | −9.2894 |
| A106 | −2.5863 | −9.2722 |
| A107 | −2.7433 | −9.2567 |
| A108 | −2.9001 | −9.2431 |
| A109 | −3.0568 | −9.2313 |
| A110 | −3.2135 | −9.2214 |
| A111 | −3.3706 | −9.2132 |
| A112 | −3.528 | −9.2069 |
| A113 | −3.6862 | −9.2024 |
| A114 | −3.8452 | −9.1997 |
| A115 | −4.0052 | −9.1988 |
| A116 | −4.1664 | −9.1998 |
| A117 | −4.329 | −9.2026 |
| A118 | −4.4933 | −9.2072 |
| A119 | −4.6594 | −9.2137 |
| A120 | −4.8275 | −9.2219 |
| A121 | −4.9978 | −9.232 |
| A122 | −5.1706 | −9.244 |
| A123 | −5.346 | −9.2577 |
| A124 | −5.5243 | −9.2732 |
| A125 | −5.7057 | −9.2906 |
| A126 | −5.8904 | −9.3097 |
| A127 | −6.0786 | −9.3306 |
| A128 | −6.2707 | −9.3534 |
| A129 | −6.4668 | −9.3779 |
| A130 | −6.6672 | −9.4041 |
| A131 | −6.8722 | −9.4322 |
| A132 | −7.0821 | −9.462 |
| A133 | −7.2971 | −9.4935 |

TABLE IA-continued

| POINT | CAM PROFILE C-804486-A X | Y |
|---|---|---|
| A134 | −7.5048 | −9.4898 |
| A135 | −7.7058 | −9.4573 |
| A136 | −7.9054 | −9.4144 |
| A137 | −8.109 | −9.3749 |
| A138 | −8.3109 | −9.3251 |
| A139 | −8.5054 | −9.2527 |
| A140 | −8.6933 | −9.1621 |
| A141 | −8.878 | −9.0624 |
| A142 | −9.0626 | −8.9606 |
| A143 | −9.2454 | −8.8534 |
| A144 | −9.4221 | −8.733 |
| A145 | −9.5886 | −8.5942 |
| A146 | −9.7463 | −8.4408 |
| A147 | −9.899 | −8.2804 |
| A148 | −10.0496 | −8.118 |
| A149 | −10.195 | −7.9492 |
| A150 | −10.3297 | −7.7665 |
| A151 | −10.4496 | −7.5658 |
| A152 | −10.5576 | −7.3524 |
| A153 | −10.6594 | −7.1352 |
| A154 | −10.7584 | −6.9186 |
| A155 | −10.8496 | −6.6966 |
| A156 | −10.9255 | −6.461 |
| A157 | −10.9814 | −6.2081 |
| A158 | −11.0217 | −5.9444 |
| A159 | −11.0549 | −5.68 |
| A160 | −11.0837 | −5.4176 |
| A161 | −11.0992 | −5.1487 |
| A162 | −11.0894 | −4.863 |
| A163 | −11.0483 | −4.5569 |
| A164 | −10.9928 | −4.2476 |
| A165 | −10.9411 | −3.9511 |
| A166 | −10.8915 | −3.665 |
| A167 | −10.8417 | −3.3868 |
| A168 | −10.7895 | −3.1146 |
| A169 | −10.7331 | −2.8466 |
| A170 | −10.6723 | −2.5827 |
| A171 | −10.613 | −2.3269 |
| A172 | −10.5553 | −2.0786 |
| A173 | −10.4991 | −1.8373 |
| A174 | −10.4444 | −1.6027 |
| A175 | −10.3913 | −1.3744 |
| A176 | −10.3398 | −1.1519 |
| A177 | −10.2899 | −0.9349 |
| A178 | −10.2416 | −0.7231 |
| A179 | −10.1949 | −0.5161 |
| A180 | −10.1499 | −0.3137 |
| A181 | −10.1065 | −0.1155 |
| A182 | −10.0648 | 0.0788 |
| A183 | −10.0248 | 0.2694 |
| A184 | −9.9865 | 0.4566 |
| A185 | −9.9499 | 0.6407 |
| A186 | −9.9149 | 0.8219 |
| A187 | −9.8818 | 1.0004 |
| A188 | −9.8504 | 1.1765 |
| A189 | −9.8207 | 1.3505 |
| A190 | −9.7927 | 1.5224 |
| A191 | −9.7666 | 1.6926 |
| A192 | −9.7422 | 1.8613 |
| A193 | −9.7196 | 2.0286 |
| A194 | −9.6987 | 2.1948 |
| A195 | −9.6797 | 2.3601 |
| A196 | −9.6625 | 2.5247 |
| A197 | −9.6471 | 2.6887 |
| A198 | −9.6335 | 2.8524 |
| A199 | −9.6217 | 3.016 |
| A200 | −9.6117 | 3.1796 |
| A201 | −9.6036 | 3.3435 |
| A202 | −9.5972 | 3.5078 |
| A203 | −9.5927 | 3.6728 |
| A204 | −9.59 | 3.8386 |
| A205 | −9.5892 | 4.0054 |
| A206 | −9.5901 | 4.1734 |
| A207 | −9.5929 | 4.3429 |

TABLE IA-continued

| POINT | CAM PROFILE C-804486-A X | Y |
|---|---|---|
| A208 | −9.5976 | 4.514 |
| A209 | −9.604 | 4.6869 |
| A210 | −9.6123 | 4.8619 |
| A211 | −9.6224 | 5.0391 |
| A212 | −9.6343 | 5.2187 |
| A213 | −9.648 | 5.4011 |
| A214 | −9.6635 | 5.5863 |
| A215 | −9.6781 | 5.7742 |
| A216 | −9.6986 | 5.9662 |
| A217 | −9.7166 | 6.1609 |
| A218 | −9.7356 | 6.3591 |
| A219 | −9.7532 | 6.5606 |
| A220 | −9.7604 | 6.7629 |
| A221 | −9.7569 | 6.9655 |
| A222 | −9.7429 | 7.1682 |
| A223 | −9.7181 | 7.3702 |
| A224 | −9.6826 | 7.5714 |
| A225 | −9.6363 | 7.771 |
| A226 | −9.5793 | 7.9688 |
| A227 | −9.5114 | 8.1642 |
| A228 | −9.4328 | 8.3567 |
| A229 | −9.3435 | 8.5459 |
| A230 | −9.2435 | 8.7313 |
| A231 | −9.1329 | 8.9124 |
| A232 | −9.0117 | 9.0887 |
| A233 | −8.8801 | 9.2597 |
| A234 | −8.7382 | 9.4249 |
| A235 | −8.586 | 9.5839 |
| A236 | −8.4238 | 9.7361 |
| A237 | −8.2517 | 9.881 |
| A238 | −8.0698 | 10.0182 |
| A239 | −7.8783 | 10.1471 |
| A240 | −7.6774 | 10.2672 |
| A241 | −7.4674 | 10.3781 |
| A242 | −7.2483 | 10.479 |
| A243 | −7.0205 | 10.5697 |
| A244 | −6.7842 | 10.6494 |
| A245 | −6.5396 | 10.7177 |
| A246 | −6.2869 | 10.7739 |
| A247 | −6.0264 | 10.8176 |
| A248 | −5.7584 | 10.848 |
| A249 | −5.4831 | 10.8646 |
| A250 | −5.2007 | 10.8666 |
| A251 | −4.9155 | 10.8574 |
| A252 | −4.6378 | 10.8477 |
| A253 | −4.368 | 10.8382 |
| A254 | −4.1054 | 10.829 |
| A255 | −3.8497 | 10.8202 |
| A256 | −3.6005 | 10.8118 |
| A257 | −3.3574 | 10.804 |
| A258 | −3.12 | 10.7968 |
| A259 | −2.8881 | 10.7903 |
| A260 | −2.6612 | 10.7846 |
| A261 | −2.4391 | 10.7797 |
| A262 | −2.2215 | 10.7757 |
| A263 | −2.0081 | 10.7727 |
| A264 | −1.7985 | 10.7707 |
| A265 | −1.5926 | 10.7699 |
| A266 | −1.3901 | 10.7701 |
| A267 | −1.1907 | 10.7716 |
| A268 | −0.9942 | 10.7743 |
| A269 | −0.8003 | 10.7784 |
| A270 | −0.6088 | 10.7838 |
| A271 | −0.4196 | 10.7906 |
| A272 | −0.2323 | 10.7989 |
| A273 | −0.0468 | 10.8086 |
| A274 | 0.1372 | 10.8199 |
| A275 | 0.3199 | 10.8328 |
| A276 | 0.5014 | 10.8473 |
| A277 | 0.682 | 10.8635 |
| A278 | 0.8619 | 10.8814 |
| A279 | 1.0413 | 10.9011 |
| A280 | 1.2207 | 10.9211 |
| A281 | 1.3993 | 10.9458 |

TABLE IA-continued

| POINT | CAM PROFILE C-804486-A X | Y |
|---|---|---|
| A282 | 1.5783 | 10.9709 |
| A283 | 1.7576 | 10.9979 |
| A284 | 1.9374 | 11.0269 |
| A285 | 2.1179 | 11.0579 |
| A286 | 2.2993 | 11.0908 |
| A287 | 2.4817 | 11.1259 |
| A288 | 2.6655 | 11.163 |
| A289 | 2.8508 | 11.2022 |
| A290 | 3.0378 | 11.2435 |
| A291 | 3.2274 | 11.2765 |
| A292 | 3.4208 | 11.2751 |
| A293 | 3.6163 | 11.2372 |
| A294 | 3.812 | 11.1607 |
| A295 | 4.0062 | 11.0423 |
| A296 | 4.1966 | 10.8762 |
| A297 | 4.3813 | 10.6765 |
| A298 | 4.5608 | 10.4814 |
| A299 | 4.7354 | 10.2917 |
| A300 | 4.9054 | 10.107 |
| A301 | 5.0713 | 9.9272 |
| A302 | 5.2333 | 9.7521 |
| A303 | 5.3917 | 9.5815 |
| A304 | 5.5469 | 9.4152 |
| A305 | 5.699 | 9.253 |
| A306 | 5.8484 | 9.0947 |
| A307 | 5.9954 | 8.9402 |
| A308 | 6.1401 | 8.7893 |
| A309 | 6.2829 | 8.6419 |
| A310 | 6.4238 | 8.4979 |
| A311 | 6.5633 | 8.357 |
| A312 | 6.7014 | 8.2191 |
| A313 | 6.8383 | 8.0842 |
| A314 | 6.9744 | 7.952 |
| A315 | 7.1097 | 7.8225 |
| A316 | 7.2445 | 7.6956 |
| A317 | 7.3789 | 7.571 |
| A318 | 7.5132 | 7.4488 |
| A319 | 7.6475 | 7.3287 |
| A320 | 7.782 | 7.2107 |
| A321 | 7.9168 | 7.0946 |
| A322 | 8.0522 | 6.9803 |
| A323 | 8.1883 | 6.8678 |
| A324 | 8.3252 | 6.7569 |
| A325 | 8.4632 | 6.6475 |
| A326 | 8.6024 | 6.5394 |
| A327 | 8.7429 | 6.4326 |
| A328 | 8.885 | 6.327 |
| A329 | 9.0288 | 6.2224 |
| A330 | 9.1745 | 6.1187 |
| A331 | 9.3222 | 6.0158 |
| A332 | 9.4721 | 5.9136 |
| A333 | 9.6244 | 5.812 |
| A334 | 9.7792 | 5.7108 |
| A335 | 9.9368 | 5.6099 |
| A336 | 10.0972 | 5.5093 |
| A337 | 10.2607 | 5.4086 |
| A338 | 10.4275 | 5.308 |
| A339 | 10.5977 | 5.2071 |
| A340 | 10.7716 | 5.1058 |
| A341 | 10.9492 | 5.0041 |
| A342 | 11.131 | 4.9017 |
| A343 | 11.3169 | 4.7985 |
| A344 | 11.5073 | 4.6944 |
| A345 | 22.6937 | 4.5818 |
| A346 | 11.8669 | 4.4539 |
| A347 | 12.0252 | 4.3104 |
| A348 | 12.177 | 4.1589 |
| A349 | 12.3202 | 3.9984 |
| A350 | 12.4594 | 3.8326 |
| A351 | 12.59 | 3.6588 |
| A352 | 12.7113 | 3.4769 |
| A353 | 12.8269 | 3.2901 |
| A354 | 12.9296 | 3.0941 |
| A355 | 13.0187 | 2.8893 |

TABLE IA-continued

| POINT | CAM PROFILE C-804486-A X | Y |
|---|---|---|
| A356 | 13.1018 | 2.6809 |
| A357 | 13.1768 | 2.4678 |
| A358 | 13.2475 | 2.2526 |
| A359 | 13.3151 | 2.0358 |

TABLE IB

| POINT | CAM PROFILE C-804486-B X | Y |
|---|---|---|
| B357 | 13.1768 | 2.4678 |
| B358 | 13.2475 | 2.2526 |
| B359 | 13.3151 | 2.0358 |
| B360 | 13.368 | 1.8121 |
| B1 | 13.3823 | 1.5718 |
| B2 | 13.3068 | 1.2952 |
| B3 | 13.1514 | 0.9918 |
| B4 | 12.9796 | 0.6904 |
| B5 | 12.8572 | 0.4156 |
| B6 | 12.7543 | 0.154 |
| B7 | 12.6543 | −0.1013 |
| B8 | 12.552 | −0.3522 |
| B9 | 12.4463 | −0.5991 |
| B10 | 12.3423 | −0.8408 |
| B11 | 12.2404 | −1.0773 |
| B12 | 12.1505 | −1.3067 |
| B13 | 12.0655 | −1.5313 |
| B14 | 11.9827 | −1.7522 |
| B15 | 11.9104 | −1.9681 |
| B16 | 11.839 | −2.1812 |
| B17 | 11.7695 | −2.3916 |
| B18 | 11.7038 | −2.5994 |
| B19 | 11.6388 | −2.8051 |
| B20 | 11.5758 | −3.0089 |
| B21 | 11.5167 | −3.2108 |
| B22 | 11.4579 | −3.4113 |
| B23 | 11.4004 | −3.6106 |
| B24 | 11.3461 | −3.8089 |
| B25 | 11.2921 | −4.0063 |
| B26 | 11.2389 | −4.2031 |
| B27 | 11.1908 | −4.3996 |
| B28 | 11.1462 | −4.596 |
| B29 | 11.1105 | −4.7931 |
| B30 | 11.0741 | −4.9906 |
| B31 | 11.0269 | −5.1875 |
| B32 | 10.9775 | −5.3844 |
| B33 | 10.9295 | −5.5819 |
| B34 | 10.8907 | −5.7814 |
| B35 | 10.8586 | −5.9831 |
| B36 | 10.8245 | −6.1857 |
| B37 | 10.7829 | −6.3882 |
| B38 | 10.7308 | −6.5895 |
| B39 | 10.668 | −6.7892 |
| B40 | 10.5953 | −6.9871 |
| B41 | 10.513 | −7.1828 |
| B42 | 10.4218 | −7.3761 |
| B43 | 10.3221 | −7.5669 |
| B44 | 10.2142 | −7.7547 |
| B45 | 10.0985 | −7.9396 |
| B46 | 9.9754 | −8.1211 |
| B47 | 9.8452 | −8.2993 |
| B48 | 9.7081 | −8.4738 |
| B49 | 9.5645 | −8.6444 |
| B50 | 9.4144 | −8.8111 |
| B51 | 9.258 | −8.9735 |
| B52 | 9.0957 | −9.1315 |
| B53 | 8.9274 | −9.2848 |
| B54 | 8.7532 | −9.4332 |
| B55 | 8.5733 | −9.5765 |

TABLE IB-continued

| CAM PROFILE C-804486-B | | |
|---|---|---|
| POINT | X | Y |
| B56 | 8.3878 | −9.7144 |
| B57 | 8.1966 | −9.8465 |
| B58 | 7.9997 | −9.9726 |
| B59 | 7.7972 | −10.0923 |
| B60 | 7.589 | −10.2052 |
| B61 | 7.375 | −10.3108 |
| B61.6 | 7.0246 | −10.4618 |
| B62 | 7.1551 | −10.4087 |

TABLE IC

| CAM PROFILE C-804486-C | | |
|---|---|---|
| POINT | X | Y |
| C357 | 13.1768 | 2.4678 |
| C358 | 13.1768 | 2.2526 |
| C359 | 13.1768 | 2.0358 |
| C360 | 13.1768 | 1.8121 |
| C1 | 13.1768 | 1.5718 |
| C2 | 13.1768 | 1.2885 |
| C3 | 13.1768 | 1.0142 |
| C4 | 13.1768 | 0.7463 |
| C5 | 13.1768 | 0.4842 |
| C6 | 12.9846 | 0.2277 |
| C7 | 12.9102 | −0.0237 |
| C8 | 12.8382 | −0.2702 |
| C9 | 12.7683 | −0.5123 |
| C10 | 12.7006 | −0.7502 |
| C11 | 12.6351 | −0.9843 |
| C12 | 12.5718 | −1.2148 |
| C13 | 12.5105 | −1.4421 |
| C14 | 12.4513 | −1.6664 |
| C15 | 12.3942 | −1.8881 |
| C16 | 12.3392 | −2.1073 |
| C17 | 12.2861 | −2.3243 |
| C18 | 12.2351 | −2.5394 |
| C19 | 12.1861 | −2.7529 |
| C20 | 12.139 | −2.9649 |
| C21 | 12.0939 | −3.1757 |
| C22 | 12.0507 | −3.3856 |
| C23 | 12.0094 | −3.5947 |
| C24 | 11.97 | −3.8033 |
| C25 | 11.9324 | −4.0117 |
| C26 | 11.8966 | −4.22 |
| C27 | 11.8627 | −4.4284 |
| C28 | 11.8306 | −4.6373 |
| C29 | 11.8002 | −4.8468 |
| C30 | 11.7716 | −5.0571 |
| C31 | 11.7446 | −5.2685 |
| C32 | 11.7194 | −5.4811 |
| C33 | 11.6959 | −5.6953 |
| C34 | 11.6739 | −5.9112 |
| C35 | 11.6536 | −6.129 |
| C36 | 11.6349 | −6.349 |
| C37 | 11.5981 | −6.5673 |
| C38 | 11.4217 | −6.7548 |
| C39 | 11.2337 | −6.936 |
| C40 | 11.0497 | −7.1145 |
| C41 | 10.8696 | −7.2907 |
| C42 | 10.6933 | −7.4647 |
| C43 | 10.5258 | −7.6331 |
| C44 | 10.3512 | −7.8074 |
| C45 | 10.185 | −7.9766 |
| C46 | 10.0219 | −8.1445 |
| C47 | 9.8618 | −8.3115 |
| C48 | 9.7044 | −8.4777 |
| C49 | 9.5645 | −8.6444 |
| C50 | 9.4144 | −8.8111 |
| C51 | 9.258 | −8.9735 |

TABLE IC-continued

| CAM PROFILE C-804486-C | | |
|---|---|---|
| POINT | X | Y |
| C52 | 9.0957 | −9.1315 |
| C53 | 8.9274 | −9.4332 |
| C54 | 8.7532 | −9.2848 |
| C55 | 8.5733 | −9.5765 |
| C56 | 8.3878 | −9.7144 |
| C57 | 8.1966 | −9.8465 |
| C58 | 7.9997 | −9.9726 |
| C59 | 7.7972 | −10.0923 |
| C60 | 7.589 | −10.2052 |
| C61 | 7.375 | −10.3108 |
| C61.6 | 7.0246 | −10.4618 |
| C62 | 7.1551 | −10.4087 |

TABLE IIA

| MANDREL PATH | | |
|---|---|---|
| LABEL | X | Y |
| A1 | 18.865 | 4.0076 |
| A2 | 18.8307 | 3.6349 |
| A3 | 18.7152 | 3.2347 |
| A4 | 18.5819 | 2.8359 |
| A5 | 18.4966 | 2.4646 |
| A6 | 18.4282 | 2.1027 |
| A7 | 18.3614 | 1.7482 |
| A8 | 18.2905 | 1.3974 |
| A9 | 18.2148 | 1.0514 |
| A10 | 18.1387 | 0.7089 |
| A11 | 18.0627 | 0.3696 |
| A12 | 17.9975 | 0.0397 |
| A13 | 17.9348 | −0.2885 |
| A14 | 17.8729 | −0.6119 |
| A15 | 17.8196 | −0.9308 |
| A16 | 17.7654 | −1.2472 |
| A17 | 17.7114 | −1.5612 |
| A18 | 17.6593 | −1.8728 |
| A19 | 17.6063 | −2.1813 |
| A20 | 17.5533 | −2.4893 |
| A21 | 17.5021 | −2.7968 |
| A22 | 17.4498 | −3.1007 |
| A23 | 17.3967 | −3.4059 |
| A24 | 17.3453 | −3.7075 |
| A25 | 17.2921 | −4.0097 |
| A26 | 17.238 | −4.3112 |
| A27 | 17.1871 | −4.6124 |
| A28 | 17.1378 | −4.9134 |
| A29 | 17.0954 | −5.2162 |
| A30 | 17.0507 | −5.5181 |
| A31 | 16.9937 | −5.818 |
| A32 | 16.9324 | −6.119 |
| A33 | 16.8706 | −6.4203 |
| A34 | 16.8163 | −6.7233 |
| A35 | 16.7669 | −7.0283 |
| A36 | 16.7137 | −7.3338 |
| A37 | 16.6511 | −7.6389 |
| A38 | 16.5762 | −7.9425 |
| A39 | 16.489 | −8.244 |
| A40 | 16.3899 | −8.5433 |
| A41 | 16.2792 | −8.8411 |
| A42 | 16.1581 | −9.1348 |
| A43 | 16.0274 | −9.4242 |
| A44 | 15.8856 | −9.7125 |
| A45 | 15.7349 | −9.996 |
| A46 | 15.5757 | −10.2745 |
| A47 | 15.4063 | −10.5511 |
| A48 | 15.2299 | −10.8213 |
| A49 | 15.0436 | −11.089 |
| A50 | 14.85 | −11.3509 |
| A51 | 14.6493 | −11.6068 |
| A52 | 14.4393 | −11.8594 |

TABLE IIA-continued

| MANDREL PATH | | |
|---|---|---|
| LABEL | X | Y |
| A53 | 14.2225 | −12.1056 |
| A54 | 13.9993 | −12.345 |
| A55 | 13.7668 | −12.5804 |
| A56 | 13.528 | −12.8084 |
| A57 | 13.282 | −13.0298 |
| A58 | 13.0288 | −13.2441 |
| A59 | 12.7695 | −13.4503 |
| A60 | 12.502 | −13.6494 |
| A61 | 12.2259 | −13.841 |
| A62 | 11.9437 | −14.023 |
| A63 | 11.6552 | −14.1949 |
| A64 | 11.358 | −14.3574 |
| A65 | 11.0529 | −14.5092 |
| A66 | 10.7398 | −14.6492 |
| A67 | 10.4185 | −14.7767 |
| A68 | 10.0884 | −14.8904 |
| A69 | 9.7494 | −14.9891 |
| A70 | 9.3992 | −15.0715 |
| A71 | 9.0418 | −15.1351 |
| A72 | 8.6703 | −15.1786 |
| A73 | 8.2898 | −15.1988 |
| A74 | 7.8997 | −15.1988 |
| A75 | 7.5196 | −15.1988 |
| A76 | 7.1475 | −15.1988 |
| A77 | 6.7856 | −15.1988 |
| A78 | 6.4319 | −15.1988 |
| A79 | 6.0859 | −15.1988 |
| A80 | 5.7471 | −15.1988 |
| A81 | 5.4149 | −15.1988 |
| A82 | 5.0891 | −15.1988 |
| A83 | 4.7691 | −15.1988 |
| A84 | 4.4545 | −15.1988 |
| A85 | 4.1451 | −15.1988 |
| A86 | 3.8405 | −15.1988 |
| A87 | 3.5403 | −15.1988 |
| A88 | 3.2442 | −15.1988 |
| A89 | 2.952 | −15.1988 |
| A90 | 2.6634 | −15.1988 |
| A91 | 2.3781 | −15.1988 |
| A92 | 2.0959 | −15.1988 |
| A93 | 1.8165 | −15.1988 |
| A94 | 1.5397 | −15.1988 |
| A95 | 1.2653 | −15.1988 |
| A96 | 0.9931 | −15.1988 |
| A97 | 0.7228 | −15.1988 |
| A98 | 0.4543 | −15.1988 |
| A99 | 0.1874 | −15.1988 |
| A100 | −0.0782 | −15.1988 |
| A101 | −0.3425 | −15.1988 |
| A102 | −0.6058 | −15.1988 |
| A103 | −0.8682 | −15.1988 |
| A104 | −1.13 | −15.1988 |
| A105 | −1.3912 | −15.1988 |
| A106 | −1.652 | −15.1988 |
| A107 | −1.9127 | −15.1988 |
| A108 | −2.1733 | −15.1988 |
| A109 | −2.434 | −15.1988 |
| A110 | −2.695 | −15.1988 |
| A111 | −2.9564 | −15.1988 |
| A112 | −3.2185 | −15.1988 |
| A113 | −3.4812 | −15.1988 |
| A114 | −3.7449 | −15.1988 |
| A115 | −4.0096 | −15.1988 |
| A116 | −4.2756 | −15.1988 |
| A117 | −4.5429 | −15.1988 |
| A118 | −4.8118 | −15.1988 |
| A119 | −5.0824 | −15.1988 |
| A120 | −5.3549 | −15.1988 |
| A121 | −5.6295 | −15.1988 |
| A122 | −5.9063 | −15.1988 |
| A123 | −6.1855 | −15.1988 |
| A124 | −6.4674 | −15.1988 |
| A125 | −6.752 | −15.1988 |
| A126 | −7.0397 | −15.1988 |
| A127 | −7.3306 | −15.1988 |

TABLE IIA-continued

| MANDREL PATH | | |
|---|---|---|
| LABEL | X | Y |
| A128 | −7.6249 | −15.1988 |
| A129 | −7.9228 | −15.1988 |
| A130 | −8.2246 | −15.1988 |
| A131 | −8.5305 | −15.1988 |
| A132 | −8.8396 | −15.1988 |
| A133 | −9.1557 | −15.1987 |
| A134 | −9.4618 | −15.1592 |
| A135 | −9.7613 | −15.0913 |
| A136 | −10.0598 | −15.0139 |
| A137 | −10.3606 | −14.9357 |
| A138 | −10.6587 | −14.8443 |
| A139 | −10.9493 | −14.7304 |
| A140 | −11.2328 | −14.5971 |
| A141 | −11.5122 | −14.4529 |
| A142 | −11.7905 | −14.3042 |
| A143 | −12.066 | −14.1482 |
| A144 | −12.3345 | −13.9776 |
| A145 | −12.5922 | −13.7873 |
| A146 | −12.8403 | −13.581 |
| A147 | −13.0844 | −13.3642 |
| A148 | −13.3211 | −13.1472 |
| A149 | −13.5536 | −12.9202 |
| A150 | −13.7743 | −12.6778 |
| A151 | −13.961 | −12.4424 |
| A152 | −14.1717 | −12.1408 |
| A153 | −14.3294 | −11.9021 |
| A154 | −14.537 | −11.5774 |
| A155 | −14.7083 | −11.2879 |
| A156 | −14.8633 | −10.9838 |
| A157 | −14.9979 | −10.662 |
| A158 | −15.1161 | −10.3283 |
| A159 | −15.2253 | −9.9919 |
| A160 | −15.3276 | −9.655 |
| A161 | −15.415 | −9.31 |
| A162 | −15.4763 | −8.9475 |
| A163 | −15.5078 | −8.566 |
| A164 | −15.5245 | −8.1809 |
| A165 | −15.5408 | −7.8047 |
| A166 | −15.5567 | −7.4369 |
| A167 | −15.5701 | −7.0753 |
| A168 | −15.5797 | −6.7186 |
| A169 | −15.5891 | −6.3706 |
| A170 | −15.5891 | −6.0214 |
| A171 | −15.5891 | −5.6792 |
| A172 | −15.5891 | −5.3436 |
| A173 | −15.5891 | −5.014 |
| A174 | −15.5891 | −4.69 |
| A175 | −15.5891 | −4.3714 |
| A176 | −15.5892 | −4.0578 |
| A177 | −15.5892 | −3.7475 |
| A178 | −15.5891 | −3.444 |
| A179 | −15.5892 | −3.1433 |
| A180 | −15.5892 | −2.8463 |
| A181 | −15.5891 | −2.5528 |
| A182 | −15.5892 | −2.2613 |
| A183 | −15.5892 | −1.9751 |
| A184 | −15.5892 | −1.6904 |
| A185 | −15.5892 | −1.4083 |
| A186 | −15.5891 | −1.1283 |
| A187 | −15.5892 | −0.8505 |
| A188 | −15.5892 | −0.5745 |
| A189 | −15.5892 | −0.3001 |
| A190 | −15.5892 | −0.0273 |
| A191 | −15.5891 | 0.2444 |
| A192 | −15.5891 | 0.5149 |
| A193 | −15.5891 | 0.7855 |
| A194 | −15.5891 | 1.0533 |
| A195 | −15.5891 | 1.3215 |
| A196 | −15.5892 | 1.5905 |
| A197 | −15.5892 | 1.857 |
| A198 | −15.5892 | 2.1245 |
| A199 | −15.5892 | 2.3932 |
| A200 | −15.5892 | 2.6611 |
| A201 | −15.5892 | 2.9283 |
| A202 | −15.5892 | 3.1971 |

TABLE IIA-continued

| MANDREL PATH | | |
|---|---|---|
| LABEL | X | Y |
| A203 | −15.5892 | 3.4667 |
| A204 | −15.5892 | 3.7383 |
| A205 | −15.5892 | 4.0087 |
| A206 | −15.5892 | 4.2815 |
| A207 | −15.5892 | 4.5568 |
| A208 | −15.5892 | 4.8325 |
| A209 | −15.5892 | 5.1088 |
| A210 | −15.5892 | 5.3893 |
| A211 | −15.5892 | 5.6708 |
| A212 | −15.5892 | 5.9545 |
| A213 | −15.5892 | 6.2406 |
| A214 | −15.5891 | 6.5294 |
| A215 | −15.5892 | 6.8199 |
| A216 | −15.5865 | 7.1153 |
| A217 | −15.5838 | 7.4127 |
| A218 | −15.5811 | 7.7134 |
| A219 | −15.5741 | 8.0166 |
| A220 | −15.5549 | 8.3203 |
| A221 | −15.5234 | 8.6238 |
| A222 | −15.4795 | 8.9268 |
| A223 | −15.4232 | 9.2288 |
| A224 | −15.3543 | 9.5292 |
| A225 | −15.273 | 9.8275 |
| A226 | −15.1791 | 10.1234 |
| A227 | −15.0728 | 10.4161 |
| A228 | −14.954 | 10.7054 |
| A229 | −14.8228 | 10.9906 |
| A230 | −14.6793 | 11.2712 |
| A231 | −14.5235 | 11.5467 |
| A232 | −14.3555 | 11.8167 |
| A233 | −14.1755 | 12.0805 |
| A234 | −13.9835 | 12.3377 |
| A235 | −13.7796 | 12.5878 |
| A236 | −13.5642 | 12.8302 |
| A237 | −13.3372 | 13.0643 |
| A238 | −13.099 | 13.2898 |
| A239 | −12.8496 | 13.5059 |
| A240 | −12.5893 | 13.7123 |
| A241 | −12.3184 | 13.9083 |
| A242 | −12.037 | 14.0934 |
| A243 | −11.7453 | 14.267 |
| A244 | −11.4437 | 14.4286 |
| A245 | −11.1324 | 14.5776 |
| A246 | −10.8116 | 14.7134 |
| A247 | −10.4817 | 14.8353 |
| A248 | −10.1428 | 14.9429 |
| A249 | −9.7953 | 15.0353 |
| A250 | −9.4395 | 15.1119 |
| A251 | −9.0795 | 15.176 |
| A252 | −8.7259 | 15.2384 |
| A253 | −8.3788 | 15.2996 |
| A254 | −8.0378 | 15.3597 |
| A255 | −7.7025 | 15.4188 |
| A256 | −7.3725 | 15.477 |
| A257 | −7.0474 | 15.5343 |
| A258 | −6.7269 | 15.5908 |
| A259 | −6.4108 | 15.6466 |
| A260 | −6.0987 | 15.7016 |
| A261 | −5.7903 | 15.756 |
| A262 | −5.4853 | 15.8098 |
| A263 | −5.1835 | 15.863 |
| A264 | −4.8847 | 15.9157 |
| A265 | −4.5885 | 15.9679 |
| A266 | −4.2948 | 16.0197 |
| A267 | −4.0034 | 16.0711 |
| A268 | −3.7139 | 16.1221 |
| A269 | −3.4263 | 16.1728 |
| A270 | −3.1403 | 16.2233 |
| A271 | −2.8558 | 16.2734 |
| A272 | −2.5724 | 16.3234 |
| A273 | −2.2901 | 16.3732 |
| A274 | −2.0087 | 16.4228 |
| A275 | −1.7279 | 16.4723 |
| A276 | −1.4476 | 16.5217 |
| A277 | −1.1677 | 16.5711 |

TABLE IIA-continued

| MANDREL PATH | | |
|---|---|---|
| LABEL | X | Y |
| A278 | −0.8879 | 16.6204 |
| A279 | −0.6081 | 16.6698 |
| A280 | −0.3281 | 16.7191 |
| A281 | −0.0478 | 16.7686 |
| A282 | 0.2331 | 16.8181 |
| A283 | 0.5146 | 16.8677 |
| A284 | 0.797 | 16.9175 |
| A285 | 1.0805 | 16.9675 |
| A286 | 1.3651 | 17.0177 |
| A287 | 1.6512 | 17.0681 |
| A288 | 1.9388 | 17.1188 |
| A289 | 2.2281 | 17.1699 |
| A290 | 2.5194 | 17.2212 |
| A291 | 2.8135 | 17.2622 |
| A292 | 3.1114 | 17.267 |
| A293 | 3.4115 | 17.2334 |
| A294 | 3.7119 | 17.1595 |
| A295 | 4.0108 | 17.0417 |
| A296 | 4.3059 | 16.8744 |
| A297 | 4.5953 | 16.6719 |
| A298 | 4.8793 | 16.4722 |
| A299 | 5.1584 | 16.276 |
| A300 | 5.4328 | 16.0831 |
| A301 | 5.7029 | 15.8932 |
| A302 | 5.9689 | 15.7063 |
| A303 | 6.2311 | 15.5219 |
| A304 | 6.4898 | 15.3401 |
| A305 | 6.7452 | 15.1605 |
| A306 | 6.9976 | 14.9831 |
| A307 | 7.2472 | 14.8077 |
| A308 | 7.4941 | 14.6341 |
| A309 | 7.7386 | 14.4622 |
| A310 | 7.981 | 14.2918 |
| A311 | 8.2213 | 14.1229 |
| A312 | 8.4598 | 13.9553 |
| A313 | 8.6966 | 13.7888 |
| A314 | 8.9319 | 13.6234 |
| A315 | 9.1659 | 13.4588 |
| A316 | 9.3988 | 13.2952 |
| A317 | 9.6306 | 13.1322 |
| A318 | 9.8616 | 12.9698 |
| A319 | 10.0919 | 12.8079 |
| A320 | 10.3217 | 12.6464 |
| A321 | 10.551 | 12.4852 |
| A322 | 10.7801 | 12.3242 |
| A323 | 11.009 | 12.1633 |
| A324 | 11.2379 | 12.0023 |
| A325 | 11.467 | 11.8413 |
| A326 | 11.6964 | 11.68 |
| A327 | 11.9262 | 11.5185 |
| A328 | 12.1566 | 11.3565 |
| A329 | 12.3877 | 11.1941 |
| A330 | 12.6197 | 11.031 |
| A331 | 12.8526 | 10.8673 |
| A332 | 13.0866 | 10.7027 |
| A333 | 13.322 | 10.5373 |
| A334 | 13.5587 | 10.3709 |
| A335 | 13.797 | 10.2034 |
| A336 | 14.0371 | 10.0346 |
| A337 | 14.279 | 9.8646 |
| A338 | 14.5229 | 9.6931 |
| A339 | 14.7691 | 9.52 |
| A340 | 15.0176 | 9.3453 |
| A341 | 15.2687 | 9.1689 |
| A342 | 15.5224 | 8.9905 |
| A343 | 15.7791 | 8.81 |
| A344 | 16.0378 | 8.6282 |
| A345 | 16.2931 | 8.4351 |
| A346 | 16.5328 | 8.2263 |
| A347 | 16.7553 | 8.0017 |
| A348 | 16.9698 | 7.7663 |
| A349 | 17.1763 | 7.5223 |
| A350 | 17.3763 | 7.2713 |
| A351 | 17.5661 | 7.0111 |
| A352 | 17.7451 | 6.742 |

TABLE IIA-continued

| MANDREL PATH | | |
|---|---|---|
| LABEL | X | Y |
| A353 | 17.9176 | 6.4656 |
| A354 | 18.0743 | 6.1814 |
| A355 | 18.2165 | 5.8864 |
| A356 | 18.3512 | 5.5868 |
| A357 | 18.4761 | 5.2817 |
| A358 | 18.5951 | 4.9735 |
| A359 | 18.7093 | 4.663 |
| A360 | 18.8076 | 4.3434 |

TABLE IIB

| MANDREL PATH | | |
|---|---|---|
| LABEL | X | Y |
| A1 | 18.865 | 4.0091 |
| A2 | 18.8276 | 3.6335 |
| A3 | 18.7841 | 3.2623 |
| A4 | 18.7561 | 2.9095 |
| A5 | 18.7023 | 2.5394 |
| A6 | 18.6606 | 2.184 |
| A7 | 18.6194 | 1.8332 |
| A8 | 18.5787 | 1.4866 |
| A9 | 18.5385 | 1.144 |
| A10 | 18.4987 | 0.8051 |
| A11 | 18.4593 | 0.4695 |
| A12 | 18.4202 | 0.1371 |
| A13 | 18.3815 | −0.1925 |
| A14 | 18.3431 | −0.5196 |
| A15 | 18.305 | −0.8442 |
| A16 | 18.2671 | −1.1668 |
| A17 | 18.2295 | −1.4874 |
| A18 | 18.192 | −1.8064 |
| A19 | 18.1547 | −2.124 |
| A20 | 18.1176 | −2.4402 |
| A21 | 18.0806 | −2.7555 |
| A22 | 18.0437 | −3.0699 |
| A23 | 18.0068 | −3.3837 |
| A24 | 17.97 | −3.697 |
| A25 | 17.9333 | −4.0101 |
| A26 | 17.8965 | −4.3231 |
| A27 | 17.8591 | −4.6378 |
| A28 | 17.8229 | −4.9497 |
| A29 | 17.7856 | −5.2652 |
| A30 | 17.7487 | −5.5799 |
| A31 | 17.712 | −5.8939 |
| A32 | 17.6749 | −6.2106 |
| A33 | 17.6375 | −6.5285 |
| A34 | 17.6 | −6.8479 |
| A35 | 17.5623 | −7.169 |
| A36 | 17.5244 | −7.4919 |
| A37 | 17.4689 | −7.8132 |
| A38 | 17.2717 | −8.1034 |
| A39 | 17.0591 | −8.3865 |
| A40 | 16.8487 | −8.6665 |
| A41 | 16.6406 | −8.9436 |
| A42 | 16.4343 | −9.218 |
| A43 | 16.2311 | −9.4904 |
| A44 | 16.0244 | −9.7606 |
| A45 | 15.826 | −10.0278 |
| A46 | 15.6261 | −10.2939 |
| A47 | 15.4274 | −10.5583 |
| A48 | 15.2298 | −10.8212 |
| A49 | 15.0444 | −11.0879 |
| A50 | 14.8508 | −11.3498 |
| A51 | 14.6493 | −11.6068 |
| A52 | 14.4402 | −11.8584 |
| A53 | 14.2235 | −12.1046 |
| A54 | 13.9993 | −12.345 |
| A55 | 13.7678 | −12.5974 |
| A56 | 13.529 | −12.8075 |
| A57 | 13.2831 | −13.0289 |

TABLE IIB-continued

| MANDREL PATH | | |
|---|---|---|
| LABEL | X | Y |
| A58 | 13.0299 | −13.2433 |
| A59 | 12.7695 | −13.4503 |
| A60 | 12.502 | −13.6494 |
| A61 | 12.2271 | −13.8403 |
| A62 | 11.9449 | −14.0223 |
| A357 | 18.4761 | 5.2817 |
| A358 | 18.5951 | 4.9735 |
| A359 | 18.7093 | 4.663 |
| A360 | 18.8073 | 4.3448 |

TABLE IIIA

| CAM PROFILE C-804490-A | | |
|---|---|---|
| POINT | X | Y |
| A61 | 7.375 | −10.3108 |
| A61.6 | 7.0246 | −10.4618 |
| A62 | 7.1551 | −10.4087 |
| A63 | 6.9292 | −10.4983 |
| A64 | 6.6972 | −10.5789 |
| A65 | 6.4588 | −10.6499 |
| A66 | 6.2138 | −10.7103 |
| A67 | 5.9618 | −10.7594 |
| A68 | 5.7026 | −10.7959 |
| A69 | 5.4357 | −10.8187 |
| A70 | 6.1604 | −10.8262 |
| A71 | 4.8763 | −10.8168 |
| A72 | 4.5823 | −10.7881 |
| A73 | 4.2776 | −10.7377 |
| A74 | 3.9659 | −10.6684 |
| A75 | 3.6655 | −10.6004 |
| A76 | 3.3756 | −10.5338 |
| A77 | 3.0957 | −10.4687 |
| A78 | 2.8251 | −10.405 |
| A79 | 2.5633 | −10.3427 |
| A80 | 2.3097 | −10.282 |
| A81 | 2.0639 | −10.2227 |
| A82 | 1.8254 | −10.165 |
| A83 | 1.5937 | −10.1087 |
| A84 | 1.3685 | −10.0541 |
| A85 | 1.1493 | −10.001 |
| A86 | 0.9358 | −9.9495 |
| A87 | 0.7276 | −9.8996 |
| A88 | 0.5245 | −9.8513 |
| A89 | 0.326 | −9.8046 |
| A90 | 0.1319 | −9.7595 |
| A91 | −0.062 | −9.7073 |
| A92 | −0.2314 | −9.7048 |
| A93 | −0.4007 | −9.6993 |
| A94 | −0.5699 | −9.6908 |
| A95 | −0.739 | −9.6794 |
| A96 | −0.9078 | −9.665 |
| A97 | −1.0763 | −9.6477 |
| A98 | −1.2446 | −9.6274 |
| A99 | −1.4124 | −9.6042 |
| A100 | −1.5798 | −9.5781 |
| A101 | −1.7467 | −9.5491 |
| A102 | −1.9131 | −9.5172 |
| A103 | −2.0789 | −9.4823 |
| A104 | −2.2441 | −9.4446 |
| A105 | −2.4086 | −9.404 |
| A106 | −2.5723 | −9.3605 |
| A107 | −2.7353 | −9.3142 |
| A108 | −2.8974 | −9.265 |
| A109 | −3.0587 | −9.2131 |
| A110 | −3.219 | −9.1583 |
| A111 | −3.3784 | −9.1007 |
| A112 | −3.5367 | −9.0404 |
| A113 | −3.6939 | −8.9773 |
| A114 | −3.85 | −8.9114 |

TABLE IIIA-continued

| POINT | CAM PROFILE C-804490-A X | Y |
|---|---|---|
| A115 | −4.005 | −8.8429 |
| A116 | −4.1587 | −8.7716 |
| A117 | −4.3111 | −8.6977 |
| A118 | −4.4623 | −8.6212 |
| A119 | −4.6121 | −8.542 |
| A120 | −4.7604 | −8.4602 |
| A121 | −4.9074 | −8.3758 |
| A122 | −5.0528 | −8.2889 |
| A123 | −5.1967 | −8.1994 |
| A124 | −5.339 | −8.1075 |
| A125 | −5.4797 | −8.0131 |
| A126 | −5.6187 | −7.9162 |
| A127 | −5.756 | −7.817 |
| A128 | −5.8915 | −7.7153 |
| A129 | −6.0253 | −7.6113 |
| A130 | −6.1572 | −7.505 |
| A131 | −6.2872 | −7.3964 |
| A132 | −6.4154 | −7.2855 |
| A133 | −6.5415 | −7.1725 |
| A134 | −6.6657 | −7.0572 |
| A135 | −6.7879 | −6.9398 |
| A136 | −6.908 | −6.8203 |
| A137 | −7.0259 | −6.6987 |
| A138 | −7.1418 | −6.575 |
| A139 | −7.2554 | −6.4494 |
| A140 | −7.3669 | −6.3218 |
| A141 | −7.4761 | −6.1923 |
| A142 | −7.583 | −6.0608 |
| A143 | −7.6876 | −5.9276 |
| A144 | −7.7899 | −5.7925 |
| A145 | −7.8898 | −5.6557 |
| A146 | −7.9873 | −5.5171 |
| A147 | −8.0824 | −5.3769 |
| A148 | −8.175 | −5.235 |
| A149 | −8.2651 | −5.0915 |
| A150 | −8.3527 | −4.9465 |
| A151 | −8.4378 | −4.8 |
| A152 | −8.5203 | −4.652 |
| A153 | −8.6002 | −4.5026 |
| A154 | −8.6774 | −4.3518 |
| A155 | −8.7521 | −4.1997 |
| A156 | −8.824 | −4.0463 |
| A157 | −8.8933 | −3.8917 |
| A158 | −8.9599 | −3.7359 |
| A159 | −9.0237 | −3.579 |
| A160 | −9.0848 | −3.4209 |
| A161 | −9.1431 | −3.2619 |
| A162 | −9.1986 | −3.1018 |
| A163 | −9.2514 | −2.9408 |
| A164 | −9.3013 | −2.7789 |
| A165 | −9.3484 | −2.6161 |
| A166 | −9.3926 | −2.4526 |
| A167 | −9.434 | −2.2883 |
| A168 | −9.4725 | −2.1233 |
| A169 | −9.5081 | −1.9576 |
| A170 | −9.5408 | −1.7914 |
| A171 | −9.5518 | −1.6119 |
| A172 | −9.5761 | −1.4435 |
| A173 | −9.6215 | −1.2896 |
| A174 | −9.6425 | −1.1215 |
| A175 | −9.6606 | −0.953 |
| A176 | −9.6758 | −0.7843 |
| A177 | −9.688 | −0.6153 |
| A178 | −9.6973 | −0.4461 |
| A179 | −9.7036 | −0.2768 |
| A180 | −9.7072 | −0.1075 |
| A181 | −9.7101 | 0.0607 |
| A182 | −9.7131 | 0.2279 |
| A183 | −9.7161 | 0.394 |
| A184 | −9.719 | 0.5591 |
| A185 | −9.7219 | 0.7235 |
| A186 | −9.7248 | 0.8872 |
| A187 | −9.7277 | 1.0504 |
| A188 | −9.7306 | 1.2131 |

TABLE IIIA-continued

| POINT | CAM PROFILE C-804490-A X | Y |
|---|---|---|
| A189 | −9.7335 | 1.3754 |
| A190 | −9.7364 | 1.5375 |
| A191 | −9.7393 | 1.6994 |
| A192 | −9.7422 | 1.8613 |
| A193 | −9.7196 | 2.0286 |
| A194 | −9.6987 | 2.1948 |
| A195 | −9.6797 | 2.3601 |
| A196 | −9.6625 | 2.5247 |
| A197 | −9.6471 | 2.6887 |
| A198 | −9.6335 | 2.8524 |
| A199 | −9.6217 | 3.016 |
| A200 | −9.6117 | 3.1796 |
| A201 | −9.6036 | 3.3435 |
| A202 | −9.5972 | 3.5078 |
| A203 | −9.5927 | 3.6728 |
| A204 | −9.59 | 3.8386 |
| A205 | −9.5892 | 4.0054 |
| A206 | −9.5901 | 4.1734 |
| A207 | −9.5929 | 4.3429 |
| A208 | −9.5976 | 4.514 |
| A209 | −9.604 | 4.6869 |
| A210 | −9.6123 | 4.8619 |
| A211 | −9.6224 | 5.0391 |
| A212 | −9.6343 | 5.2187 |
| A213 | −9.648 | 5.4011 |
| A214 | −9.6635 | 5.5863 |
| A215 | −9.6781 | 5.7742 |
| A216 | −9.6986 | 5.9662 |
| A217 | −9.7166 | 6.1609 |
| A218 | −9.7356 | 6.3591 |
| A219 | −9.7532 | 6.5606 |
| A220 | −9.7604 | 6.7629 |
| A221 | −9.7569 | 6.9655 |
| A222 | −9.7429 | 7.1682 |
| A223 | −9.7181 | 7.3702 |
| A224 | −9.6826 | 7.5714 |
| A225 | −9.6363 | 7.771 |
| A226 | −9.5793 | 7.9688 |
| A227 | −9.5114 | 8.1642 |
| A228 | −9.4328 | 8.3567 |
| A229 | −9.3435 | 8.5459 |
| A230 | −9.2435 | 8.7313 |
| A231 | −9.1329 | 8.9124 |
| A232 | −9.0117 | 9.0887 |
| A233 | −8.8801 | 9.2597 |
| A234 | −8.7382 | 9.4249 |
| A235 | −8.586 | 9.5839 |
| A236 | −8.4238 | 9.7361 |
| A237 | −8.2517 | 9.881 |
| A238 | −8.0698 | 10.0182 |
| A239 | −7.8783 | 10.1471 |
| A240 | −7.6774 | 10.2672 |
| A241 | −7.4674 | 10.3781 |
| A242 | −7.2483 | 10.479 |
| A243 | −7.0205 | 10.5697 |
| A244 | −6.7842 | 10.6494 |
| A245 | −6.5396 | 10.7177 |
| A246 | −6.2869 | 10.7739 |
| A247 | −6.0264 | 10.8176 |
| A248 | −5.7584 | 10.848 |
| A249 | −5.4831 | 10.8646 |
| A250 | −5.2007 | 10.8666 |
| A251 | −4.9155 | 10.8574 |
| A252 | −4.6378 | 10.8477 |
| A253 | −4.368 | 10.8382 |
| A254 | −4.1054 | 10.829 |
| A255 | −3.8497 | 10.8202 |
| A256 | −3.6005 | 10.8118 |
| A257 | −3.3574 | 10.804 |
| A258 | −3.12 | 10.7968 |
| A259 | −2.8881 | 10.7903 |
| A260 | −2.6612 | 10.7846 |
| A261 | −2.4391 | 10.7797 |
| A262 | −2.2215 | 10.7757 |

TABLE IIIA-continued

| POINT | CAM PROFILE C-804490-A X | Y |
|---|---|---|
| A263 | −2.0081 | 10.7727 |
| A264 | −1.7985 | 10.7707 |
| A265 | −1.5926 | 10.7699 |
| A266 | −1.3901 | 10.7701 |
| A267 | −1.1907 | 10.7716 |
| A268 | −0.9942 | 10.7743 |
| A269 | −0.8003 | 10.7784 |
| A270 | −0.6088 | 10.7838 |
| A271 | −0.4196 | 10.7906 |
| A272 | −0.2323 | 10.7989 |
| A273 | −0.0468 | 10.8086 |
| A274 | 0.1372 | 10.8199 |
| A275 | 0.3199 | 10.8328 |
| A276 | 0.5014 | 10.8473 |
| A277 | 0.682 | 10.8635 |
| A278 | 0.8619 | 10.8814 |
| A279 | 1.0413 | 10.9011 |
| A280 | 1.2207 | 10.9211 |
| A281 | 1.3993 | 10.9458 |
| A282 | 1.5783 | 10.9709 |
| A283 | 1.7576 | 10.9979 |
| A284 | 1.9374 | 11.0269 |
| A285 | 2.1179 | 11.0579 |
| A286 | 2.2993 | 11.0908 |
| A287 | 2.4817 | 11.1259 |
| A288 | 2.6655 | 11.163 |
| A289 | 2.8508 | 11.2022 |
| A290 | 3.0378 | 11.2435 |
| A291 | 3.2274 | 11.2765 |
| A292 | 3.4208 | 11.2751 |
| A293 | 3.6163 | 11.2372 |
| A294 | 3.812 | 11.1607 |
| A295 | 4.0062 | 11.0423 |
| A296 | 4.1966 | 10.8762 |
| A297 | 4.3813 | 10.6765 |
| A298 | 4.5608 | 10.4814 |
| A299 | 4.7354 | 10.2917 |
| A300 | 4.9054 | 10.107 |
| A301 | 5.0713 | 9.9272 |
| A302 | 5.2333 | 9.7521 |
| A303 | 5.3917 | 9.5815 |
| A304 | 5.5469 | 9.4152 |
| A305 | 5.699 | 9.253 |
| A306 | 5.8484 | 9.0947 |
| A307 | 5.9954 | 8.9402 |
| A308 | 6.1401 | 8.7893 |
| A309 | 6.2829 | 8.6419 |
| A310 | 6.4238 | 8.4979 |
| A311 | 6.5633 | 8.357 |
| A312 | 6.7014 | 8.2191 |
| A313 | 6.8383 | 8.0842 |
| A314 | 6.9744 | 7.952 |
| A315 | 7.1097 | 7.8225 |
| A316 | 7.2445 | 7.6956 |
| A317 | 7.3789 | 7.571 |
| A318 | 7.5132 | 7.4488 |
| A319 | 7.6475 | 7.3287 |
| A320 | 7.782 | 7.2107 |
| A321 | 7.9168 | 7.0946 |
| A322 | 8.0522 | 6.9803 |
| A323 | 8.1883 | 6.8678 |
| A324 | 8.3252 | 6.7569 |
| A325 | 8.4632 | 6.6475 |
| A326 | 8.6024 | 6.5394 |
| A327 | 8.7429 | 6.4326 |
| A328 | 8.885 | 6.327 |
| A329 | 9.0288 | 6.2224 |
| A330 | 9.1745 | 6.1187 |
| A331 | 9.3222 | 6.0158 |
| A332 | 9.4721 | 5.9136 |
| A333 | 9.6244 | 5.812 |
| A334 | 9.7792 | 5.7108 |
| A335 | 9.9368 | 5.6099 |
| A336 | 10.0972 | 5.5093 |

TABLE IIIA-continued

| POINT | CAM PROFILE C-804490-A X | Y |
|---|---|---|
| A337 | 10.2607 | 5.4086 |
| A338 | 10.4275 | 5.308 |
| A339 | 10.5977 | 5.2071 |
| A340 | 10.7716 | 5.1058 |
| A341 | 10.9492 | 5.0041 |
| A342 | 11.131 | 4.9017 |
| A343 | 11.3169 | 4.7985 |
| A344 | 11.5073 | 4.6944 |
| A345 | 11.6937 | 4.5818 |
| A346 | 11.8669 | 4.4539 |
| A347 | 12.0252 | 4.3104 |
| A348 | 12.177 | 4.1589 |
| A349 | 12.3202 | 3.9984 |
| A350 | 12.4594 | 3.8326 |
| A351 | 12.59 | 3.6588 |
| A352 | 12.7113 | 3.4769 |
| A353 | 12.8269 | 3.2901 |
| A354 | 12.9296 | 3.0941 |
| A355 | 13.0187 | 2.8893 |
| A356 | 13.1018 | 2.6809 |
| A357 | 13.1768 | 2.4678 |
| A358 | 13.2475 | 2.2526 |
| A359 | 13.3151 | 2.0358 |

TABLE IIIB

| POINT | CAM PROFILE C-804490-B X | Y |
|---|---|---|
| B357 | 13.1768 | 2.4678 |
| B358 | 13.2475 | 2.2526 |
| B359 | 13.3151 | 2.0358 |
| B360 | 13.368 | 1.8121 |
| B1 | 13.3823 | 1.5718 |
| B2 | 13.3068 | 1.2952 |
| B3 | 13.1514 | 0.9918 |
| B4 | 12.9796 | 0.6904 |
| B5 | 12.8572 | 0.4156 |
| B6 | 12.7543 | 0.154 |
| B7 | 12.6543 | −0.1013 |
| B8 | 12.552 | −0.3522 |
| B9 | 12.4463 | −0.5991 |
| B10 | 12.3423 | −0.8408 |
| B11 | 12.2404 | −1.0773 |
| B12 | 12.1505 | −1.3067 |
| B13 | 12.0655 | −1.5313 |
| B14 | 11.9827 | −1.7522 |
| B15 | 11.9104 | −1.9681 |
| B16 | 11.839 | −2.1812 |
| B17 | 11.7695 | −2.3916 |
| B18 | 11.7038 | −2.5994 |
| B19 | 11.6388 | −2.8051 |
| B20 | 11.5758 | −3.0089 |
| B21 | 11.5167 | −3.2108 |
| B22 | 11.4579 | −3.4113 |
| B23 | 11.4004 | −3.6106 |
| B24 | 11.3461 | −3.8089 |
| B25 | 11.2921 | −4.0063 |
| B26 | 11.2389 | −4.2031 |
| B27 | 11.1908 | −4.3996 |
| B28 | 11.1462 | −4.596 |
| B29 | 11.1105 | −4.7931 |
| B30 | 11.0741 | −4.9906 |
| B31 | 11.0269 | −5.1875 |
| B32 | 10.9775 | −5.3844 |
| B33 | 10.9295 | −5.5819 |
| B34 | 10.8907 | −5.7814 |
| B35 | 10.8586 | −5.9831 |
| B36 | 10.8245 | −6.1857 |

TABLE IIIB-continued

| CAM PROFILE C-804490-B | | |
|---|---|---|
| POINT | X | Y |
| B37 | 10.7829 | −6.3882 |
| B38 | 10.7308 | −6.5895 |
| B39 | 10.668 | −6.7892 |
| B40 | 10.5953 | −6.9871 |
| B41 | 10.513 | −7.1828 |
| B42 | 10.4218 | −7.3761 |
| B43 | 10.3221 | −7.5669 |
| B44 | 10.2142 | −7.7547 |
| B45 | 10.0985 | −7.9396 |
| B46 | 9.9754 | −8.1211 |
| B47 | 9.8452 | −8.2993 |
| B48 | 9.7081 | −8.4738 |
| B49 | 9.5645 | −8.6444 |
| B50 | 9.4144 | −8.8111 |
| B51 | 9.258 | −8.9735 |
| B52 | 9.0957 | −9.1315 |
| B53 | 8.9274 | −9.2848 |
| B54 | 8.7532 | −9.4332 |
| B55 | 8.5733 | −9.5765 |
| B56 | 8.3878 | −9.7144 |
| B57 | 8.1966 | −9.8465 |
| B58 | 7.9997 | −9.9726 |
| B59 | 7.7972 | −10.0923 |
| B60 | 7.589 | −10.2052 |
| B61 | 7.375 | −10.3108 |
| B61.6 | 7.0246 | −10.4618 |
| B62 | 7.1551 | −10.4087 |

TABLE IIIC

| CAM PROFILE C-804490-C | | |
|---|---|---|
| POINT | X | Y |
| C357 | 13.1768 | 2.4678 |
| C358 | 13.1768 | 2.2526 |
| C359 | 13.1768 | 2.0358 |
| C360 | 13.1768 | 1.8121 |
| C1 | 13.1768 | 1.5718 |
| C2 | 13.1768 | 1.2885 |
| C3 | 13.1768 | 1.0142 |
| C4 | 13.1768 | 0.7463 |
| C5 | 13.1768 | 0.4842 |
| C6 | 12.9846 | 0.2277 |
| C7 | 12.9102 | −0.0237 |
| C8 | 12.8382 | −0.2702 |
| C9 | 12.7683 | −0.5123 |
| C10 | 12.7006 | −0.7502 |
| C11 | 12.6351 | −0.9843 |
| C12 | 12.5718 | −1.2148 |
| C13 | 12.5105 | −1.4421 |
| C14 | 12.4513 | −1.6664 |
| C15 | 12.3942 | −1.8881 |
| C16 | 12.3392 | −2.1073 |
| C17 | 12.2861 | −2.3243 |
| C18 | 12.2351 | −2.5394 |
| C19 | 12.1861 | −2.7529 |
| C20 | 12.139 | −2.9649 |
| C21 | 12.0939 | −3.1757 |
| C22 | 12.0507 | −3.3856 |
| C23 | 12.0094 | −3.5947 |
| C24 | 11.97 | −3.8033 |
| C25 | 11.9324 | −4.0117 |
| C26 | 11.8966 | −4.22 |
| C27 | 11.8627 | −4.4284 |
| C28 | 11.8306 | −4.6373 |
| C29 | 11.8002 | −4.8468 |
| C30 | 11.7716 | −5.0571 |
| C31 | 11.7446 | −5.2685 |
| C32 | 11.7194 | −5.4811 |

TABLE IIIC-continued

| CAM PROFILE C-804490-C | | |
|---|---|---|
| POINT | X | Y |
| C33 | 11.6959 | −5.6953 |
| C34 | 11.6739 | −5.9112 |
| C35 | 11.6536 | −6.129 |
| C36 | 11.6349 | −6.349 |
| C37 | 11.5981 | −6.5673 |
| C38 | 11.4217 | −6.7548 |
| C39 | 11.2337 | −6.936 |
| C40 | 11.0497 | −7.1145 |
| C41 | 10.8696 | −7.2907 |
| C42 | 10.6933 | −7.4647 |
| C43 | 10.5258 | −7.6331 |
| C44 | 10.3512 | −7.8074 |
| C45 | 10.185 | −7.9766 |
| C46 | 10.0219 | −8.1445 |
| C47 | 9.8618 | −8.3115 |
| C48 | 9.7044 | −8.4777 |
| C49 | 9.5645 | −8.6444 |
| C50 | 9.4144 | −8.8111 |
| C51 | 9.258 | −8.9735 |
| C52 | 9.0957 | −9.1315 |
| C53 | 8.9274 | −9.4332 |
| C54 | 8.7532 | −9.2848 |
| C55 | 8.5733 | −9.5765 |
| C56 | 8.3878 | −9.7144 |
| C57 | 8.1966 | −9.8465 |
| C58 | 7.9997 | −9.9726 |
| C59 | 7.7972 | −10.0923 |
| C60 | 7.589 | −10.2052 |
| C61 | 7.375 | −10.3108 |
| C61.6 | 7.0246 | −10.4618 |
| C62 | 5.1551 | −10.4087 |

What is claimed:

1. A core engaging apparatus for releasably engaging the inner surface of a hollow core on a web winding device, said core engaging apparatus comprising:

a mandrel extending along a mandrel axis from a first mandrel end to a second mandrel end and a mandrel cup releasably engaging the second mandrel end and supporting said mandrel for rotation about the mandrel axis; said mandrel comprising:

a mandrel body comprising a metallic tube member, a metallic endpiece, and a non-metallic tube portion disposed intermediate and joining the metallic tube member and the metallic endpiece;

a deformable core engaging member supported on the endpiece, at least a portion of the core engaging member deformable radially outwardly relative to the mandrel axis from a first shape to a second shape; and a mandrel nosepiece disposed at the second end of said mandrel and slidably supported on the endpiece, the mandrel nosepiece is biased by a spring to be disposed in a first position relative to the mandrel body, and the mandrel nosepiece displaceable relative to the mandrel body from the first position to a second position, wherein the mandrel nosepiece compressibly deforms the core engaging member from the first shape to the second shape when the nosepiece is displaced from the first position to the second position.

2. The core engaging apparatus of claim 1 wherein at least a portion of the core engaging member is elastically deformable.

3. The core engaging apparatus of claim 1 wherein at least a portion of the core engaging member has a substantially circumferentially continuous surface for engaging a core.

4. The mandrel of claim 1 wherein the core engaging member comprises a deformable ring.

5. The core engaging apparatus of claim 1 wherein the spring is disposed intermediate the mandrel body and the mandrel nosepiece for biasing the mandrel nosepiece from the mandrel body.

6. The core engaging apparatus of claim 5 further comprising an antirotation member for restricting rotation of the mandrel nosepiece relative to the mandrel body, the antirotation member extending from one of the mandrel body and the mandrel nosepiece, and an axially extending slot in the other of the mandrel body and the mandrel nosepiece for receiving the antirotation member.

7. The core engaging apparatus of claim 1 wherein the mandrel comprises a frustum shaped shoulder disposed near one of the mandrel ends, and wherein the deformable core engaging member is disposed intermediate the mandrel nosepiece and the frustum shaped shoulder.

8. A web winding apparatus for winding a web on a hollow core comprising:

a plurality of mandrels, each mandrel for releasably engaging the inner surface of a hollow core, each of the mandrels extending along a mandrel axis from a proximal mandrel end to a distal mandrel end, each of the mandrels comprising:

a mandrel body rotatably supported in cantilevered fashion at the proximal mandrel end from a first portion of the web winding apparatus;

a deformable core engaging member supported on the mandrel, at least a portion of the core engaging member deformable radially outwardly relative to the mandrel axis from a first shape to a second shape;

a mandrel nosepiece slidably supported on the mandrel generally near the distal mandrel end, the mandrel nosepiece biased to a first position relative to the mandrel body, and the mandrel nosepiece displaceable relative to the mandrel body to a second position, the mandrel nosepiece thereby compressibly deforming the core engaging member from the first shape to the second shape as the nosepiece is displaced from the first position to the second position; and a mandrel cupping assembly rotatably attached to a second portion of the web winding apparatus, the mandrel cupping assembly comprising a plurality of mandrel cup assemblies; each mandrel cup assembly releasably engaging the mandrel nosepiece and supporting said mandrel for rotation about the mandrel axis.

9. The web winding apparatus of claim 8 wherein each of the mandrel bodies comprise:

a metallic tube member having two ends, a metallic endpiece, and a non-metallic tube portion disposed intermediate and joining the metallic tube member and the metallic endpiece.

10. The web winding apparatus of claim 8 wherein at least a portion of the core engaging member is generally elastically deformable.

11. The web winding apparatus of claim 8 wherein at least a portion of the core engaging member has a substantially circumferentially continuous surface for engaging a core.

12. The web winding apparatus of claim 8 wherein the core engaging member comprises a deformable ring.

13. The web winding apparatus of claim 8 further comprising a spring disposed intermediate the mandrel body and the mandrel nosepiece for biasing the mandrel nosepiece from the mandrel body.

14. The web winding apparatus of claim 13 further comprising an antirotation member for restricting rotation of the mandrel nosepiece relative to the mandrel body, the antirotation member extending from one of the mandrel body and the mandrel nosepiece, and an axially extending slot in the other of the mandrel body and the mandrel nosepiece for receiving the antirotation member.

15. The web winding apparatus of claim 8 wherein the mandrel comprises a frustum shaped shoulder disposed near one of the ends, and wherein the deformable core engaging member is disposed intermediate the mandrel nosepiece and the frustum shaped shoulder.

* * * * *